US011903555B1

(12) United States Patent
Chung et al.

(10) Patent No.: US 11,903,555 B1
(45) Date of Patent: Feb. 20, 2024

(54) SURFACE CLEANING APPARATUS WITH LIGHTING

(71) Applicant: BISSELL Inc., Grand Rapids, MI (US)

(72) Inventors: Sang Hoon Chung, Holland, MI (US); Mike Luyckx, Ada, MI (US); Chris J. Harmelink, Wyoming, MI (US); Patryk Donald Akhurst, Grand Rapids, MI (US); Isaac Busken-Jovanovich, Grand Rapids, MI (US); Christopher L Hogg, Holland, MI (US); Churu Yun, Plainwell, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/283,047

(22) PCT Filed: Mar. 22, 2022

(86) PCT No.: PCT/US2022/021291
§ 371 (c)(1),
(2) Date: Sep. 20, 2023

(87) PCT Pub. No.: WO2022/212120
PCT Pub. Date: Oct. 6, 2022

Related U.S. Application Data

(60) Provisional application No. 63/169,321, filed on Apr. 1, 2021.

(51) Int. Cl.

| | |
|---|---|
| ***A47L 9/30*** | (2006.01) |
| ***A47L 7/00*** | (2006.01) |
| ***A47L 11/40*** | (2006.01) |
| ***A47L 11/30*** | (2006.01) |

(52) U.S. Cl.
CPC ..... *A47L 9/30* (2013.01); *A47L 7/0009* (2013.01); *A47L 11/302* (2013.01); *A47L 11/4083* (2013.01)

(58) Field of Classification Search
CPC ..... A47L 9/30; A47L 7/0009; A47L 11/302; A47L 11/4083
See application file for complete search history.

(56) References Cited

U.S. PATENT DOCUMENTS

| | | | |
|---|---|---|---|
| 3,679,885 | A | 7/1972 | Selley et al. |
| 5,233,723 | A | 8/1993 | Hung |
| 5,983,443 | A | 11/1999 | Redding |

(Continued)

FOREIGN PATENT DOCUMENTS

| | | | |
|---|---|---|---|
| DE | 202017104648 | U1 | 8/2017 |
| EP | 3669737 | A1 | 6/2020 |

(Continued)

*Primary Examiner* — David Redding
(74) *Attorney, Agent, or Firm* — Warner Norcross + Judd LLP

(57) ABSTRACT

The present disclosure provides a surface cleaning apparatus that includes an illumination system having lighting to illuminate a floor surface or other area being cleaned. The lighting for the illumination system includes a plurality of lights, light sources, and/or lighting zones disposed around a housing of the apparatus. The illumination system can output a condition, status, state, alert or error to a user by emitting visible light and varying an intensity, color, wavelength, temperature, or animation of the light. Methods for operating the illumination system are also provided.

19 Claims, 31 Drawing Sheets

(56) References Cited

U.S. PATENT DOCUMENTS

| | | | |
|---|---|---|---|
| 6,637,067 | B2 | 10/2003 | Paterson et al. |
| 10,272,828 | B2 | 4/2019 | White et al. |
| 2002/0038488 | A1 | 4/2002 | Paterson et al. |
| 2006/0096057 | A1 | 5/2006 | Chatfield |
| 2017/0049288 | A1 | 2/2017 | Knutson et al. |
| 2019/0090710 | A1 | 3/2019 | Marcus et al. |

FOREIGN PATENT DOCUMENTS

| | | | |
|---|---|---|---|
| WO | 2014154995 | A1 | 10/2014 |
| WO | 2020006182 | A1 | 1/2020 |
| WO | 2020072567 | A1 | 4/2020 |
| WO | 2020082066 | A1 | 4/2020 |

SURFACE CLEANING APPARATUS WITH LIGHTING

CROSS-REFERENCE TO RELATED APPLICATION(S)

The present application is the National Stage of International Application No. PCT/US2022/021291, filed Mar. 22, 2022, which claims the benefit of U.S. Provisional Application No. 63/169,321, filed Apr. 1, 2021, all of which are incorporated herein by reference in their entirety.

The present application claims the benefit of U.S. Provisional Application No. 63/169,321, filed Apr. 1, 2021, which is incorporated herein by reference in its entirety.

BACKGROUND

Surface cleaning apparatuses such as vacuum cleaners are well-known devices for removing dirt and debris from a variety of surfaces such as carpets, hard floors, or other fabric surfaces such as upholstery. Such surface cleaning apparatuses typically include a recovery system including a recovery container, a nozzle adjacent the surface to be cleaned and in fluid communication with the recovery container through a conduit, and a source of suction in fluid communication with the conduit to draw debris-laden air from the surface to be cleaned and through the nozzle and the conduit to the recovery container. Other common configurations for surface cleaning apparatus include wet/dry vacuum cleaners adapted for cleaning hard floor surfaces such as tile and hardwood and soft floor surfaces such as carpet and upholstery, upright extraction cleaners, i.e. deep cleaners, portable or handheld cleaners, unattended extraction cleaners or spot cleaners, and autonomous floor cleaners, i.e. robots.

Various surface cleaning apparatuses with illumination means have been proposed to illuminate the surface when cleaning. Such illumination means include headlights, which are effective in illuminating the surface out in front of the surface cleaning apparatuses, but otherwise have a field of view that does not adequately illuminate debris on the surface around the apparatus. Brighter lights have been used, but these require more power and increase the weight of the apparatus. Accordingly a need remains for improved illumination means for surface cleaning apparatuses.

To communicate with the user, surface cleaning apparatus have user interfaces that can visually or audibly convey information to a user. Such communication has traditionally been limited, and may provide insufficient information to the user. The location of user interfaces has also been restricted by the architecture of the apparatus, and often requires a particular line of sight between the user and the interface. It can therefore be difficult to know when information is being conveyed while operating the surface cleaning apparatus or when the user is away from the apparatus. Accordingly, a need remains for improving user experience and facilitating interaction between the user and the surface cleaning apparatus.

BRIEF SUMMARY

A surface cleaning apparatus with improved lighting is provided herein to improve user experience. The apparatus includes an illumination system with a plurality of lights, light sources, and/or lighting zones disposed around a housing of the apparatus.

According to one aspect, an upright surface cleaning apparatus includes a base adapted for movement over a surface to be cleaned and having a plurality of sides, including at least a front side, a first lateral side, a second lateral side, and a rear side, an upright body moveably mounted to the base and comprising a handle, at least one of a fluid delivery system, recovery system, or a combination thereof, a controller, and an illumination system operably coupled with the controller to receive input from the controller, the illumination system comprising lighting extending along at least at least a portion of the front side, the first lateral side, and the second lateral side of the base, wherein the lighting is configured to emit visible light onto the surface to be cleaned to produce an illumination zone extending greater than 180 degrees around the base to provide greater than 180 degrees of illumination around the base.

According to another aspect, a surface cleaning apparatus includes a housing adapted for movement over a surface to be cleaned, at least one of a fluid delivery system, recovery system, or a combination thereof, a controller, a headlight on a forward oriented portion of the housing, the headlight configured to emit visible light from the forward oriented portion of the housing, a taillight on a rearward oriented portion of the housing, the taillight configured to emit visible light from the rearward oriented portion of the housing, a first sidelight on a first laterally orientated portion of the housing, the first sidelight configured to emit visible light from the first laterally orientated portion of the housing, and a second sidelight on a second laterally orientated portion of the housing, the second sidelight configured to emit visible light from the second laterally orientated portion of the housing, wherein the headlight, taillight, first sidelight and second sidelight together provide lighting around the housing. According to yet another aspect, a surface cleaning apparatus includes a housing adapted for movement over a surface to be cleaned, at least one of a fluid delivery system, recovery system, or combinations thereof, a plurality of lighting zones carried by the housing and configured to emit visible light, a sensor configured to generate sensor data during operation of the surface cleaning apparatus, and a controller configured to process the sensor data generated by the sensor to identify, based on the sensor data, at least a first event and a second event, wherein the controller is configured to transmit a first control signal control at least one of the plurality of lighting zones to emit visible light in a first state in response to the first event, and wherein the controller is configured to transmit a second control signal to control at least one of the plurality of lighting zones to emit visible light in a second state in response to the second event.

According to still another aspect, a surface cleaning apparatus includes a housing adapted for movement over a surface to be cleaned, at least one of a fluid delivery system, recovery system, or combinations thereof, a controller, an adaptive lighting assembly comprising a first light carried by a right lateral side of the housing and configured to emit visible light outwardly from the right side of the housing onto the surface to be cleaned and a second light carried by a left lateral side of the housing and configured to emit visible light outwardly from the left side of the housing onto the surface to be cleaned, a turn sensor configured to detect a turn of the housing on the surface to be cleaned during operation of the surface cleaning apparatus and to generate turn data, a controller configured to process the turn data generated by the turn sensor to identify, based on the turn data, at least one of a turn direction and a turn angle, wherein the controller is configured to transmit a control signal to illuminate the adaptive lighting assembly based on the turn data.

According to a further aspect, a surface cleaning apparatus includes a housing adapted for movement over a surface to be cleaned, at least one of a fluid delivery system, recovery system, and combinations thereof, a plurality of light emitting elements arranged along at least one side of the housing and spaced from each other to emit a plurality of discrete spots of visible light, and a diffuser in front of the plurality of light emitting elements to diffuse the discrete spots of visible light.

According to yet a further aspect, a surface cleaning apparatus includes a housing adapted for movement over a surface to be cleaned, at least one of a fluid delivery system, recovery system, or combinations thereof, a plurality of light emitting elements arranged around a perimeter of the housing and configured to emit visible light, a sensor configured to generate sensor data during operation of the surface cleaning apparatus, and a controller configured to process the sensor data generated by the sensor to identify, based on the sensor data, one of a first event and a second event, wherein the controller is configured to transmit a first control signal in response to the first event to supply power to the plurality of light emitting elements for a first animation and to transmit a second control signal in response to the second event to supply power to the plurality of light emitting elements for a second animation.

According to still a further aspect, a surface cleaning apparatus includes a housing adapted for movement over a surface to be cleaned, at least one of a fluid delivery system, recovery system, or combinations thereof, lighting carried by the housing and configured to emit visible light onto the surface to be cleaned to produce an illumination zone extending in an arc of at least 180 degrees to provide at least 180 degrees of lighting around the housing, a sensor configured to generate sensor data during operation of the surface cleaning apparatus, and a controller configured to process the sensor data generated by the sensor to identify, based on the sensor data, one of a first event and a second event, wherein the controller is configured to transmit a first control signal to supply continuous power to the lighting to emit visible light in a steady state in response to the first event, and to transmit a second control signal to supply power intermittently to the lighting to emit visible light in an animated state in response to the second event.

According to yet another aspect, a surface cleaning apparatus includes a housing adapted for movement over a surface to be cleaned, a fluid delivery system, a recovery system, a plurality of light emitting elements arranged around a perimeter of the housing and configured to emit visible light to illuminate the surface to be cleaned, and an indicator light disposed on an upper side of the housing and configured to provide status information.

According to yet another embodiment of the invention, methods for operating the illumination system are provided.

According to one aspect a method is provided for illuminating a floor surface with a surface cleaning apparatus having a base adapted for movement over a surface to be cleaned and an upright body moveably mounted to the base, the method including detecting a turn of the base relative to the upright body, transmitting a right turn control signal to a sidelight on a right side of the base in response to detecting a clockwise turn of the upright body relative to the base, and transmitting a left turn control signal to a sidelight on a left side of the base in response to detecting a counterclockwise of the upright body relative to the base.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION

The invention generally relates to a surface cleaning apparatus with lighting. In particular, aspects of the invention relate to a surface cleaning apparatus with improved illumination of the surface to be cleaned and improved user communication and experience.

Figure 2:
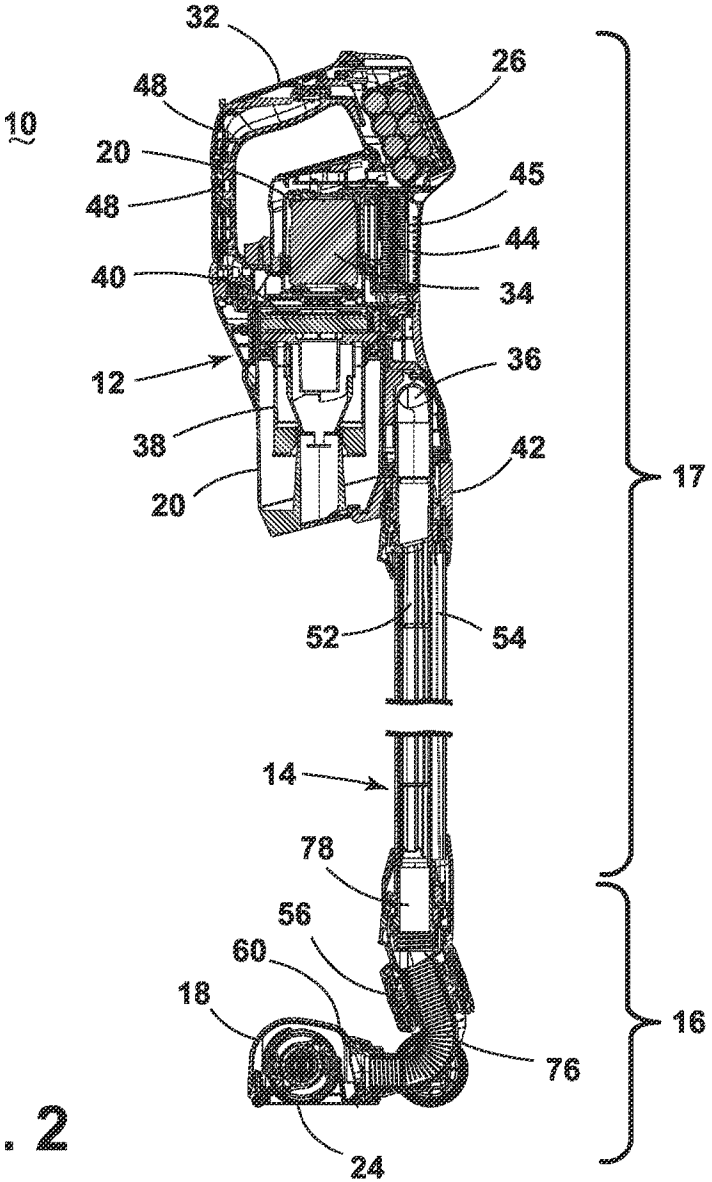
FIG. 2 is a side sectional view through the surface cleaning apparatus of FIG. 1.
Figure 1:
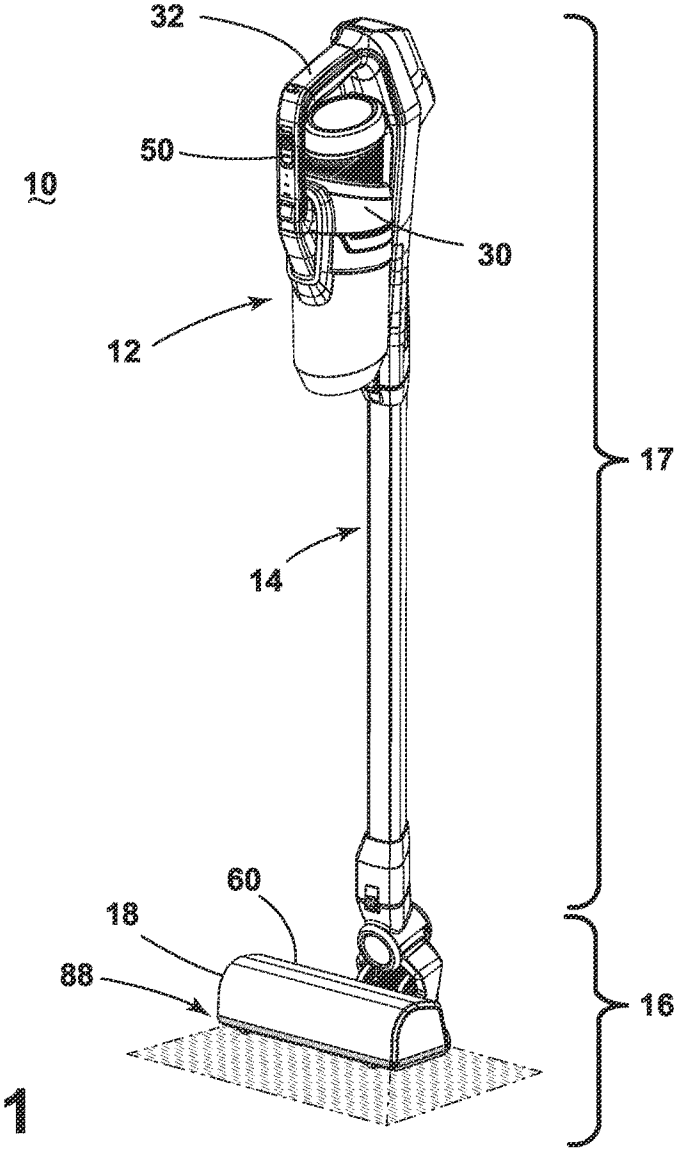
FIG. 1 is a perspective view of a surface cleaning apparatus having an illumination system according to one embodiment.

FIGS. 1-2 show a surface cleaning apparatus 10 according to one aspect of the present disclosure. As discussed in further detail below, the apparatus 10 is provided with an illumination system 88 consistent with one or more aspects of the disclosure, the details of which are described in further detail below. As explained herein, the illumination system 88 may be configured to illuminate a floor surface or other area being cleaned, function as a communication output device, and/or provide an improved user experience. The illumination system 88 may include lighting configured to emit visible light to accomplish one or more of the aforementioned functions.

As illustrated herein, in one embodiment the surface cleaning apparatus 10 can be a vacuum cleaner. As used herein, the term vacuum cleaner is intended to refer to various types of vacuum cleaners including, but not limited to, upright vacuum cleaners, canister vacuum cleaners, hand-held vacuum cleaners, stick vacuum cleaners, convertible vacuum cleaners, lift-off vacuum cleaners, and robot vacuum cleaners. In at least FIGS. 1-3, the vacuum cleaner 10 is particularly embodied as an upright, convertible vacuum cleaner that includes a vacuum unit 12, a detachable wand 14 and a cleaning foot or base 16 adapted to move over a surface to be cleaned. The apparatus 10 includes a vacuum collection system, as referred to herein as a recovery system, for removing debris from the surface to be cleaned and storing the debris, which is described in further detail below and which can include components supported on any of the vacuum unit 12, wand 14, or base 16. The apparatus 10 can vacuum dirt from a surface to be cleaned, including floor surfaces, such as carpets, hard floors, and non-floor surface. The apparatus 10 can be convertible between different modes of operation to efficiently clean different surface types and hard-to-reach areas. The vacuum unit 12 and wand 14 can collectively form an upright body 17, which can be pivotally mounted to the base 16.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the apparatus 10, which defines the rear of the apparatus 10. However, it is to be understood that the disclosure may assume various alternative orientations, except where expressly specified to the contrary. The term "dirt" includes dirt, dust, hair, and other debris, unless otherwise noted.

It should be understood that the apparatus 10 shown is for exemplary purposes only and that another surface cleaning apparatus according to embodiments of the invention described herein may not include all of the features shown in FIG. 1 and/or may include additional features not shown in FIG. 1. The functional systems of the apparatus 10 can be arranged into configurations other than that shown in FIG. 1, including as a canister device having a cleaning implement connected to a wheeled base by a vacuum hose, a portable device adapted to be hand carried by a user, an autonomous or robotic device, or a commercial device. Any of the aforementioned cleaners can be adapted to include a flexible vacuum hose, which can form a portion of the working air conduit between a nozzle and the suction source.

While primarily discussed herein in terms of a vacuum cleaner, aspects of the surface cleaning apparatus and illumination systems disclosed herein are applicable to other types of surface cleaning apparatus, including any surface cleaning apparatus having a fluid delivery system for storing cleaning fluid (e.g. liquid) and delivering the cleaning fluid to the surface to be cleaned. Aspects of the disclosure may also be incorporated into a steam apparatus, such as surface cleaning apparatus with steam delivery. Aspects of the disclosure may also be incorporated into an apparatus with only mechanical sweeping capabilities, e.g. floor sweepers.

The vacuum unit 12 can comprise a modular, handheld vacuum unit 12 that can be used independently of the wand 14 and base 16 to clean a surface. Thus, the wand 14 and base 16 are removable or detachable from the vacuum unit 12. The apparatus 10 is convertible between at least two different modes of operation, including an upright mode of operation shown in FIG. 1, in which the wand 14 and base 16 are attached to the vacuum unit 12, and a handheld mode of operation, in which the wand 14 and base 16 are detached from the vacuum unit 12. The upright mode may be useful for cleaning floor surfaces, while the handheld mode may be useful for cleaning other non-floor surfaces. The apparatus 10 can further be provided with other modes of operation, such as a remote cleaning mode of operation, in which the wand 14 is attached to the vacuum unit 12 and the base 16 is removed, which allows the apparatus 10 to clean remote or hard to reach areas. Another mode of operation is a handheld accessory mode of operation, in which the wand 14 is detached from the vacuum unit 12, and a cleaning accessory tool is attached in its place. For example, the base 16 itself can be directly attached to the vacuum unit 12. Other accessory tools (not shown) can be used in the handheld accessory mode instead of the base 16.

The vacuum collection system can include a suction nozzle 18 defining at least one suction inlet, a suction source 20 in fluid communication with the suction nozzle 18 for generating a working air stream, and a recovery container 22 for separating and collecting debris from the working airstream for later disposal.

The suction nozzle 18 can be disposed on a base or cleaning head adapted to move over the surface to be cleaned. An agitator 24 can be provided adjacent to the suction nozzle 18 for agitating the surface to be cleaned so that the debris is more easily ingested into the suction nozzle 18. Some examples of agitators 24 include, but are not limited to, a horizontally-rotating brushroll, dual horizontally-rotating brushrolls, one or more vertically-rotating brushrolls, or a stationary brush.

The suction source 20 can be any suitable suction source and is provided in fluid communication with the recovery container 22. The suction source 20 can be electrically coupled to a power source 26, such as a battery or by a power cord plugged into a household electrical outlet. A power switch between the suction source 20 and the power source 26 can be selectively closed by the user, thereby activating the suction source 20. When the suction source 20 is activated, dirt-laden working air is drawn in through the suction nozzle 18 and into the downstream collection container 22, where the dirt is substantially separated from the working air. The airstream then passes through the suction source 20 prior to being exhausted from the apparatus 10.

The vacuum unit 12 can comprise a housing 30 with a pistol-style grip 32, and can carries the suction source 20, collection container 22, and battery 26, among other components. By way of non-limiting example, the suction source 20 can includes a vacuum motor 34. The battery 26 can be provided in form of a battery pack containing one or more batteries, such as lithium-ion (Li-Ion) batteries. The battery 26 can be rechargeable, such as by connecting to an external source of power to recharge.

The vacuum system can include a working air path through the housing 30, and may include a dirt inlet 36 through which dirt-laden working air can enter the collection container 22 and a clean air outlet, such as an exhaust vent 44. The working air path can be formed by, among other elements, the suction source 20 and the container 22. A separator 38 can be formed in a portion of the container 22 for separating entrained debris from the working airstream. The separator 38 can include a cyclonic separator having one or more cyclonic separation stages. Other examples of the separator 38 include a bulk separator or filter bag, for example. A pre-motor filter 40 can be disposed in the working air path downstream of an air outlet of the container 22 and upstream of an inlet of the suction source 20. A post-motor filter 45 may also be provided. The vacuum unit 12 can include a wand connector 42 that couples the wand 14 thereto, and is in fluid communication with the dirt inlet 36. The collection container 22 can be removable from the housing 30 for emptying collected debris.

The apparatus 10 can further include at least one controller 46 operably coupled with the various function systems of the apparatus 10 for controlling its operation such as being operably coupled with the vacuum motor 34. The controller 46 can be provided at various locations on the apparatus 10, and in the illustrated embodiment is located in the vacuum unit 12, within the housing 30. The controller 46 can be a microcontroller unit (MCU) that contains at least one central processing unit (CPU). In some embodiments, the apparatus 10 can include multiple controllers 46, 47. One controller 46 may be located in the vacuum unit 12 and a second controller 47 (see FIG. 7) may be located in the base 16. In other embodiments of the apparatus 10, a single controller 46 may be disposed within the base 16, or else whereon the apparatus 10.

The controller 46, and optionally the second controller 47, can be electronically coupled with a user interface 48 through which a user can interact with the apparatus 10. The user interface 48 can be provided at various locations on the apparatus 10, and in the illustrated embodiment is located in the vacuum unit 12, on the grip 32. The user interface can enable operation and control of the apparatus 10 from the user's end, and can provide feedback information from the apparatus 10 to the user. The user interface 48 can be electrically coupled with electrical components of the apparatus 10, including, but not limited to, circuitry electrically connected to the vacuum motor 34, brush motor 62, illumination system 88, at least one sensor 102, and/or at least one other component (104), as described in further detail below. The user interface 48 can comprise one or more input controls 50, such as but not limited to buttons, triggers, toggles, keys, switches, or the like, operably connected to systems in the apparatus 10 to affect and control its operation. For example, one of the input controls 50 may comprise the power switch. The user interface 48 can also communicate a condition or status of the apparatus 10 to the user.

Figure 3:
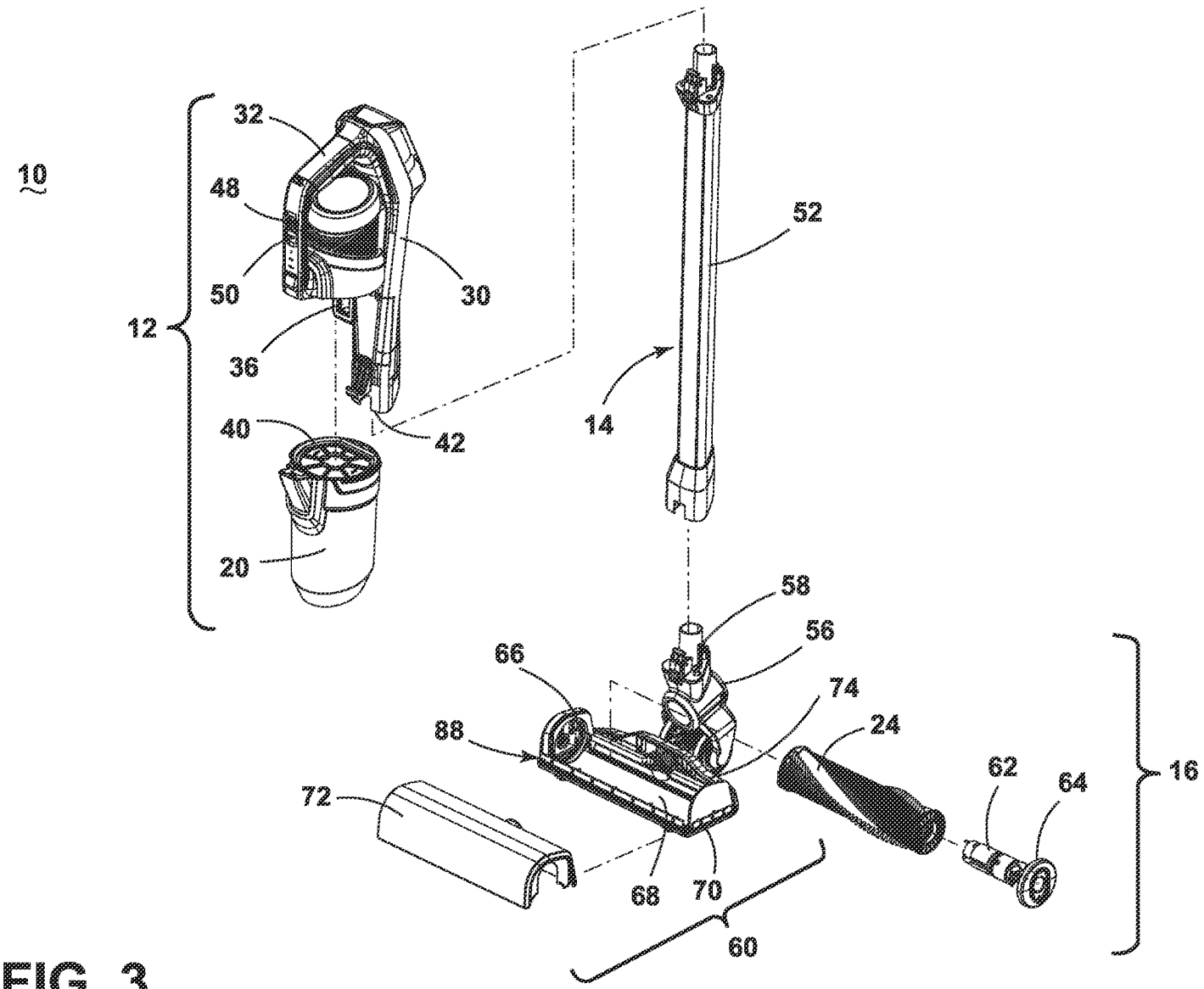
FIG. 3 is an exploded view of the surface cleaning apparatus of FIG. 1.

Referring to FIG. 3, the wand 14 defines an elongate wand conduit 52 and has a first proximal end attachable to the vacuum unit 12 and a second distal end attachable to the base 16. Coupling the wand 14 with the vacuum unit 12 places the conduit 52 in fluid communication with the collection container 22, and with the suction source 20. When connected between the vacuum unit 12 and the base 16 as shown in FIG. 1, the wand 14 defines a portion of the working air pathway between the suction nozzle 18 of the base 16 and the collection container 22 in the vacuum unit 12. When used without the base 16, the second distal end of the wand 14 can define the inlet to the working air pathway.

With the wand 14 and base 16 attached to the vacuum unit 12 as shown in FIG. 2, electrical power can be provided to one or more electrical components within the base 16, and signals can be transmitted between the unit 12 and base 16. The wand 14 can include one or more electrical conductors 54, for example insulated wires or cables, to transmit electricity, power signals, and/or data signals between the vacuum unit 12 and the base 16.

In the embodiment shown, the base 16 can be pivotally attached to the wand 14, or alternatively to the vacuum unit 12, by a swivel joint 56 for movement about at least two orthogonal axes of rotation. In one embodiment, the swivel joint 56 can be a multi-axis Cardan joint as shown in the figures, but can alternatively comprise a ball joint. A working air conduit for working air flow between the base 16, the wand 14, and the vacuum unit 12, can extend though the swivel joint 56. One or more electrical conductors 54 can extend though the swivel joint 56. In one configuration, the swivel joint 56 can include a coupler 58 that receives the second distal end of the wand 14 or the wand connector 42 of the unit 12.

The base 16 can include a base housing 60 supporting at least some of the components of the vacuum cleaner, such as the agitator 24, and including the suction nozzle 18. The agitator 24 of the illustrated embodiment is a brushroll configured to rotate about a horizontal axis and operatively coupled to a drive motor 62 via a transmission 64, which can include one or more belts, gears, shafts, pulleys, or combinations thereof. In one embodiment, the agitator 24 can comprise a motor-in-dowel configuration, with the drive motor 62 incorporated into a dowel of the brushroll. The brushroll can include one or more agitating elements, such as, but not limited to, bristles, microfiber, rubber strips, and the like. The suction nozzle 18 can define a chamber 66 for the brushroll 24 as well as an inlet opening 68 into the working air pathway. In the illustrated embodiment, the air inlet 68 is formed on a bottom or underside 70 of the base housing 60.

The suction nozzle 18 can include a cover 72 enclosing the brushroll 24 and at least partially defining the brushroll chamber 66. The cover 72 can be disposed at a forward end of a rear enclosure 74 of the base housing 60, and may be removably or non-removably attached thereto. The cover 72 can be formed at least partially from a transparent, semi-transparent, or translucent material, and may, for example, allow a user to view the agitator 24 from the exterior of the base 16. The rear enclosure 74 may house components such as the drive motor 62 for the brushroll 24, and the swivel joint 56 may be connected at the rear enclosure 74. The base housing 60 can be generally collectively defined by the cover 72 and the rear enclosure 74. Other configurations for the base housing 60 are possible.

A working airflow conduit can extends through the base housing 60 from the suction nozzle 18 to the swivel joint 56. In the embodiment shown, the airflow conduit includes a hose conduit 76 extending through the base housing 60 that is fluidly coupled to a conduit 78 of the swivel joint 56, such that an airflow pathway can be completed to the wand 14 or vacuum unit 12 by connection of the swivel joint 56 therewith. The hose conduit 76 can be flexible to facilitate pivoting movement of the swivel joint 56 about multiple axes.

Figure 5:
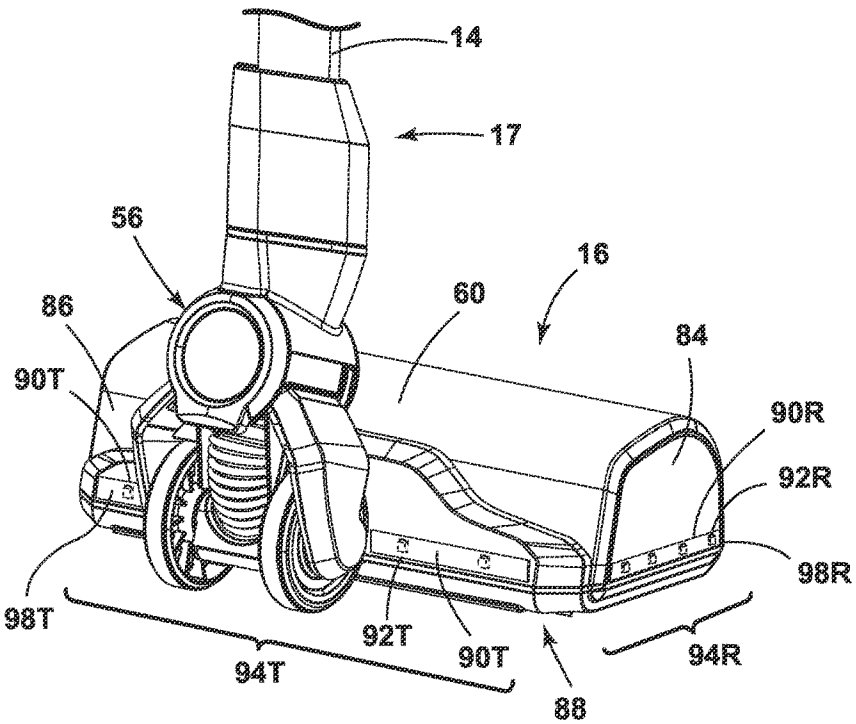
FIG. 5 is a rear perspective view of the base.
Figure 4:
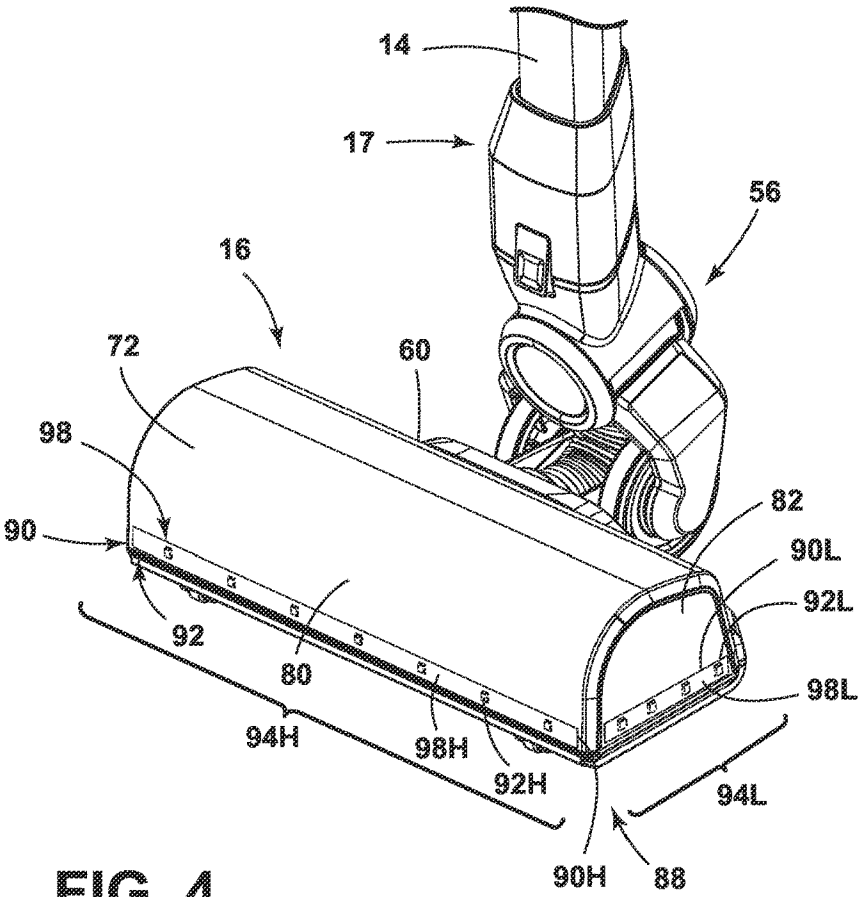
FIG. 4 is a front perspective view of a base of the surface cleaning apparatus of FIG. 1.

Turning to FIGS. 4-5, close-up perspective views of the base 16 having one embodiment of an illumination system 88 consistent with the present disclosure is shown. While the illumination system 88 is shown in combination with the base 16 of the apparatus 10, it should be appreciated that the illumination system 88 may also be included in a surface cleaning apparatus with other configurations.

The illumination system 88 includes lighting configured to emit visible light to illuminate a floor surface or other area being cleaned, function as a communication output device, and/or provide an improved user experience. The illumination system 88 can be operably coupled with the controller 46 (FIG. 2) to receive input from the controller 46. In the embodiment shown, the controller 46 is located within the vacuum unit 12 remote from the base 16, and input from the controller 46 can be communicated to the illumination system 88 via an electrical connection, which may include the electrical conductors 54 and other electrical pathways and couplings. In other embodiments, a second controller 47 (FIG. 7) for the illumination system 88 may be disposed within the base 16, and the first controller 46 may provide input to the second controller 47, and vice versa. In other embodiments of the apparatus 10, the main controller 46 may be disposed within the base 16, or else whereon the apparatus 10.

The illumination system 88 can be configured to emit visible light around at least part of the base 16. Many prior vacuum cleaners have headlights limited to emitting light out in front of the base. To improve visible of the surface to be cleaned, the lighting of the illumination system 88 can be configured to emit visible light onto the surface to be cleaned around the base 16, to provide at least 180 degrees of lighting around the base 16, alternatively to provide at least 270 degrees of lighting around the base 16, alternatively to provide 360 degrees of lighting around the base 16. For example, the illumination system 88 can be configured to emit visible light in an arc of at least 180 degrees around the base 16 to provide at least 180 degrees of lighting around the base 16, alternatively in an arc of at least 270 degrees around the base 16 to provide at least 270 degrees of lighting around the base 16, alternatively in an arc of at least 360 degrees around the base to provide 360 degrees of lighting around the base 16.

The base 16 can support at least some, and optionally all, of the components of the illumination system 88. The base 16 can have a plurality of sides, including at least a front side 80, a first lateral side 82, a second lateral side 84, and a rear side 86. Lighting can be disposed on multiple sides of the base 16, to emit visible light from multiple sides of the base 16. For example, lighting can be disposed on two of the sides, three of the sides, or four of the sides.

In the embodiment shown, the base 16 includes a rectilinear housing 60 generally having a forward oriented portion defining the front side 80, a first laterally oriented portion of the rectilinear housing defining the first lateral side 82, a second laterally-oriented portion defining the second lateral side 84, and a rearward oriented portion defining the rear side 86. For a rectilinear housing as shown, the sides 80-86 are generally oriented 90 degrees to each other, and is substantially rectangular, with the front and rear sides 80, 86 being longer than the lateral sides 82, 84. The rearward oriented portion or rear side 86 lies generally parallel to the forward oriented portion or front side 80, and these sides 80, 86. The first and second laterally oriented portions or lateral sides 82, 84 lie generally parallel to each other. In being "generally" parallel, the opposing sides of the base housing 60 may deviate up to 5 degrees, up to 10 degrees, or up to 15 degrees from parallel.

Other shapes for the base housing 60 are possible, including shapes with less than four sides, more than four sides, or non-rectangular housings with four sides. In one embodiment, the base 16 can include a triangular housing having three sides, which may be oriented at 45 to 135 degrees to each other, for example. In one embodiment, the base 16 can be circular.

The illumination system 88 can include one or more lights 90 disposed on the base 16, such as at least one headlight 90H, first sidelight 90R, second sidelight 90L, and taillight 90T. The headlight, sidelights, and taillight 90H, 90R, 90L, 90T are collectively referred to herein in some instances as lights or lighting. Each light 90 can include at least one light source 92 configured to emit at least one light beam, e.g. a directional projection of light energy radiating from the light source 92. The light source 92 can emit a plurality of light beams.

Other combinations of lights 90 are possible. For example, in other embodiments, the illumination system 88 can include a headlight and a taillight, and no sidelights. In yet other embodiments, the illumination system 88 can include a headlight and a sidelight, and no taillight. In still other embodiments, the illumination system 88 can include a taillight and a sidelight, and no headlight Each light 90 can define, at least in part, a lighting zone or emission zone 94 configured to emit a plurality of light beams outwardly from the base 16. In these and other embodiments, an emission zone 94 may be configured to direct the plurality of light beams outwardly, and optionally also downwardly, from the side of the housing 60 on which the light 90 is disposed, so as to maximize illumination of the surface around the base 16 and over which the base 16 moves during cleaning. Each emission zone 94 can produce an illuminated zone 96 on the surface to be cleaned. One example of the illuminated zones 96 are shown in FIG. 6.

In the embodiment shown in FIGS. 4-5, each emission zone 94 is disposed on one side 80-86 of the housing 60, and is defined by a plurality of light sources 92. In various embodiments, the emission zones 94 may be disposed on more than one side of the housing 60, and may wrap around a corner of the housing 60 to be disposed on more than one side of the housing 60.

Figure 6:
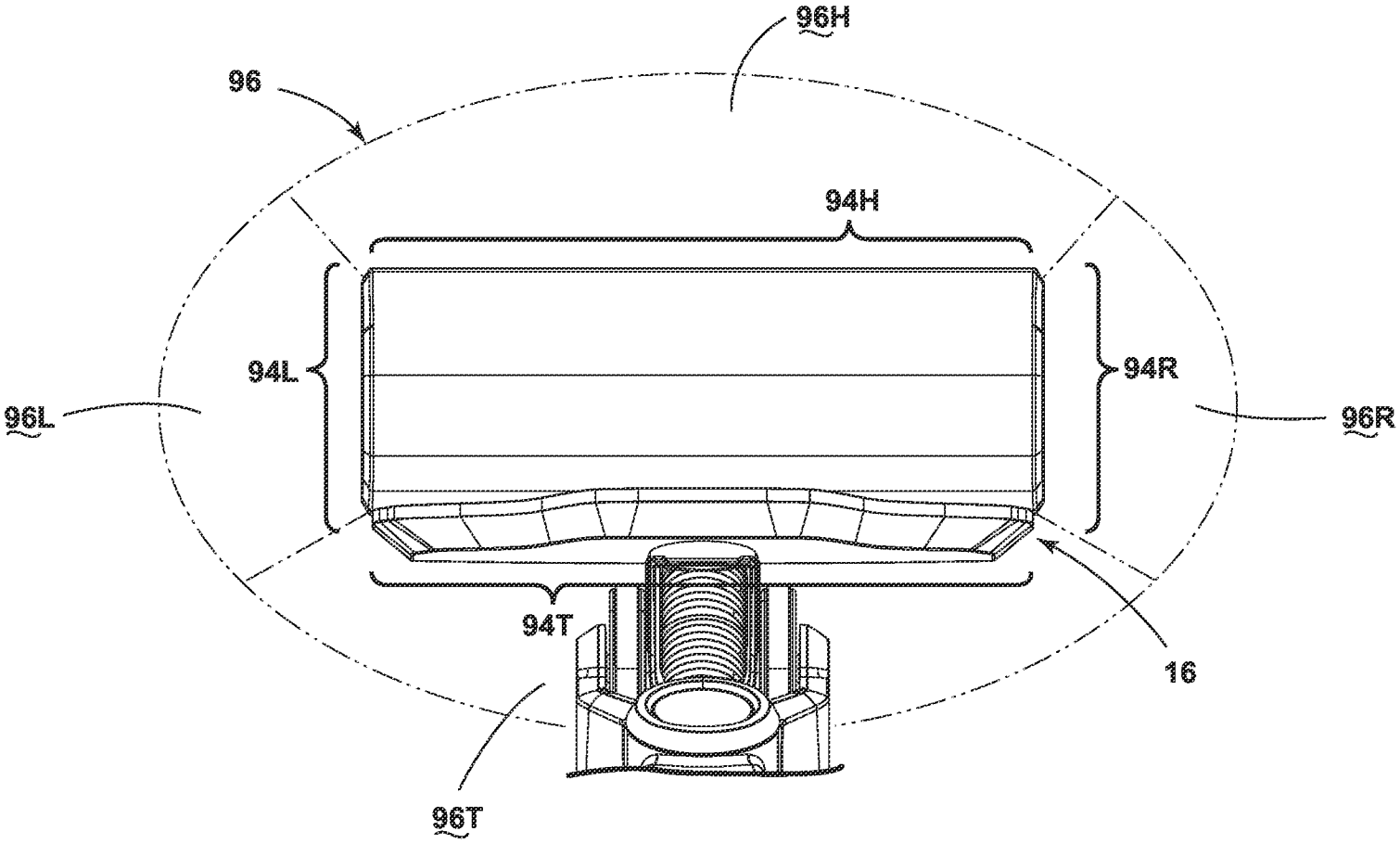
FIG. 6 is a top view of the base showing illumination zones produced by the illumination system on a surface to be cleaned.

Referring to FIGS. 4 and 6, in one embodiment, the headlight 90H is generally disposed on the forward oriented portion of the housing 60, e.g. the front side 80, and is configured to emit visible light from the housing 60 towards a first region on the surface to be cleaned in front of the forward oriented portion of the housing 60. From the headlight 90H, visible light can be cast onto the surface in front of the front side 80 of the housing 60, producing a first illuminated zone 96H. The first or front illuminated zone 96H can be defined by light beams emitted from the headlight 90H or from the front emission zone 94H. Light can be emitted from the emission zone 94H toward the front illuminated zone 96H in a manner to maximize illumination of the surface in front of the housing 60.

Referring to FIGS. 5 and 6, in one embodiment, the first sidelight 90R is generally disposed on the first laterally orientated portion of the housing 60, e.g. the first lateral side 82, and is configured to emit visible light from the housing 60 toward a second region on the surface to be cleaned outward of the first laterally orientated portion of the housing 60. From the sidelight 90R, visible light can be cast onto the surface outside of the lateral side 82 of the housing 60, producing a second illuminated zone 96R. The second or right side illuminated zone 96R can be defined by light beams emitted from the first sidelight 90R or from the right side emission zone 94R. Light can be emitted from the emission zone 94R toward the right side illuminated zone 96R in a manner to maximize illumination of the surface to the right of the housing 60.

Referring to FIGS. 4 and 6, in one embodiment, the second sidelight 90L is generally disposed on the second laterally orientated portion of the housing 60, e.g. the second lateral side 84, and is configured to emit visible light from the housing 60 toward a third region on the surface to be cleaned outward of the second laterally orientated portion of the housing 60. From the sidelight 90L, visible light can be cast onto the surface outside of the lateral side 84 of the housing 60, producing a third illuminated zone 96L. The third or left side illuminated zone 96L can be defined by light beams emitted from the second sidelight 90L or from the left side emission zone 94L. Light can be emitted from the emission zone 94L toward the left side illuminated zone 96L in a manner to maximize illumination of the surface to the left of the housing 60.

Referring to FIGS. 5 and 6, in one embodiment, the taillight 90T is generally disposed on the rearward oriented portion of the housing 60, e.g. the rear side 86, and is configured to emit visible light from the housing towards a fourth region on the surface to be cleaned behind the rearward oriented portion of the housing 60. From the taillight 90T, visible light can be cast onto the surface behind the rear side 86 of the housing 60, producing a fourth illuminated zone 96T. The fourth or rear illuminated zone 96T can be defined by light beams emitted from the taillight 90T or from the rear emission zone 94T. Light can be emitted from the emission zone 94T toward the rear illuminated zone 96T in a manner to maximize illumination of the surface behind the housing 60.

Multiple taillights 90T can be disposed on the rear side 86 of the base 16, for example to accommodate for the swivel joint 56 joining the upright body 17 with the base 16. As shown in FIG. 5, one taillight 90T is provided the right of the swivel joint 56 and another taillight 90T is provided to the left of the swivel joint 56. The two taillights 90T may collectively form the rear emission zone 94T and may together produce the rear illuminated zone 96T.

In the embodiment shown in FIG. 6, the illuminated zones 96 meet and/or overlap to produce a total illumination zone extending 360 degrees around the housing 60. In other embodiments, the illuminated zones 96 can produce a total illumination zone extending less than 360 degrees around the housing 60, such as a total illumination zone extending at least 180 degrees around the housing 60, alternative a total illumination zone extending at least 270 degrees around the housing 60. It is also contemplated that in other embodiments, the illuminated zones 96 do not meet or overlap each other, and that non-illuminated zones may separate one or more of the illuminated zones 96.

The lights 90 can distribute or emit light in a variety of beam angles, depending on the desired coverage or size of the illuminated zone 96 produced by each. For example, the lights 90 can have a beam angle of about 60 degrees to about 120 degrees, alternately about 60 to about 90 degrees, alternately at least 90 degrees. In the embodiment shown, the lights 90 each have a beam angle of at least 90 degrees. It is noted that the beam angle for any of the lights 90 may be a collective beam angle of individual light sources forming the light 90.

The illumination system 88 is configured to emit light in the visible light spectrum. For example, one or more of the lights 90 may emit white light (i.e., a combination of light in wavelengths from about 400 nm to about 700 nm). The white light may illuminate an area of the surface to be cleaned proximate the apparatus 10, e.g. proximate to the base 16. Alternatively or in addition, one or more of the lights 90 may be configured to emit visible light having another color, such as, but not limited to, red, blue, green, orange, yellow, and the like. The lights 90 can be configured to emit light in specific colors, wavelength ranges, and or patterns to convey information to the user. Alternatively or in addition, the lights 90 may be adjustable by the user to emit light in different wavelength ranges or colors. In some embodiments, one or more of the lights 90 of the illumination system 88 may be configured to emit light in the infrared (IR) spectrum and/or in the ultraviolet (UV) spectrum.

Each light 90 can include at least one light source. Referring back to FIGS. 4-5, the lights 90 can each include a plurality of light sources 92, shown in phantom line. The light sources 92 can comprises at least one light emitting element, such as, but not limited to, a light emitting diode (LED), an organic LED (OLED), a chip-on-board LED, a laser or laser diode, a regular lamp (arc lamp, gas discharge lamp, etc.), bulbs, or other light emitting device. One or more of the light sources 92 can comprise multiple light emitting elements, such as multiple LEDs.

The light sources 92 may be coupled to a support surface, which may include, but is not limited to, a printed circuit board (PCB). The PCB may include any necessary circuitry such as, but not limited to, power conditioners, voltage regulators, sensors, or the like. Alternatively, the support surface for the light sources 92 may include any mounting surface to which the light sources 92 may be secured.

The light sources 92 can be arranged in arrays extending along the sides of the base housing 60. For example, the array of light sources 92H forming the headlight 90H can extend along the length of the front side 80, and may extend substantially the entire width of the base 16. Similarly, the array of light sources 92R, 92L forming the sidelights 90R, 90L can extend along the length of the lateral sides 82, 82, and may extend substantially the entire depth of the base 16. Two arrays of light sources 92T may form the taillights 90T, and can extend along the rear side 86, on either side of the swivel joint 56.

The light sources 92 can be positioned relatively low on the base 16, and emit visible light approximately parallel to the underside 70 of the housing 60 and also to the surface to be cleaned, which can improve illumination of debris on the surface to be cleaned by elongating the shadow cast by debris, making debris appear larger and more apparent to the user. In one embodiment, the light sources 92 may be positioned at a height from the floor surface of approximately 10 mm to 50 mm, inclusive, alternatively 10 mm to 40 mm, inclusive. It was found that the light source height had a varied impact on debris illumination depending on floor type or texture. On smooth floors, such as hardwood floors, the light source height has lesser effect on debris illumination than on a more textured surface, such as carpet. This difference can be attributed to additional visual interference on the textured surface from an increased illumination field causing additional shadows from the texture elements. From this observation, it was determined that for textured surfaces, a light source height at the lower end of this range, for example at a height of around 10 mm to 20 mm, may be preferred to help reduce visual interference from surface shadowing, making debris on the surface more visible.

The lights 90 can include covers 98 for protecting the light sources 92. The covers 98 can include a transparent, semi-transparent, or translucent portion to permit emitted light to shine through to the surface to be cleaned. The covers 98 may be provided by transparent, semi-transparent, or translucent portions mounted to the base housing 60. For example, in one embodiment, the array of light sources 92H forming the headlight 90H can be positioned behind a headlight cover 98H, which can be disposed below the nozzle cover 72. In other embodiments, the covers 98 may be integrated with the base housing 60 itself. For example, in one embodiment, the headlight cover 98H can be formed by a portion of the nozzle cover 72 itself, such as by a lower front edge of the nozzle cover 72 extending to cover the headlight light sources 92H. In yet other embodiments, the light sources 92 can be uncovered. Even in embodiments where the light sources 92 are covered, the light sources 92 can be considered to be positioned along an outer portion of the base 16, or a side of the base housing 60.

The lights 90 have thus far been shown in FIGS. 4-6 to include a plurality of light sources 92 distributed along the sides of the base 16, with light beams from the light sources projecting more or less directly onto the floor surface around the base 16. Such a configuration may provide the effect of having discrete spots of illumination on the base 16. Other configurations for the lights 90 are possible.

In another embodiment, the lights 90 can include one or more light sources and a light pipe capable of conveying light emitted from the light source(s) to an exterior of the housing 60. The term "light pipe" as used herein encompasses light pipes, light guides, light tubes, optical fibers, and/or waveguides, unless otherwise noted. In such an embodiment, the light sources can be internal to the housing 60, and may be configured to emit light generally in the direction of the light pipe. The light pipe can have a light emitting surface disposed proximate an outer portion of the base 16, or side of the base housing 60, with the light emitting surface configured to emit light outward from the base 16. Thus, the lights 90 can be considered to be positioned along an outer portion of the base 16, or side of the base housing 60.

In another embodiment, the lights 90 can include a plurality of light sources and a diffuser in front of the plurality of light sources to diffuse the light emitted by the light sources and provide a uniform appearance to the lighting. The diffuser can reduce the intensity of light from the light sources, and spread it over a wider area. This can produce an even, continuous illumination without choppy visual breaks or appearing as discrete spots of illumination on the base 16. Embodiments of the illumination system 88 with diffused lighting are described in more detail below.

Figure 7:
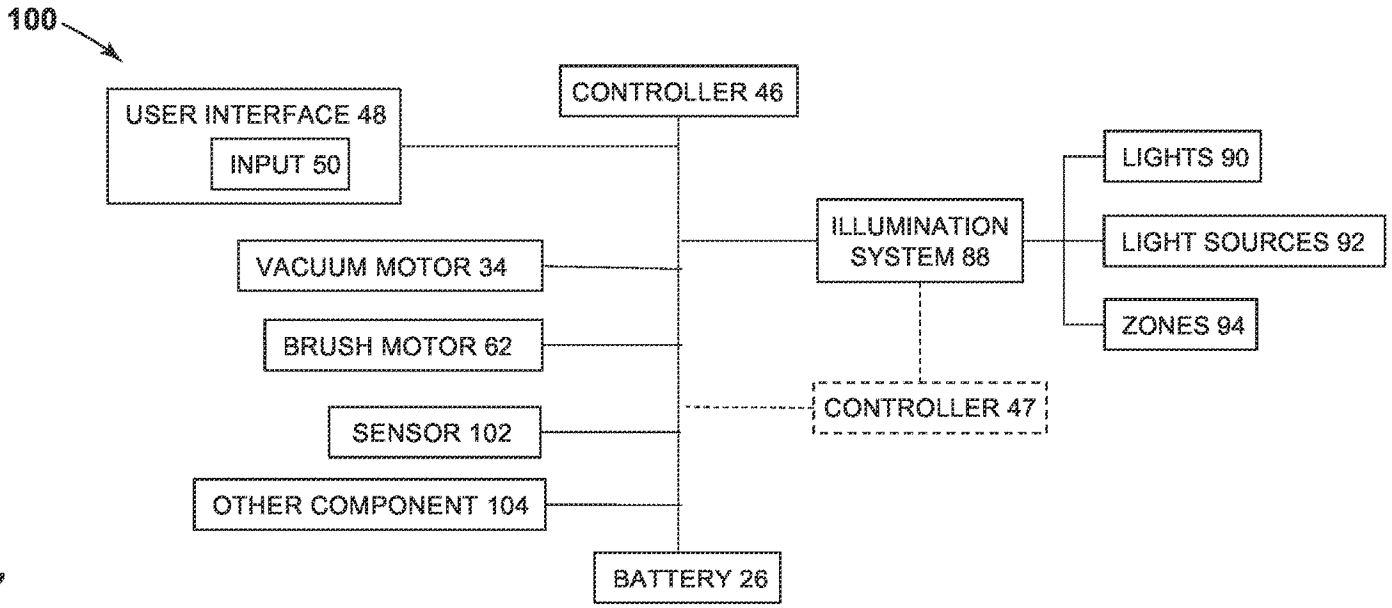
FIG. 7 is a schematic view of a control system of the surface cleaning apparatus of FIG. 1.

With reference to FIG. 7, the illumination system 88 may be powered by the power source of the apparatus 10, i.e. the battery 26, or may have a power source that is separate from that of the rest of the apparatus 10. One or more of the lights 90 of the illumination system 88 may be energized when the apparatus 10 is powered (i.e., when the power input control 50 is pressed), when cleaning in a particular cleaning mode, when a particular component of the apparatus 10 is powered (e.g., when the brush motor 62 is operating, when the vacuum motor 34 is operating, when a fluid distributor is dispensing fluid, and the like), when a service a maintenance task should be performed, to communicate a condition, status, state, alert or error to the user, and the like. Alternatively or in addition, one or more of the lights 90 may be energized when the apparatus 10 is off. For example, one or more of the lights 90 may be energized when the apparatus 10 is connected to a power supply for recharging the battery 26, when the apparatus 10 is placed on a tray or otherwise connected to a docking station, when a service or maintenance task should be performed, when a proximity sensor detects a user approaching the apparatus 10, and the like. Regardless of the power supply scheme, the illumination system 88 may be controllable to activate and deactivate individual lights 90, light sources 92, and/or zones 94, and/or to emit visible light at a particular intensity, color, wavelength, or temperature from individual lights 90, light sources 92, and/or zones 94.

The illumination system 88 can function as a visual indicator to communicate a condition of a component of the apparatus 10 and/or to communication a status change for the apparatus 10. The illumination system 88 can communicate or convey information visually to a user before, during, or after operation of the apparatus 10. For example, the illumination system 88 can emit light within one or more specific colors, wavelengths, intensities, temperatures, and/or animations to convey information about one or more parameters of the apparatus 10 including, but not limited to: that the apparatus is in a particular cleaning mode (e.g. low suction mode, high suction mode, dry cleaning mode, wet cleaning mode, carpet cleaning mode, hard floor mode, self-cleaning mode, and the like); changing between cleaning modes of the apparatus 10 (e.g. changing between a low suction mode to a high suction mode, changing between dry cleaning and wet cleaning, changing between a carpet mode in which the brushroll is rotating to a hard floor mode in which the brushroll is not rotating); when moving between an upright storage position and a reclined use position (and vice versa); moving the base 16 (e.g., forwardly, rearwardly, turning right, or turning left); that the apparatus 10 is in proximity to an obstacle; battery life (e.g., that charge level in the battery 26 has fallen below a predetermined level); suction power; filter status (e.g., that a filter is clogged or needs replacement); brushroll status (e.g., that the brushroll 24 is jammed or not rotating); the absence of the collection container 22 on the apparatus 10, remaining capacity of the collection container 22 (e.g., that the collection container 22 needs emptying); amount of debris being picked up (e.g., how dirty the surface is being vacuumed); operating time (e.g., how long the apparatus 10 has been operating); a type of floor surface below the base 16; when the apparatus 10 is placed on a storage or docking tray; when a power cord of the apparatus is plugged into an outlet; when an accessory tool is connected to a wand or hose of the apparatus 10; a change in a Wi-Fi connection status (e.g., a Wi-Fi connection being established or lost); error communication; and the like. For other embodiments of the apparatus 10 having fluid dispensing and/or recovery, the illumination system 88 can communicate or convey information relating to: a trigger being pressed or cleaning fluid otherwise being dispensed; a liquid level in a supply tank falling below a predetermined level; a liquid level in a recovery tank reaching a predetermined level; the absence of either supply tank or recovery tank on the apparatus 10; cleaning fluid being prepared for dispensing (e.g. water being heated for steam dispensing); cleaning fluid being ready for dispensing (e.g. steam is available); component dryness (e.g. how wet or dry a brushroll or cleaning fluid applicator is); surface dryness (e.g. how wet or dry the surface below the base 16 is); and the like.

In some embodiments, in addition to the visual indication provided by the illumination system 88, the apparatus 10 can include an audible output system that outputs an audible indication (e.g. voice message, tones, chimes, music, and the like) that communicate status information to the user. In certain embodiments, the controller 46 can operate the audible output system such that the audible output is coordinated with the visual indication provided by the illumination system 88.

In some embodiments, in addition to the visual indication provided by the illumination system 88, a remote computing device with a user display, e.g., a smartphone, provides an additional visual indication indicative of the status of the apparatus 10. The smartphone and the apparatus 10 wirelessly communicate with one another such that the apparatus 10 is capable of transmitting status information to the remote computing device. For example, a smartphone can receive data from the apparatus 10 causing the phone's user display to show a graphic indication and/or a message corresponding to the status of the apparatus 10. In certain embodiments, the graphic indication on the smartphone can mimic the look of the base 16 and illumination system 88 to provide a consistent visual communication across multiple devices.

FIG. 7 is a block diagram of one embodiment of a control system 100 for the apparatus 10. The controller 46 can receive input from one or more components of the apparatus 10 to control the illumination system 88. Non-limiting examples of the component include the vacuum motor 34, the brush motor 62, the user interface 48, a sensor 102, or other component 104. As discussed above, optionally a second controller 47 located in the base 16 can alternatively or additionally provide control input to the illumination system 88.

In one embodiment, the component generates data during operation of the apparatus 10. The controller 46 processes the data to identify at least one event. The controller 46 then transmits a control signal, corresponding to the identified event, to the illumination system 88. The control signal can, for example, supply power to at least one light 90, light source 92, and/or zone 94 (e.g., resulting in illumination or activation thereof), stop the supply of power at least one light 90, light source 92, and/or zone 94 (e.g., resulting in deillumination or deactivation thereof), change the intensity of visible light emitted from at least one light 90, light source 92, and/or zone 94 (e.g., dim or brighten), change the color or wavelength of visible light emitted from at least one light 90, light source 92, and/or zone 94, change the temperature of visible light emitted from at least one light 90, light source 92, and/or zone 94 (e.g. raise or lower), change an animation produced by the illumination system 88, or any combination thereof. Multiple control signals can be transmitted in response to an identified event.

In one embodiment, the controller 46 can receive input from one or more sensors 102 to control the illumination system 88. The sensor 102 is configured to detect events or changes related to the operation of the apparatus 10 or its operating environment and send the information to the controller 46 as sensor data. Non-limiting examples of the sensor 102 include a collection capacity sensor, a dirt sensor, a floor type sensor, a supply sensor, and a working air pressure sensor. Still other sensors are possible, such as, but not limited to, a filter sensor, a wheel rotation sensor, an acoustic sensor, a user proximity sensor, an accelerometer, a humidity sensor, a moisture sensor, a temperature sensor, a light sensor, a color sensor, a VOC/odor sensor, a magnetic sensor, a distance sensor, an image sensor (e.g., a camera), a radar sensor, and a laser sensor. The apparatus 10 can comprise any one of the aforementioned sensors, or any combination of aforementioned sensors. The configuration, location, and number of each sensor on the apparatus 10 can vary.

A collection capacity sensor can generate data related to the presence of debris and/or fluid in the collection container 22, and sends this information to the controller 46. The event identified by the controller 46 can be a volume of debris and/or liquid in the collection container 22 exceeding a predetermined capacity or level. The user may be notified that the collection container 22 is full via the illumination system 88.

A dirt sensor can generate data related to the dirtiness of the surface to be cleaned, and sends this information to the controller 46. Optionally, the sensor can generate data that correlates to a presence of particles in the working air pathway. The event identified by the controller 46 can be the detection of particles at or above a predetermined threshold, indicating a dirty floor, or the detection of particles below a predetermined threshold, indicating a clean floor. The user may be notified that the floor under the apparatus 10 is dirty or clean via the illumination system 88. In the case of an apparatus configured to collect liquid, the dirt sensor can comprise a turbidity sensor A floor type sensor can generate data related to a type of surface being contacted by the base 16 and sends this information to the controller 46. The event identified by the controller 46 can be a determination that floor type under the base 16 is carpet or a determination that the floor type under the base 16 is hard floor. The user may be notified of the floor type via the illumination system 88.

A supply sensor can generate data related to the presence or absence of a consumable or dispensable material stored on the apparatus 10, and sends this information to the controller 46. The event identified by the controller 46 can be the determination that the supply of the consumable or dispensable material is depleted (e.g. that a supply tank is empty). The user may be notified that the supply is depleted via the illumination system 88. In the case of an apparatus configured to dispense liquid, the supply sensor can comprise a pump pressure sensor.

A working air pressure sensor can generate data related to pressure in the working air pathway and sends this information to the controller 46. The event identified by the controller 46 can be an operational status of the vacuum motor 34, the absence of a filter (i.e. the pre-motor filter 40 or post-motor filter 45), the absence of the collection container 22, an air flow rate through a filter (i.e. the pre-motor filter 40 or post-motor filter 45), or any combination thereof. The user may be notified of the event via the illumination system 88.

The controller 46 can operate the illumination system 88 to provide a desired lighting effect. In some embodiments, the controller 46 can operate the illumination system 88 to emit light in a steady-state effect in which visible light is emitted with a generally continuous, unchanging characteristics over a period of time. In some embodiments, the controller 46 can operate the illumination system 88 to emit light in an animation in which visible light is emitted in a changing pattern and/or with changing characteristics over a period of time. Various lighting effects can be employed. Specifically, visible light may be emitted in a steady-state at times, and in an animation at other times.

During an animation, the intensity, color, wavelength, and/or temperature of emitted light can be changed, as well as which lights 90, light sources 92, and/or zones 94 of the illumination system 88 are illuminated or not illuminated. The controller 46 can, for example, control one or more of the following to produce an animation: an intensity of the light emitted, a color/wavelength of the light emitted, a temperature of the light emitted, an activation of one or more lights 90, light sources 92, or zones 94 to emit visible light, and/or how long one or more lights 90, light sources 92, or zones 94 remain activated to emit visible light.

Various lighting animations are contemplated, including, but not limited to, a pulsing or breathing animation, a flashing animation, a sunrise animation, a sunset animation, a rotating animation, a wrap-around animation, and a turning animation. FIGS. 8A-8G show some non-limiting examples of lighting animations for the illumination system 88. In FIGS. 8A-8G, the illumination system 88 is depicted schematically on the base 16, and the lights of the illuminations system are not necessarily drawn to scale relative to the base 16.

Figure 8A:
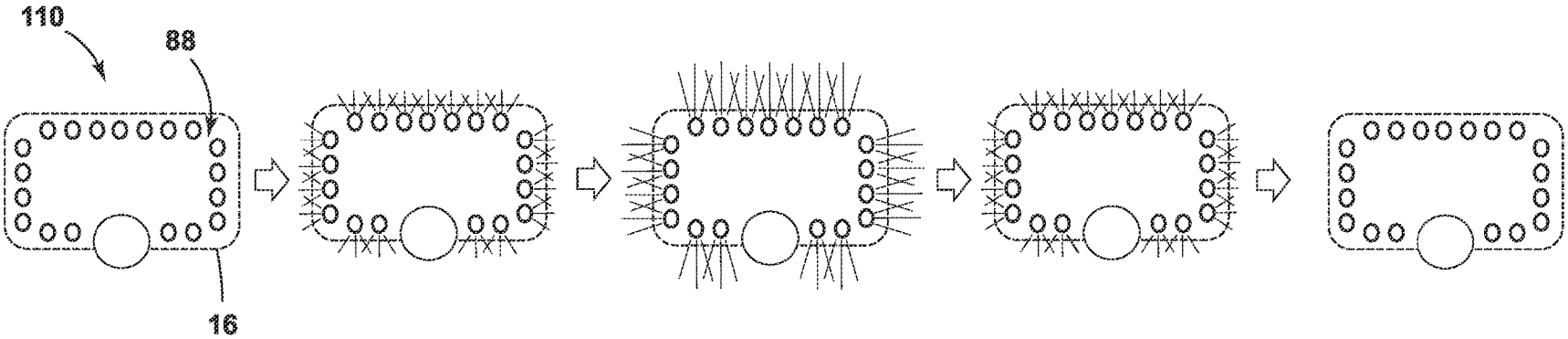
FIG. 8A is a schematic illustration of a breathing animation for the illumination system.

FIG. 8A shows one embodiment of a pulsing or breathing animation 110 for the illumination system 88. As used herein, the term "pulsing" or its variants refers to controlling the illumination of at least one light 90, light source 92, or emission zone 94 such that its light intensity increases and decreases in a generally sinusoidal manner. That is, the visible light gradually gets brighter until it reaches a peak and then gradually gets dimmer until it reaches a nadir (which may include the light completely shut off), and then this cycle repeats.

In at least one embodiment, the pulsing of visible light repeats itself with a frequency on the order of once every two to five seconds, although other frequencies may be used. By pulsing at this frequency, the emitted light changes intensity with roughly the same frequency as a human breathes, and this relatively low time period creates a non-urgent, yet persistent, visual effect.

Figures 8B, 8C, 8D:
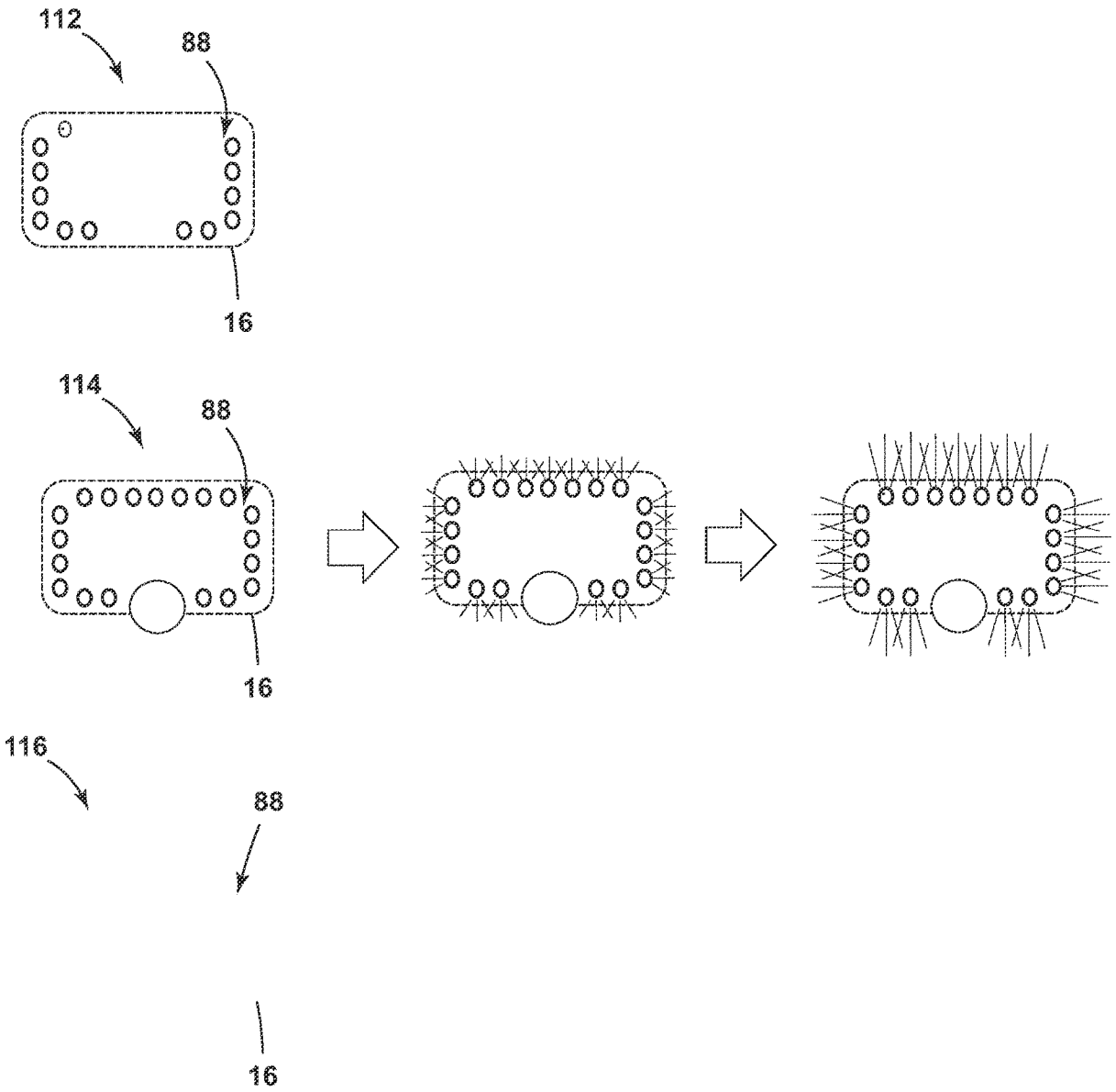
FIG. 8B is a schematic illustration of a flashing animation for the illumination system.
FIG. 8C is a schematic illustration of a sunrise animation for the illumination system.
FIG. 8D is a schematic illustration of a sunset animation for the illumination system.

FIG. 8B shows one embodiment of a flashing animation 112 for the illumination system 88. As used herein, the term "flashing" or its variants refers to controlling the illumination of at least one light 90, light source 92, or emission zone 94 such that its light intensity generally varies in a square wave fashion. Alternatively, flashing of the lights may be carried out such that the emitted light intensity varies generally as a sawtooth wave, as a triangle wave, or in some other non-sinusoidal manner.

The flashing of light may also be carried out at a higher frequency than the pulsing of light. In at least one embodiment, the flashing of visible light can repeat itself with a frequency faster than once every two to five seconds, such as, but not limited, to, at least once per second, or faster, although other frequencies may be used. This higher frequency can convey a more urgent visual effect to a human user.

FIG. 8C is a schematic illustration showing one embodiment of a sunrise animation 114 of the illumination system 88. A sunrise animation or sunrise effect refers to controlling the illumination of at least one light 90, light source 92, or emission zone 94 such that its light intensity increases at a generally steady rate. That is, visible light gradually gets brighter until it reaches a peak. For a sunrise effect, the controller 46 can active at least one light 90, light source 92, or emission zone 94 by ramping up the electrical energy delivered over a period of time to slowly increase the intensity of light emitted.

FIG. 8D is a schematic illustration showing one embodiment of a sunset animation 116 of the illumination system 88. A sunset animation or sunset effect refers to controlling the illumination of at least one light 90, light source 92, or emission zone 94 such that its light intensity decreases at a generally steady rate. That is, visible light gradually gets dimmer until it reaches a nadir (which may include the light completely shut off). For a sunset effect, the controller 46 can decrease the electrical energy delivered to an active one light 90, light source 92, or emission zone 94 over a period of time to slowly decrease the intensity of light emitted.

In some cases, the gradual changes in intensity with a sunrise or sunset effect facilitate a pleasing user experience by providing a subtle and unobtrusive, yet noticeable, visual signal to the user. Such gradual changes in intensity may be useful to convey information regarding, for example, battery level. When the apparatus 10 is recharging, a sunrise effect can convey when the battery is fully recharged, with light intensity increasing as the battery level rises. During operation of the apparatus 10, a sunset effect can convey that the battery is running out.

Figure 8E:
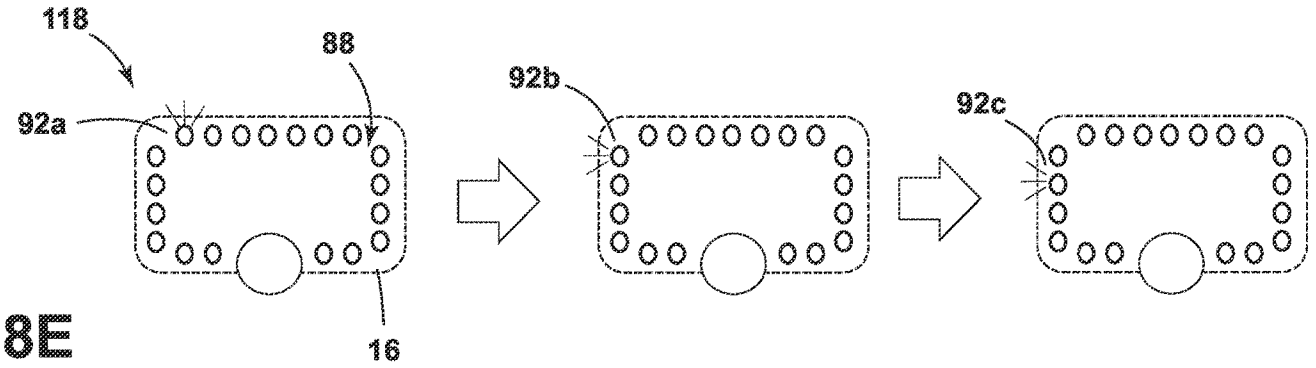
FIG. 8E is a schematic illustration of a rotating animation for the illumination system.

FIG. 8E is a schematic illustration showing one embodiment of a rotating animation 118 of the illumination system 88. A rotating animation or rotating effect refers to controlling the illumination of the lights 90, light sources 92, or emission zones 94 such that the illuminated portion appears to travel around the base 16. The illuminated portion can appears to travel in a clockwise or counterclockwise direction around the base 16.

To produce this effect, the controller 46 activates and deactivates the lights 90, light sources 92, or emission zones 94 in a sequence. For example, in the embodiment illustrated in FIG. 8E, the controller 46 can activates one light source to emit light, pauses for a predefined duration of time (e.g., 100 ms to 1 second), deactivates the light source, and then activates and deactivates an adjacent light source, and then activates and deactivates the next adjacent light source and so on. The illuminated portion can appears to travel in a clockwise or counterclockwise direction around the base 16.

In some embodiments, the controller 46 sequentially operates each of the light sources 92 such that the pattern of illumination includes sequential illumination of an entirety of perimeter of the base 16. For example, the controller 46 operates the light sources 92 one at a time, in order, to create a pattern of illumination that creates an effect of a point of light moving around the base 16. Rather than sequentially operating a light source, in some embodiments, the controller 46 simultaneously operates a subset of the light sources 92 to cause a larger portion of the perimeter to be illuminated simultaneously.

Figure 8F:
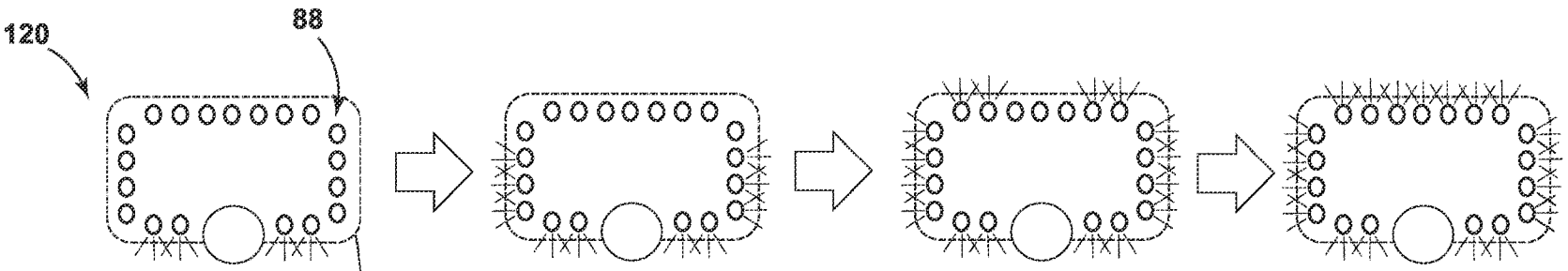
FIG. 8F is a schematic illustration of a wrap-around animation for the illumination system.

FIG. 8F is a schematic illustration showing one embodiment of a wrap-around animation 120 of the illumination system 88. A wrap-around animation or wrap-around effect refers to controlling the illumination of the lights 90, light sources 92, or emission zones 94 such that the illuminated portion appears to grow around the base 16.

The illuminated portion can appear to grow in a single direction around the base 16, i.e. in a clockwise direction around the base 16 or in a counterclockwise direction around the base 16, or appear to grow in two directions around the base, such as by wrapping from the rear of the base 16 around to the front, by wrapping from the front of base 16 around to the rear, by wrapping from one side of the base 16 around to the other side, or by wrapping from one corner of the base 16 around to the opposing corner.

In one embodiment, the animation can begin with a non-illuminated portion and an illuminated portion around the perimeter of the base 16. To provide the illuminated portion, the controller 46 activates at least one light source 92, pauses for a predefined duration of time (e.g., 100 ms to 1 second), and then activates at least one adjacent light source 92 to increase the length of the illuminated portion, pauses for a predefined duration of time (e.g., 100 ms to 1 second), and so on, until the illumination portion wraps around to its final point on the base 16. In FIG. 8F, the effect begins at the rear of the base 16 and wraps around to the front of the base 16.

Figure 8G:
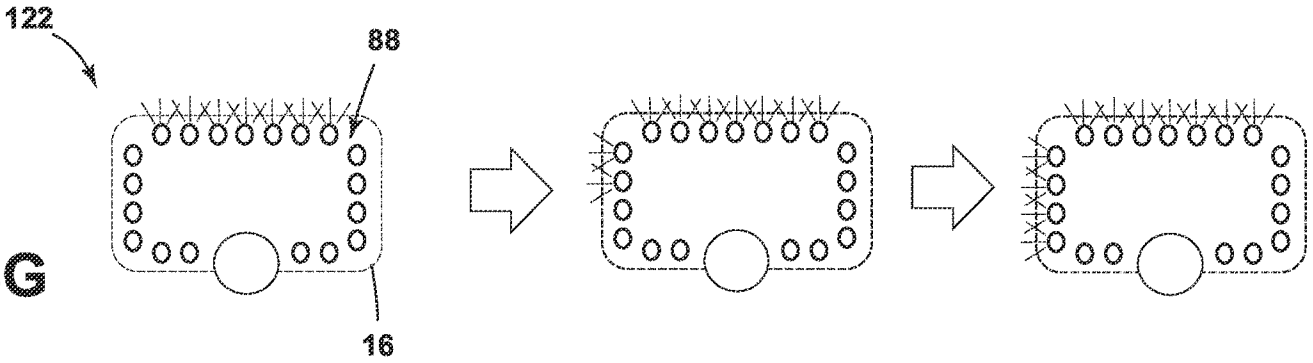
FIG. 8G is a schematic illustration of a turning animation for the illumination system.

FIG. 8G is a schematic illustration showing one embodiment of a turning animation 122 of the illumination system 88. A turning animation or turning effect refers to controlling the illumination of the lights 90, light sources 92, or emission zones 94 such that the illuminated portion appears to adapt with turning of the base 16. The illuminated portion can appear to angle to the left when the base turns left and can appear to angle toward the right when the base turns right.

In one embodiment, the turning animation can begin with an illuminated portion at the front of the base 16, e.g. by activating the headlight 90H. When the base 16 is turned, the controller 46 activates one or more light sources 92 along the corresponding turn side of the base. Optionally, the controller 46 can activate the light sources 92 along the turn side of the base in sequence from the front to rear so that the illumination portion appears to grow or increase in length as the turn is made. As the base 16 is straightened out, the turning animation can run in reverse, such that the illumination portion appears to angle back to center. In FIG. 8G, the base 16 is turned left, and the turn effect begins at the front of the base 16 and wraps around the left side of the base 16. The length of the pattern of illumination portion is usable to convey directional information to the user, for example by increasing in length as the turn angle increases, and decreasing in length as the base 16 is turned back to center.

In another embodiment, the turning animation can include controlling the illumination of at least one light 90, light source 92, or emission zone 94 such that its light intensity increases or decreases. For example, when the base 16 is turned, the controller 46 can increase the intensity of one or more light sources 92 along the corresponding turn side of the base. Optionally, the controller 46 can also decrease the intensity of one or more light sources 92 along the non-turn side of the base 16, i.e. the side of the base opposite the turn side. As the base 16 is straightened out, the turning animation can run in reverse, such that the illumination portion appears to angle back to center.

Combinations of animations are also possible, including any combination of the animations of FIGS. 8A-8G. In one embodiment for charging, the apparatus 10 is connected to an external source of power to recharge the battery 26, such by being connected by a cord to a wall adapter or placed on a changing tray. While connected to an external source of power to recharge the battery 26, a breathing animation (FIG. 8A) can convey that a charging connection is established and that the apparatus 10 is recharging. When the battery 26 is fully recharged, a sunrise animation (FIG. 8C) can convey that charging is done. The animations make the charging status of the apparatus 10 easy to view from far away and from multiple directions.

Figure 9:
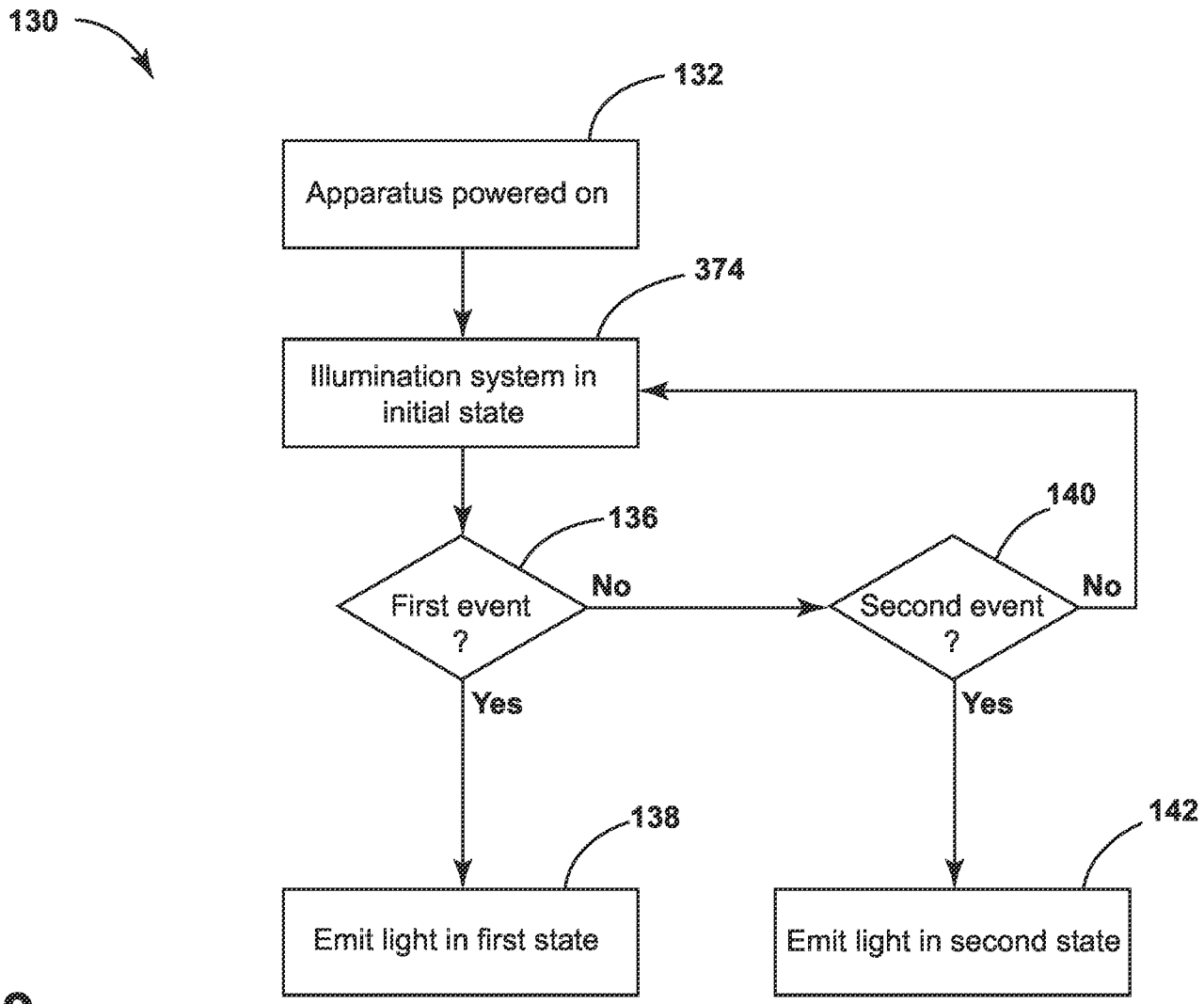
FIG. 9 is a flow chart depicting one embodiment of a method for operating the illumination system in different states depending on events at the apparatus.
Figure 11:
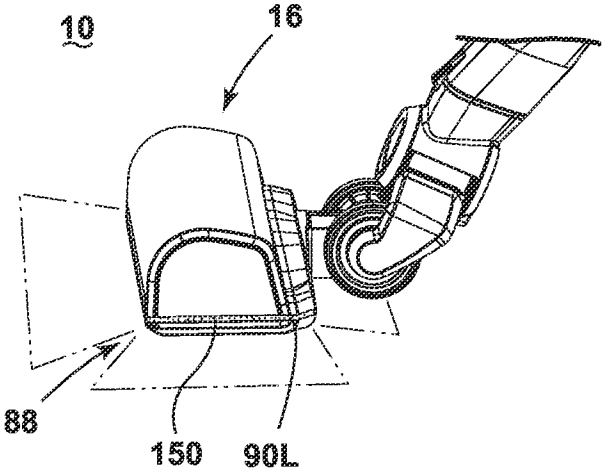
FIG. 11 is a side view of the base from FIG. 10.

Referring to FIG. 9, in another aspect, the illumination system 88 can be operable to emit light in different states depending on the occurrence of different events at the apparatus 10. FIG. 9 depicts one such method 130 for operating the illumination system 88 of the apparatus 10. The controller 46 can be configured to execute the method 130, for example by including software for executing the method 130.

When the apparatus 10 is powered on at step 132, the illumination system 88 can be in an initial state at step 134. Various initial states are possible, including an initial state where the illumination system 88 is off and no light is emitted, or an initial state where at least one light 90, light source 92, or zone 94 of the illumination system 88 is activated to emit visible light. For example, one initial state may include all lights 90, light sources 92, or zones 94 activated in a steady state.

During operation of the apparatus 10, the controller 46 determines whether a first event occurs at step 136, and if so the illumination system 88 emits light in a first state at step 138. In the first state, visible light is emitted from at least one light 90, light source 92, or zone 94. In this regard, upon seeing visible light emitted in the first state, a user understands that the first event has occurred or is occurring. During operation of the apparatus 10, the controller 46 determines whether a second event occurs at step 140, and if so, the illumination system 88 emits light in a second state at step 142. In the second state, visible light is emitted from at least one light 90, light source 92, or zone 94. In this regard, upon seeing visible light emitted in the second state, a user understands that the second event has occurred or is occurring.

A state of the illumination system 88 is a lighting state in which visible light is emitted from at least one light 90, light source 92, or zone 94 in an intensity, color, wavelength, temperature, or animation associated with that state. The second state is different from the first state in one or more these aspects. For example, different lights 90, light sources 92, or zones 94 may be active, or a different intensity, color, wavelength, temperature, or animation may be associated with the second state.

An event, including the first event and the second event of FIG. 9, may be a condition of a component of the apparatus 10 and/or a status change for the apparatus 10. Examples of events include, but are not limited to, changing between cleaning modes of the apparatus 10 (e.g. changing between a low suction mode to a high suction mode, changing between dry cleaning and wet cleaning, changing between a carpet mode in which the brushroll is rotating to a hard floor mode in which the brushroll is not rotating), when moving between an upright storage position and a reclined use position (and vice versa), moving the base 16 (e.g., forwardly, rearwardly, turning right, or turning left), when the apparatus 10 is in proximity to an obstacle, battery life (e.g., that charge level in the battery 26 has fallen below a predetermined level), suction power, filter status (e.g., that a filter is clogged or needs replacement), brushroll status (e.g., that the brushroll 24 is jammed or not rotating), the absence of the collection container 22 on the apparatus 10, remaining capacity of the collection container 22 (e.g., that the collection container 22 needs emptying), amount of debris being picked up (e.g., how dirty the surface is being vacuumed), operating time (e.g., how long the apparatus 10 has been operating), a type of floor surface below the base 16, when the apparatus 10 is placed on a storage or docking tray, when a power cord of the apparatus is plugged into an outlet, when an accessory tool is connected to a wand or hose of the apparatus 10, a change in a Wi-Fi connection status (e.g., a Wi-Fi connection being established or lost), error communication, or the like. For other embodiments of the apparatus 10 having fluid dispensing and/or recovery, the illumination system 88 can communicate or convey information relating to a trigger being pressed or liquid otherwise being dispensed, a liquid level in a supply tank falling below a predetermined level, a liquid level in a recovery tank reaching a predetermined level, the absence of either supply tank or recovery tank on the apparatus 10, and the like.

To determine whether a particular event has occurred, the controller 46 can process data or input from one or more components and/or sensors of the apparatus 10, for example as described above with respect to FIG. 7. After identifying an event, for example at step 136 or 140 of FIG. 9, the controller 46 can then transmits a control signal, corresponding to the identified event, to the illumination system 88 in order to operate the illumination system 88 in a lighting state associated with the identified event. It is noted that while the method 130 of FIG. 9 shows the controller 46 identifying first and second events, it is possible for the controller 46 to identify more than two. Each event can have a predefined lighting state associated with it.

The identified event can be indicated for a predetermined period of time at step 138 or 142, after which the illumination system 88 can return to the initial state at step 134, or move to another state. In another embodiment, the illumination system 88 can remain in the first or second state until another event occurs or until an action by a user (e.g., pressing a button on the apparatus 10 to dismiss the event notification or taking action to address the event), after which the illumination system 88 can return to the initial state at step 134, or move to another state. For example, as long as the brushroll 24 is jammed, the illumination system can remain in the state associated with a jammed brushroll. When the user fixes the jam, the illumination system can return to the initial state or move to another state.

As noted above, the illumination system 88 can be operable to emit visible light in different colors or wavelengths. In some embodiments, the illumination system 88 can include multiple light sources 92, each one corresponding to a different color. During operation of the illumination system 88, the controller 46 can select a light source 92 for one of the lights 90 and then operate the light to emit a visible light corresponding to the color of the selected light source 92. In some cases, the controller 46 operates the lights 90 such that one or more light sources 92 emit one color and one or more light sources 92 simultaneously emit another color. In some cases, the controller 46 operates a subset of light sources 92 to emit light simultaneously of a single color. The controller 46 then controls the same subset of light sources 92 to emit light of another color, thereby causing the effect that the illumination system 88 is cycling through multiple colors of illumination. In some cases, the controller 46 operates the illumination system 88 to emit a predefined pattern of colors depending on an event at the apparatus 10.

In some embodiments, the illumination system 88 can emit visible light in a first color, such as white, during normal operation and when the apparatus 10 is functioning properly, e.g. there are no status or error changes. To convey an event such as a change in status or an error condition, the illumination system 88 can change the color of the emitted visible light from the first color to a second color, such as red, blue, green, orange, yellow, and the like. In this regard, upon seeing the color change, a user understands that a status of the apparatus 10 has changed, or the apparatus 10 is in an error condition. For the method 130 of FIG. 9, the illumination system 88 can emit visible light in a first color (such as white) for the initial state, a second color (such as orange or amber) for the first state, and a third color (such as red) for the second state.

In one example, the illumination system 88 can function as a mode indicator for indicating a cleaning mode of the apparatus 10, and the first and second events can comprise switching to different cleaning modes. The illumination system 88 can have a different illumination state for each cleaning mode of the apparatus 10, and as such can be a suction level indicator and can illuminate to show a current level of suction power as it changes during operation. More specifically, the system 88 can indicate a level of suction between "high," "medium," and "low" suction powers. For example, repeated pressing of one of the input controls 50 on the vacuum unit 12 can cycle through the "high," "medium," and "low" suction power levels, and the system 88 can illuminate in sequence accordingly. It will be understood that, in the illustrated example, the input control 50 is configured to operate the suction source 20 at low, medium, and high suction power, which in turn operates the vacuum motor 34 at predetermined low, medium and high rotational speeds. In one example, the intensity of emitted light may increase as suction level/motor speed increases. In another example, a rate or speed of an animation may increase as suction level/motor speed increases. This provides a visual association between light intensity and suction power, which enhances a user's perception of a more powerful cleaning operation.

In another example, the first and second events can comprise positions of the upright body 17 relative to the base 16. In some embodiments, the upright body 17 of the apparatus 10 is pivotable with respect to the base 16 from an upright position wherein the upright body 17 is generally transverse to the base 16 or oriented vertically, to a reclined position wherein the upright body 17 is reclined. The first event can comprise the apparatus 10 powered on and in the upright position, and the second event can comprise reclining the upright body 17 to the reclined position. A sensor 102 such as a tilt switch can determine when the body 17 is reclined or upright. A lighting state associated with the first event may be, for example, activating the headlight 90H, sidelights 90R, 90L, and taillight 90T at a first intensity. A lighting state associated with the second event may be, for example, increasing the intensity of light emitted from the headlight 90H.

FIGS. 10-13 show another embodiment of the illumination system 88 for the apparatus 10. In the illustrated embodiment, the lights 90 can include a plurality of light sources (not shown) and at least one diffuser 150 in front of the plurality of light sources to diffuse the light emitted by the light sources. The diffuser 150 reduces the intensity of light from the light sources, and spreads it over a wider area. This can produce uniform illumination, reducing eye strain for users and pets.

Figure 13:
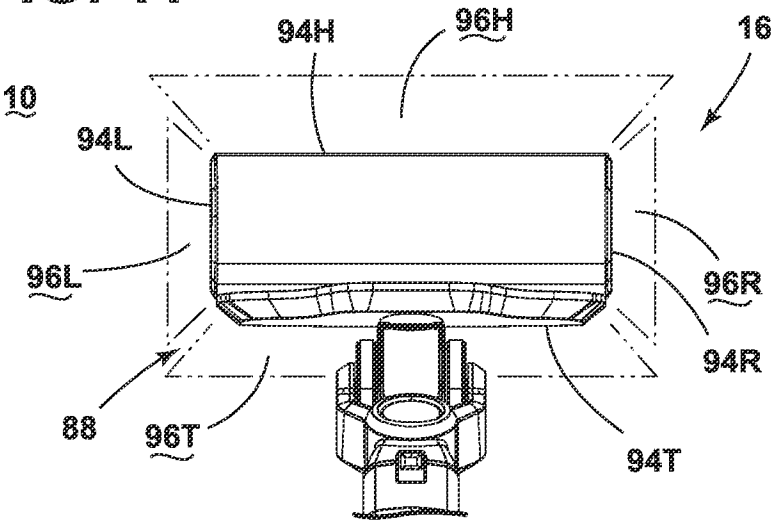
FIG. 13 is a top view of the base from FIG. 10.
Figure 10:
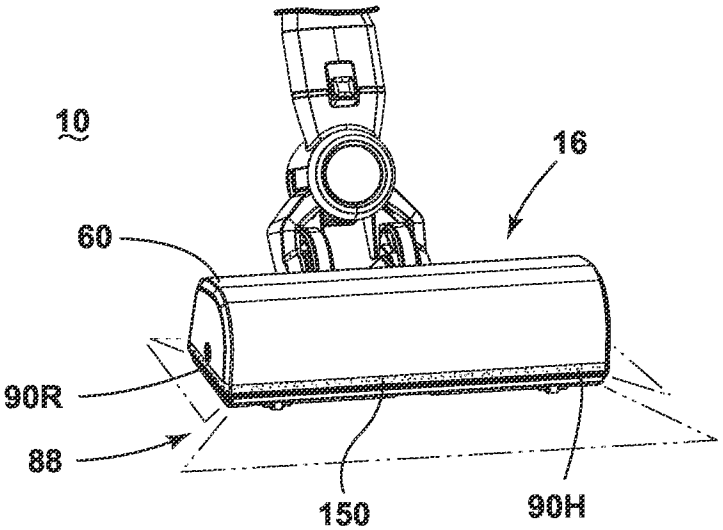
FIG. 10 is a front perspective view of a base of a surface cleaning apparatus having an illumination system according to another embodiment of the invention.
Figure 12:
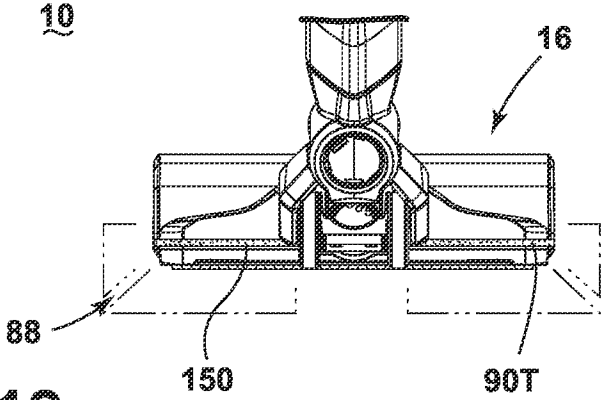
FIG. 12 is a rear view of the base from FIG. 10.

In the embodiment shown in FIGS. 10-13, the lighting of the illumination system 88 can include at least one headlight 90H, first sidelight 90R, second sidelight 90L, and taillight 90T, with each light defining, at least in part, a corresponding emission zone 94H, 94R, 94L, 94T. Each emission zone can produce a corresponding illuminated zone 96 on the surface to be cleaned. One example of the illuminated zones 96H, 96R, 96L, 96T are shown in FIG. 13. In FIG. 13, the illuminated zones meet and/or overlap to produce a total illumination zone extending around the front and sides of the housing 60, as well as at least partially around the rear of the housing 60.

The light sources for the headlight 90H, sidelights 90R, 90L, and taillight 90T preferably comprise light emitting diodes (LEDs), but may in other embodiments comprise other light emitting devices, such as, but not limited to, organic LEDs (OLEDs), chip-on-board LEDs, lasers or laser diodes, regular lamps (arc lamps, gas discharge lamps, etc.), or bulbs. The LED height from floor surface may be, for example 10 mm to 40 mm inclusive, as previously disclosed.

The diffuser 150 can be disposed on multiple sides of the base 16, to diffuse visible light emitted from multiple sides of the base 16. For example, the diffuser 150 can be disposed on two of the sides, three of the sides, or four of the sides. In various embodiments, the diffuser 150 may wrap around a corner of the housing 60 to be disposed on more than one side of the housing 60. As such, a single diffuser can cover a plurality of light sources for a plurality of lights 90. In other embodiments, separate diffusers can be provided for the lights 90, light sources 92, or zones 94.

The diffuser 150 can be made of a light transmittable material configured to transmit at least some light from the light sources, while reducing the intensity of the light and spreading it over a wider area, causing a diffused light appearance. As used herein, the term "light transmittable material" includes materials that are translucent and materials that are transparent, unless otherwise noted. Various light transmittable materials for the diffuser 150 are possible, including, but are not limited to, acrylic, polycarbonate, and other clear plastics.

In some embodiments, the light transmittable material can comprise a light-scattering fillers or additive that cause light dispersion in the material to help diffuse and blend hot-spots of light, Some examples of suitable fillers include, but are not limited to, crystalline barium sulfate and polymer diffusion powders. In embodiments where the diffuser 150 is a light pipe to transfer light internally, no fillers or light-scattering additives are used in order to allow light to pass uninterrupted along the full length of the light pipe.

In other embodiments, the diffuser 150 can comprise a clear lens or cover with molded optics on an inside face of the lens. The molded optics can be a texture or optical features that cause light dispersion molded into a back side (e.g. the side facing the LEDs) of the diffuser 150.

In yet other embodiments, the diffuser 150 can comprise a light transmittable material with applied film that causes light dispersion, or a light transmittable material with a applied coating that causes light dispersion.

Figure 15:
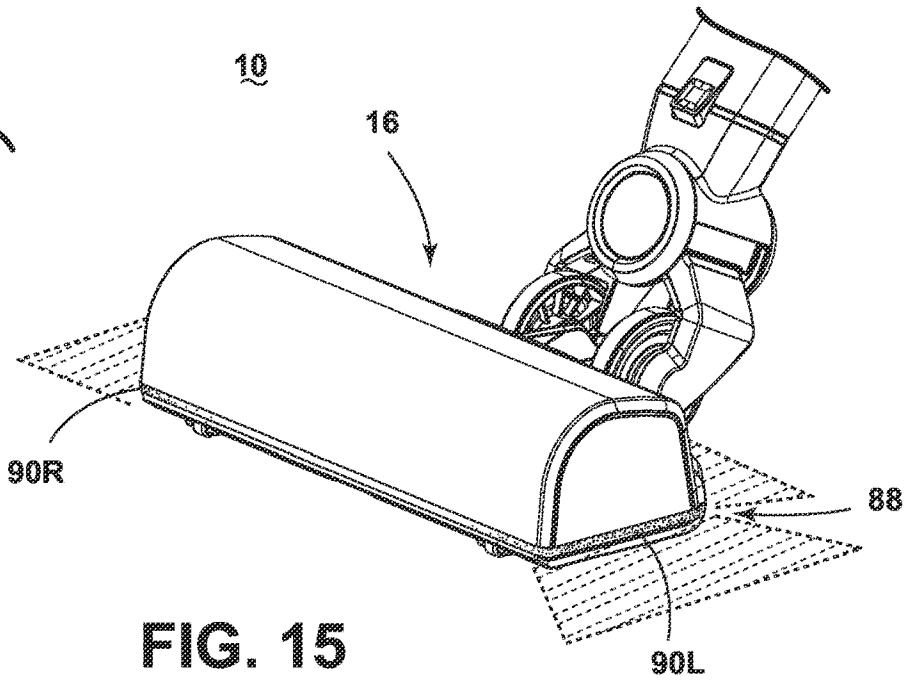
FIG. 15 is a front perspective view of the base from FIG. 10, showing the illumination system in an error state.
Figure 14:
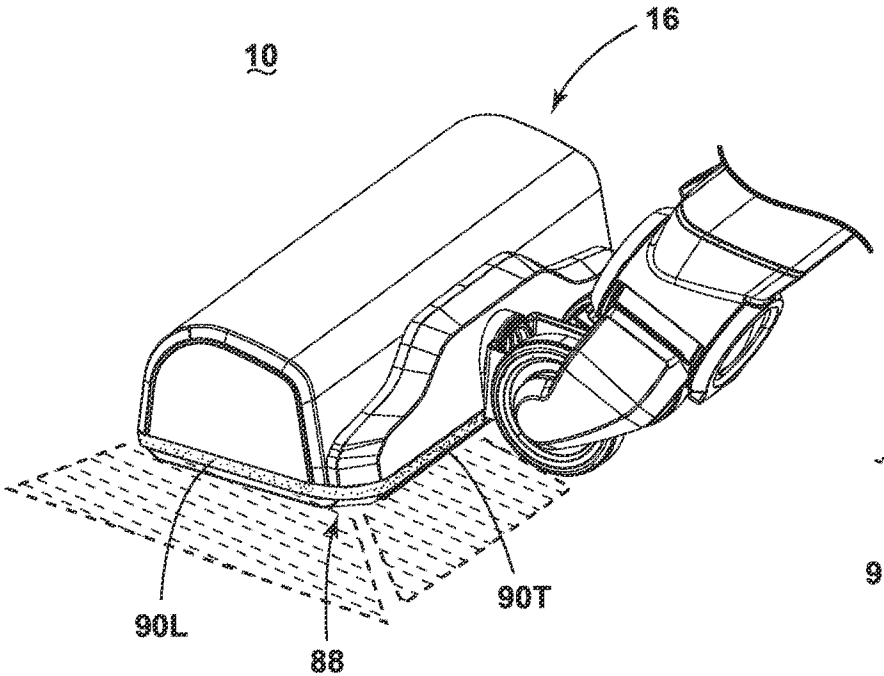
FIG. 14 is a rear perspective view of the base from FIG. 10, showing the illumination system in an alert state.

FIGS. 14-15 illustrate the illumination system 88 of the vacuum cleaner of FIGS. 10-13 functioning as a visual indicator to communicate the status of the apparatus 10 during operation. A normal operation status can be conveyed by emitting light of a first color, wavelength, intensity, and/or temperature, an example of which is shown in FIGS. 10-13 where visible light is emitted as white light (represented as an illuminated area around the base 16 in a phantom line having a first pattern). An alert can be conveyed by emitting light of a second color, wavelength, intensity, and/or temperature, an example of which is shown in FIG. 14 where visible light is emitted as orange or amber light (represented as an illuminated area around the base 16 in a phantom line having a second pattern). An error can be conveyed by emitting light of a third color, wavelength, intensity, and/or temperature, an example of which is shown in FIG. 15 where visible light is emitted as red light. Using different colors to indicate the current status of the apparatus 10 in real time makes alerts and errors easy to recognize and distinguish from each other. Since users typically look down at the floor while cleaning, illumination around the base 16 is in the normal line of sight for the user.

An alert may be a condition of the apparatus 10 that the user should address, though may not need to be addressed immediately. Some non-limiting examples of conditions that may be communicated as an alert include that the battery life is low or that the collection container 22 is almost full. An error may be a condition of the apparatus 10 that prevents proper operation of the apparatus 10 and that the user should address with urgency. Some non-limiting examples of conditions that may be communicated as an error include the brushroll being jammed, the collection container 22 being full, or a supply of cleaning fluid being empty.

In some embodiments, the controller 46 can operate the illumination system 88 to emit light indicating a normal operation state (FIG. 10-13), an alert state (FIG. 14), or an error state (FIG. 15) in a steady-state effect in which visible light is emitted with a generally continuous, unchanging characteristics over a period of time. In other embodiments, the controller 46 can operate the illumination system 88 to emit light in an animation for the normal operation, alert, and/or error states.

In one embodiment, the apparatus 10 can execute the method described above with respect to FIG. 9, where the initial state comprises the normal operational state shown in FIG. 10-13, the first state comprises the alert state shown in FIG. 14, and the second state comprises the error state shown in FIG. 15. The initial or normal operational state can comprise emitting white light in a steady-state effect. The alert state can comprise emitting orange or amber light in a pulsing or breathing animation, creating a non-urgent, yet persistent, visual effect. The error state can comprise emitting red light in a flashing animation, creating a more urgent visual effect.

To further create a recognizable and distinguishable effect, different portions of the illumination system 88 may be illuminated for the normal operation, alert, and error states. In one embodiment, the headlight 90H, sidelights 90R, 90L, and taillight 90T may emit light in the normal operation state. For the alert state, the headlight 90H may be tuned off, and the sidelights 90R, 90L, and taillight 90T may emit orange or amber light, optionally in a pulsing or breathing animation. For the error state, the headlight 90H may be tuned off, and the sidelights 90R, 90L, and taillight 90T may emit red light, optionally in a flashing animation. Emitting colored light from the sides and rear of the base 16 in the alert and error states may draw the user's attention quickly.

FIGS. 16-22 show one embodiment of the light diffusing structure for the illumination system 88 of FIGS. 10-15. The illumination system 88 includes at least one end-lighted light pipe. The end-lighted light pipe shown in FIGS. 16-22 is specifically for the headlight 90H, although it is understood that an end-lighted light pipe structure can be used for either sidelight 90R, 90L or taillight 90T. As described in further detail below, in order to provide a greater variety of animation possibilities, the sidelights 90R, 90L and taillights 90T can be forward-firing.

Figure 17:
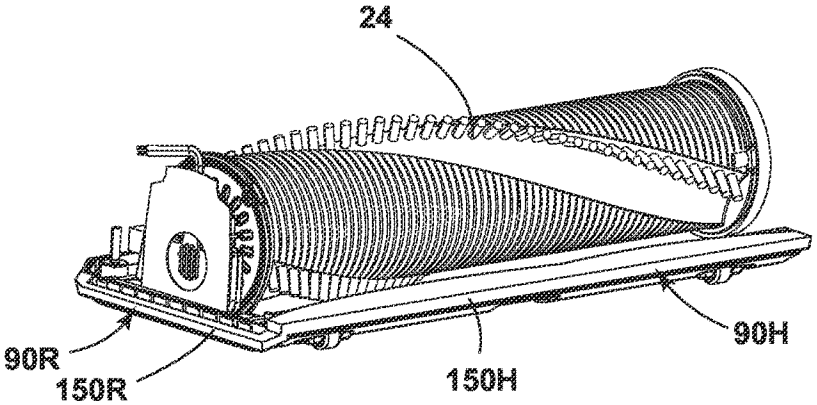
FIG. 17 is a front perspective view of the light diffusing structure of FIG. 16, also showing a sole plate and brushroll of the base.
Figure 16:
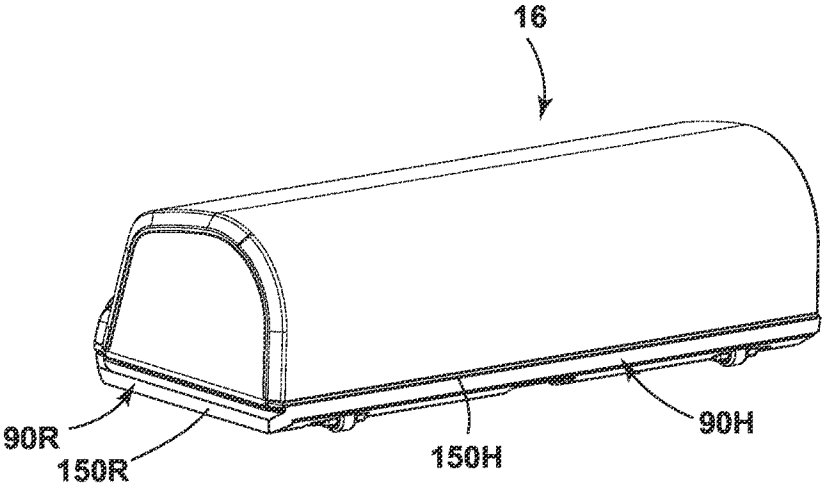
FIG. 16 is a front perspective view of the base with a light diffusing structure for the illumination system of FIG. 10, also showing a sole plate and brushroll of the base.
Figure 18:
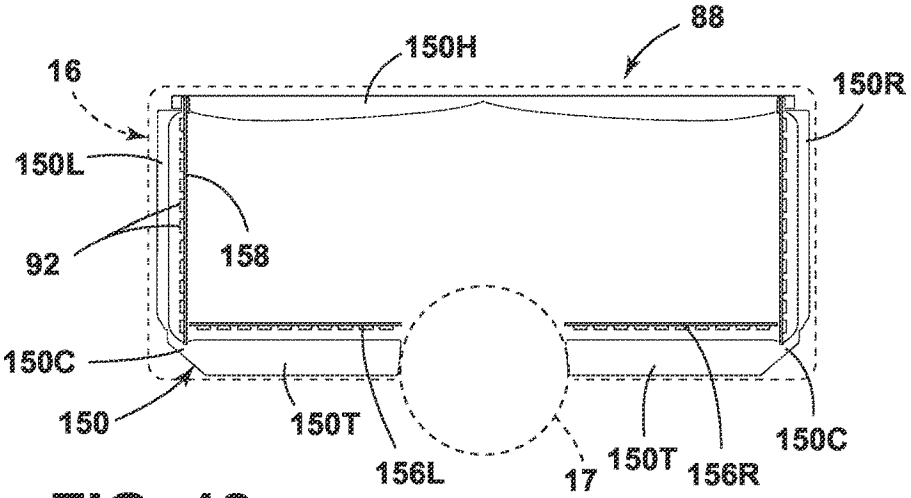
FIG. 18 is a top view of the light diffusing structure of FIG. 16, with the base indicated in phantom line.

In FIG. 16-17, one orientation of the diffuser relative to the brushroll 24 and a sole plate 152 of the base 16 is shown. The diffuser 150 is generally disposed below the brushroll 24 and above the sole plate 152. Further, the diffuser 150 can extend around a substantial portion of the perimeter of the sole plate 152. The sole plate 152 can provide at least partial support for the diffuser 150 and light sources. In FIG. 18, the base 16 is schematically depicted in phantom line.

The diffuser 150 is disposed in front of the plurality of light sources 92 to diffuse the light emitted by the light sources. The diffuser 150 comprises a molded diffusing element wrapping around the base 16, and may be formed in a single piece or in multiple pieces. In the embodiment shown, where the base 16 is generally rectilinear, the diffuser 150 includes a front diffusing element 150H, a first side diffusing element 150R, a second side diffusing element 150L, and two rear diffusing elements 150T. The diffusing elements can extend over a substantial portion of each side of the base 16, including around corners of the base 16. In this embodiment, the side and rear diffusing elements may be molded as a single piece. To extend around the rear corners, this molded piece can be formed with front corner portions 150C. In embodiments where the diffuser wraps around the front corners of the base, similar front corner portions may be provided.

Figure 19:
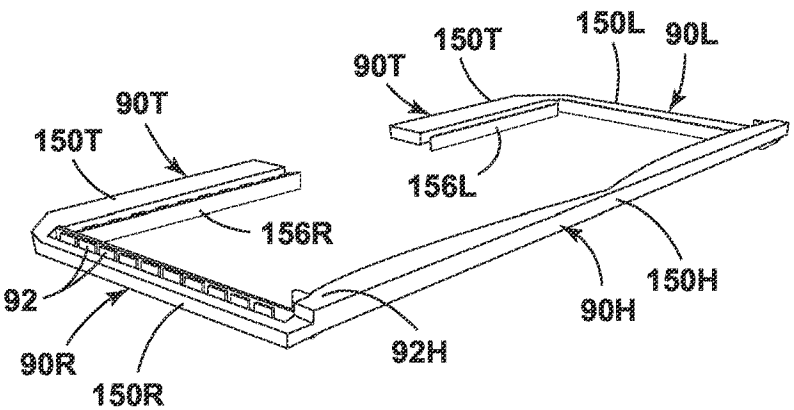
FIG. 19 is a front perspective view of the light diffusing structure of FIG. 16.
Figure 20:
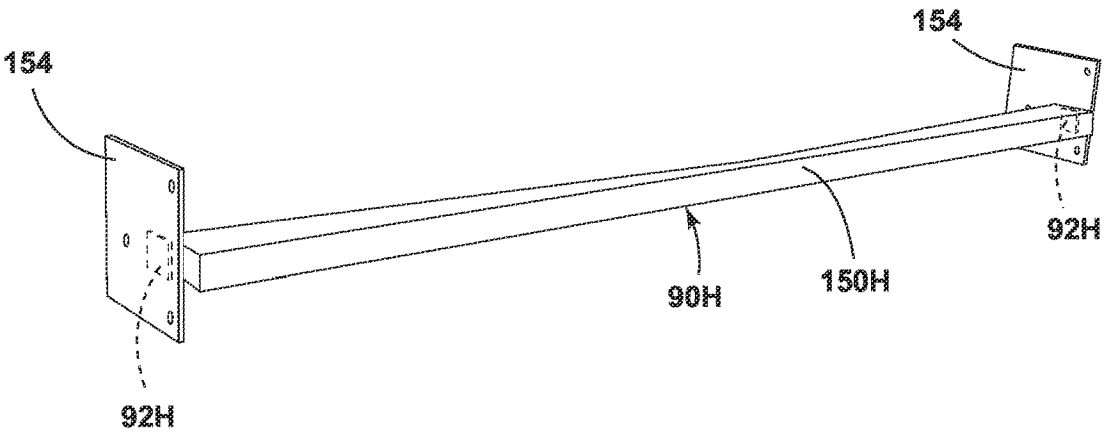
FIG. 20 is a perspective view of a portion of a headlight of the light diffusing structure of FIG. 16, the headlight including an end-lighted light pipe.
Figure 21:
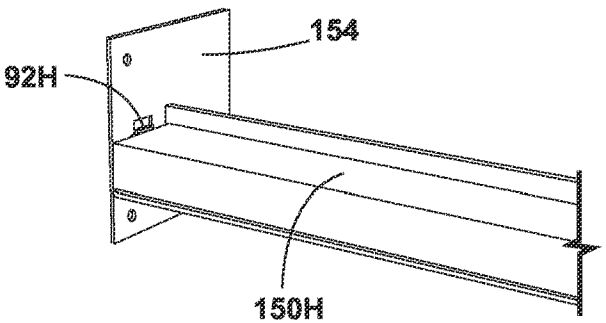
FIG. 21 is a close-up view of one end of the headlight from FIG. 20.

Referring to FIGS. 19-21, the headlight 90H includes two end-mounted LEDs 92H, including a first LED at one end of the elongated front diffusing element 150H and a second LED at opposite end of diffusing element 150H. The LEDs 92H are mounted on circuit boards 154 spaced apart on the front of the base 16, and are configured to emit visible light perpendicular to the surface of the circuit board 154. The circuit boards 154 can be situated parallel to the front of the base 16.

The headlight LEDs 92H are preferably single color, high-powered LEDs to get a bright light effect with lower power. Depending on the amount of heat produced by the LEDs 92H, in some embodiments, a heat sink (not shown) may be provided.

Figure 22:
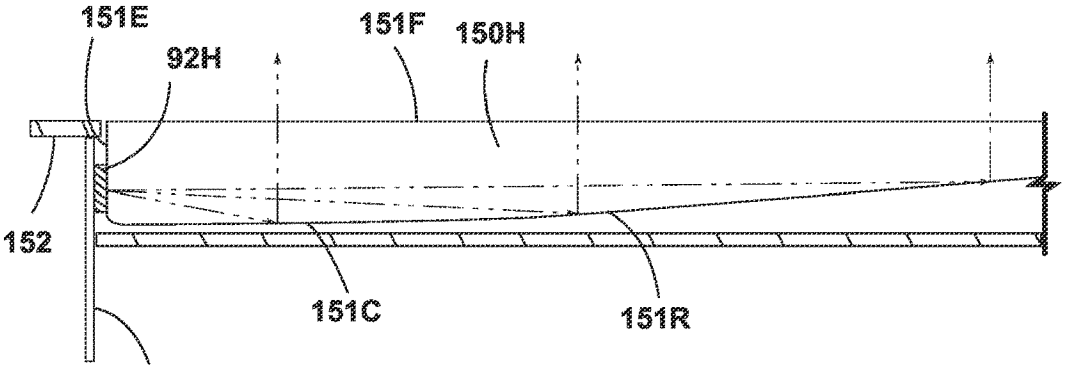
FIG. 22 is a top view of one end of the headlight from FIG. 20.

Referring to FIGS. 21-22, the front diffusing element 150H can comprise a light pipe. The shape of the light pipe 150H is designed to create an even distribution of light. The shape allows for more or less light reflection as the light travels from the LEDs 92H, directly affecting the brightness to maintain a uniform appearance.

The LEDs 92H are position at each end face 151E of the light pipe 150H, which can comprise a clear light pipe reflector lens with generally flat end faces 151E, a flat forward surface 151F, and a shaped or curved rear surface 151R. The rear surface 151R can curve outwardly in two directions, generally from a middle portion of the light pipe 150H to the end faces 151E (see FIG. 19) to propagate light from the end-mounted LEDs 92H along the length of the light pipe 150H to provide a substantially uniform illumination.

The rear surface 151R of the light pipe 150H comprises an opaque white reflective coating forming a reflecting face 151C that reflects the light traveling along the light pipe 150H to illuminate outward from the rear surface 151R. The light projects from the reflecting face 151C through the forward surface 151F. The outputted illumination appears very bright and uniform.

No lens or covering for the headlight 90H is required, as the light pipe 150H can serve as a lens itself. The forward surface 151F of the light pipe 150H therefore forms an exterior surface of the base 16 that is visible to the user. The light pipe 150H and circuit board 154 can be at least partially supported by the sole plate 152, portions of which are shown in FIG. 22, or by another portion of the base housing.

Referring to FIGS. 18-19, the sidelights 90R, 90L and taillight 90T can comprise one or more RGB color LED light strips 156R, 156L, e.g. with the LEDs 92 shining straight outwardly from a flexible circuit board 158. The flexible circuit board 158 can allow for installation and mounting of the strip on curved and/or uneven surfaces. In the embodiment shown, a first light strip 156R is mounted behind the right diffusing element 150R and one of the rear diffusing elements 150T, bending to follow the contour of the right rear corner 150C. A second light strip 156L is mounted behind the left diffusing element 150R and the other rear diffusing element 150T, bending to follow the contour of the left rear corner 150C.

The RGB light strips 156R, 156L are individually addressable by the controller 46 to allow for animation. If the red, green, and blue components of each LED are energized together, white light can be produced. Alternatively, instead of RGB light strips, RGBW light strips can be used that can allow more accurate color temperature adjustment to match the temperature of the single color headlight LEDs 92H.

With the single color, end-mounted LEDs 92H, the illumination system 88 may produce simple light animations and/or a gradient light effect with the headlight 90H. For example, the headlight 90H may produce a breathing animation, a flashing animation, a sunrise animation, or a sunset animation, as previously described. More complex light animations and/or light effects can be produced with the RGB light strips 156R, 156L of the sidelights 90R, 90L and taillight 90T. For example, the sidelights 90R, 90L and taillight 90T may produce a rotating animation, a wrap-around animation, or a turning animation.

Other light diffusing structures for the illumination system 88 of FIGS. 10-15 are contemplated. FIGS. 23-39 show additional embodiments of light diffusing structures for the illumination system 88.

Figure 23:
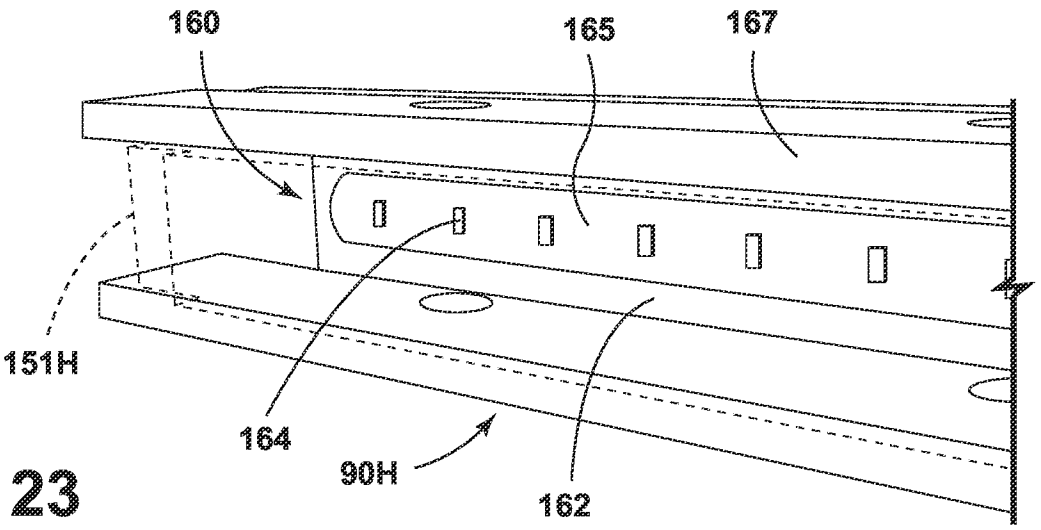
FIG. 23 is a close-up perspective view of another embodiment of a headlight for the base.
Figure 24:
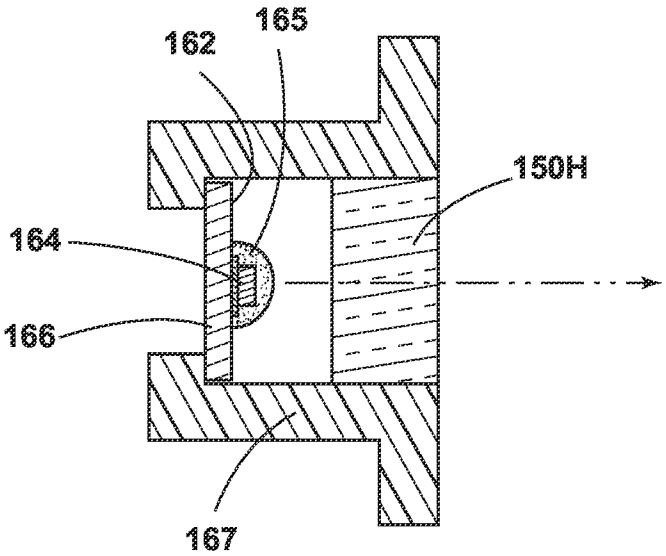
FIG. 24 is a cross-sectional view of the headlight from FIG. 23.

FIGS. 23-24 show another embodiment of a headlight 90H for the base 16. The headlight 90H includes a chip-on-board LED ("COB") light 160. The COB light 160 can include a COB strip 162 behind the diffusing element 150H, both of which extend along the front side of the base 16 (only a portion of which is shown in FIG. 23). The COB strip 162 can have multiple LED chips 164 bonded directly to a substrate or PCB 166.

The COB strip 162 can be mounted within the base 16, and covered by the diffusing element 150H. The COB strip 162 and diffusing element 150H can be supported by a housing 167, and the housing 167 may itself be attached to or formed in part by the sole plate 152 (see FIGS. 16-17), and/or may be attached to or formed in part by another portion of the base housing.

In some embodiments, the LED chips 164 can be tightly spaced miniature surface-mount blue LEDs (e.g. emitting light having a wavelength of 452 to 470 nm) covered by an encapsulant 165 comprising clear silicone infused with phosphor. The phosphor is excited by the blue light and in turn releases white light. The tight spacing of the LED chips 164 allow the PCB to be placed closer to the diffusing element 150H, thereby conserving space within the base 16 while still creating a very uniform diffusion of the light output.

With the COB strip 162, the LED chips 164 may be activated or deactivated (e.g. turned on or off), and may produce very simple light animations, such as a flashing animation as previously described. In some embodiments, the COB strip 162 may not produce complex light animations, intensity changes, or color changes. In an alternative embodiment, a segmented COB strip can be used, with the segments of the COB strip being individually addressable by the controller 46 to allow for more complex light animations, intensity changes, or color changes.

Figure 27:
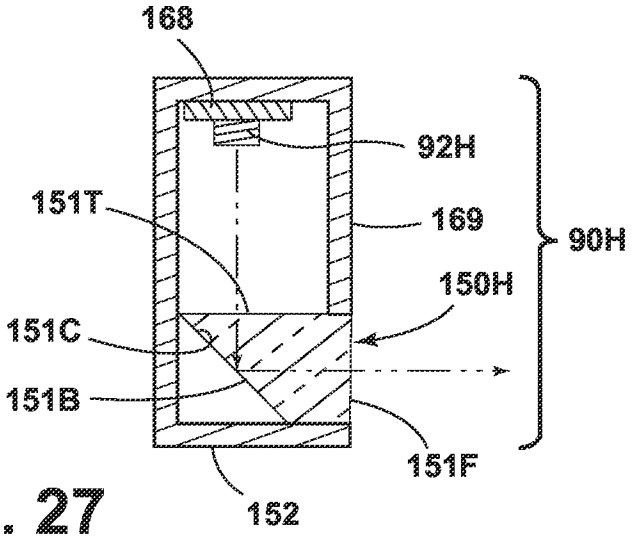
FIG. 27 is a schematic side view of a headlight for the light diffusing structure of FIG. 25.
Figure 25:
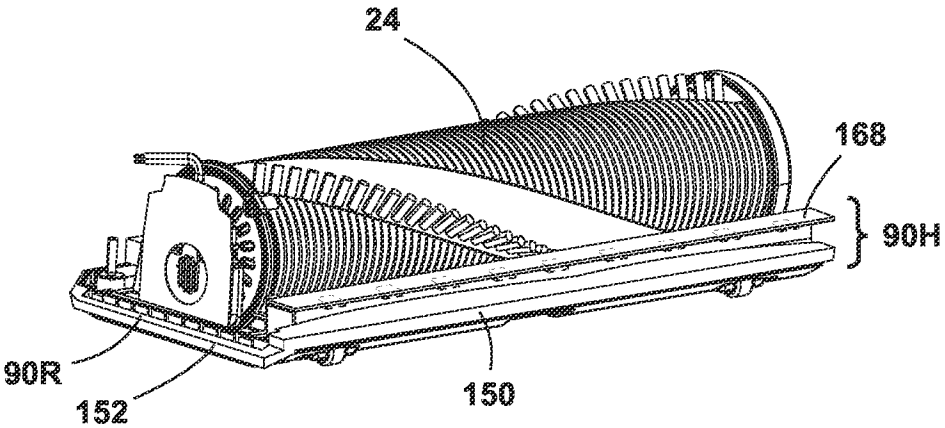
FIG. 25 is a front perspective view of another embodiment of a light diffusing structure for the illumination system of FIG. 10, also showing a sole plate and brushroll of the base.
Figure 26:
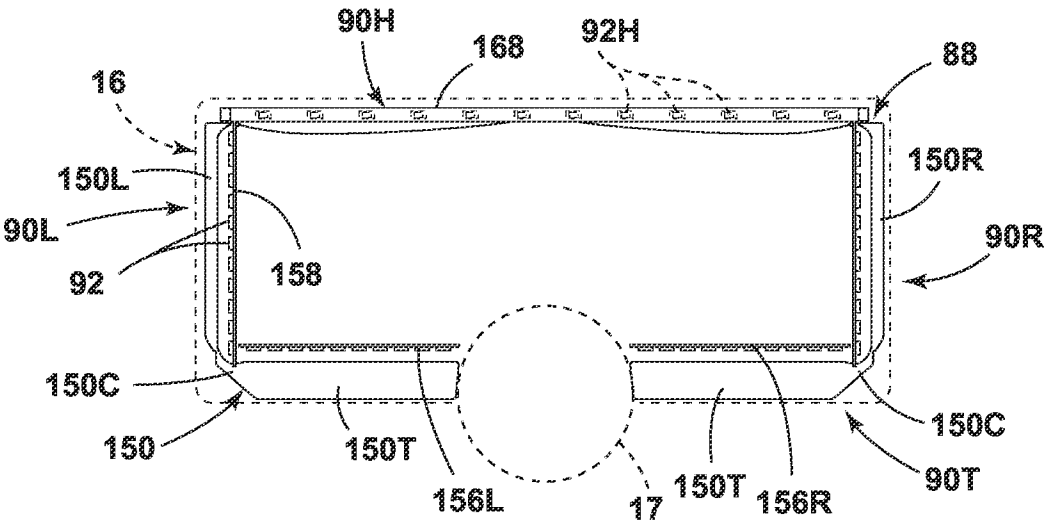
FIG. 26 is a top view of the light diffusing structure of FIG. 25, with the base indicated in phantom line.

FIGS. 25-27 show another embodiment of a light diffusing structure for the illumination system 88. The illumination system 88 includes a remote-fire light. The remote-fire light shown in FIGS. 25-27 is specifically the headlight 90H, although it is understood that a remote-fire structure can be used for either sidelight 90R, 90L or taillight 90T. The sidelights 90R, 90L and taillight 90T shown in FIGS. 25-27 can comprise the same configuration as that of FIGS. 16A-20, or comprise any other sidelight or taillight configuration disclosed herein.

The headlight 90H includes an elongated front diffusing element 150H extending along the front of the base 16 and a plurality of LEDs 92H above and spaced from the front diffusing element 150H. The LEDs 92H are configured to emit visible light in a downward direction, and may be surface-mounted on a circuit board 168. The LEDs 92H can be single color, high-powered LEDs.

The front diffusing element 150H can comprise a light pipe, with the LEDs 92H spaced above and remote from a flat top surface 151T of the light pipe 150H. A portion of a bottom surface 151B of the light pipe 150H can be shaped to direct light horizontally through a forward surface 151F of the light pipe 150H. The bottom surface 151B of the light pipe 150H comprises an opaque white reflective coating forming a reflecting face 150C that reflects the light traveling downwardly to illuminate outward and project from the reflecting face 151C through the forward surface 151F. The outputted illumination appears very bright and uniform.

In FIG. 25 one orientation of the PCB 168 and light pipe 150H relative to the brushroll 24 and sole plate 152 of the base 16 is shown. The light pipe 150H is generally disposed below the brushroll 24 and above the sole plate 152. The sole plate 152 can provide at least partial support for the light pipe 150H.

Referring to FIG. 27, the PCB 168 is disposed above the light pipe 150H and out of a line-of-sight behind a covering portion 169 of the base housing. The light pipe 150H can be at least partially supported by the sole plate 152, a portion of which is shown in FIG. 27, or by another portion of the base housing. No lens or covering for the headlight 90H is required, as the light pipe 150H can serve as a lens itself. The forward surface 151F of the light pipe 150H therefore forms an exterior surface of the base 16 that is visible to the user.

Figure 29:
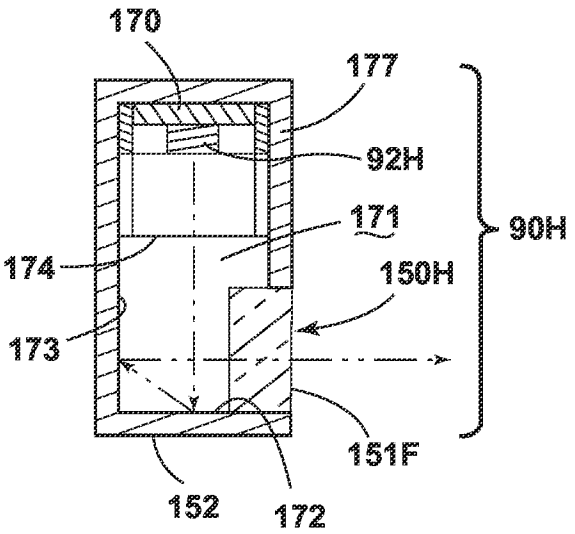
FIG. 29 is a cross-sectional view of the headlight from FIG. 28.
Figure 28:
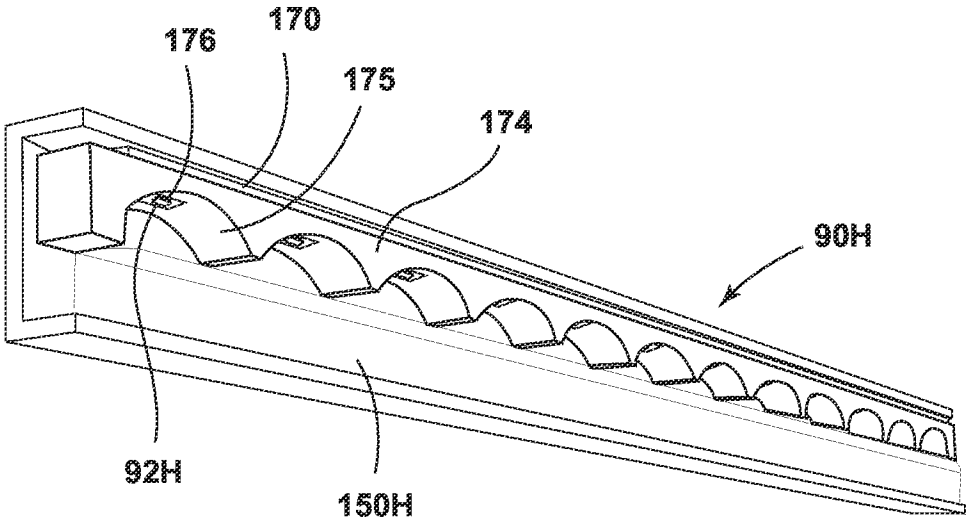
FIG. 28 is a perspective view of another embodiment of a headlight for the base.

FIGS. 28-29 show another embodiment of a remote-fire headlight 90H for the base 16. The headlight 90H includes an elongated front diffusing element 150H extending along the front of the base 16 and a plurality of surface-mounted LEDs 92H above and spaced from the front diffusing element 150H. The LEDs 92H are configured to emit visible light in a downward direction, and may be surface-mounted on a circuit board 170. The LEDs 92H can be single color, high-powered LEDs.

The LEDs 92H directly light downwardly within a light chamber 171 defined by one or more reflecting surfaces 172, 173, and are above and out of a direct line of illumination with the diffusing element 150H. At least one of the reflecting surfaces 172 is positioned in opposition to the LEDs 92H. Light is reflected within the light chamber 171 by bouncing off the reflecting surfaces 172, 173 before escaping horizontally through the diffusing element 150H. By increasing the distance light travels from the LEDs 92H to the diffuser 150H, a more uniform light output can be produced. The internal reflecting surfaces 172, 173 of the light chamber 171 can be white in color to increase reflection, such as by comprising an opaque white reflective coating.

A reflector 174 can be provided within the light chamber 171 to increase reflection and mixing of light before it escapes through the diffusing element 150H. In other embodiments, the reflector 174 is not provided.

One embodiment of the reflector 174 is shown in FIGS. 28-29, although it is understood that other configurations for the reflector are possible. The reflector 174 can comprise a plurality of arches 175, with one LED 92H facing downwardly in each arch 175. The arches 175 curve downwardly on either side of the LED 92H positioned therein, and the LED 92H is positioned at the highest point of the arch, e.g. at a crown 176 of the arch 175.

Referring to FIG. 29, the PCB 170 and reflector 174 is disposed above diffusing element 150H and out of a line-of-sight behind a covering portion 177 of the base housing. The diffusing element 150H can be at least partially supported by the sole plate 152, a portion of which is shown in FIG. 29, or by another portion of the base housing. That portion supporting the diffusing element 150H can comprise one or more of the reflecting surfaces 172, 173 forming the light chamber 171. No lens or covering for the headlight 90H is required, as the diffusing element 150H can serve as a lens itself. A forward surface 151F of the diffusing element 150H therefore forms an exterior surface of the base 16 that is visible to the user.

Figure 31:
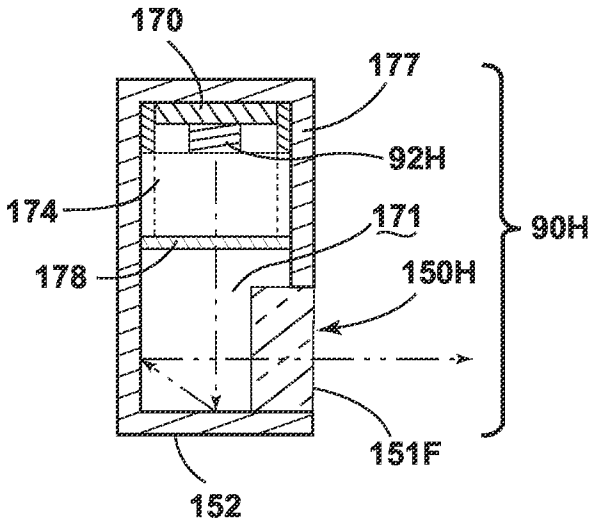
FIG. 31 is a cross-sectional view of the headlight from FIG. 30.
Figure 30:
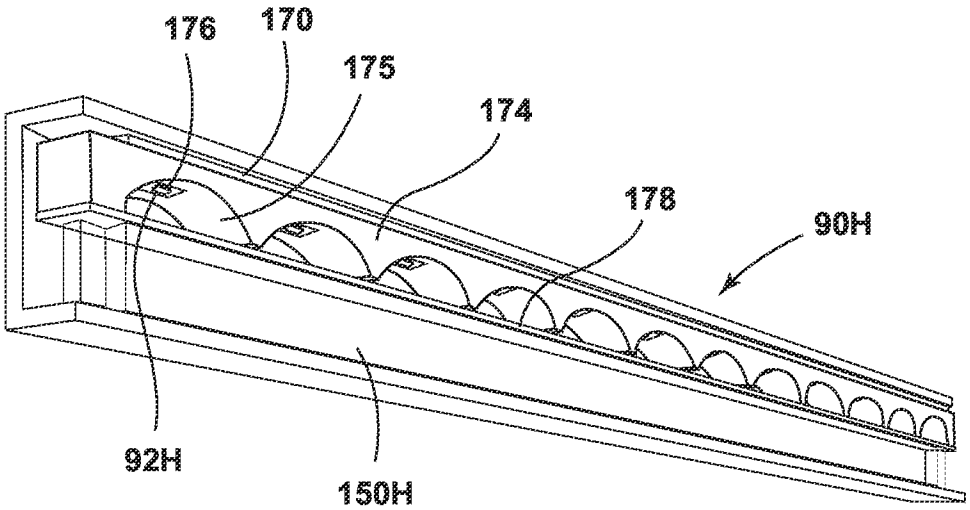
FIG. 30 is a close-up perspective view of another embodiment of a headlight for the base.

FIGS. 30-31 show an alternate embodiment of the remote-fire headlight 90H from FIGS. 28-29. The headlight 90H includes blue LEDs 92H and a phosphor film 178 in front of the LEDs 92H. The phosphor film 178 can comprise a clear silicone infused with phosphor. The phosphor film 178 is excited by the blue light emitted from the LEDs 92H and in turn releases white light. The phosphor film 178 lends an amount of diffusion as well in addition to the external diffusing element 150H.

The phosphor film 178 can be disposed at a distance from the LEDs 92H rather than encapsulating the LEDs 92H like the COB embodiment shown in FIG. 23-24. For example, the phosphor film 178 can be applied to a lower end of the reflector 174, and is out of a line-of-sight behind the covering portion 177 of the base housing.

Figure 32:
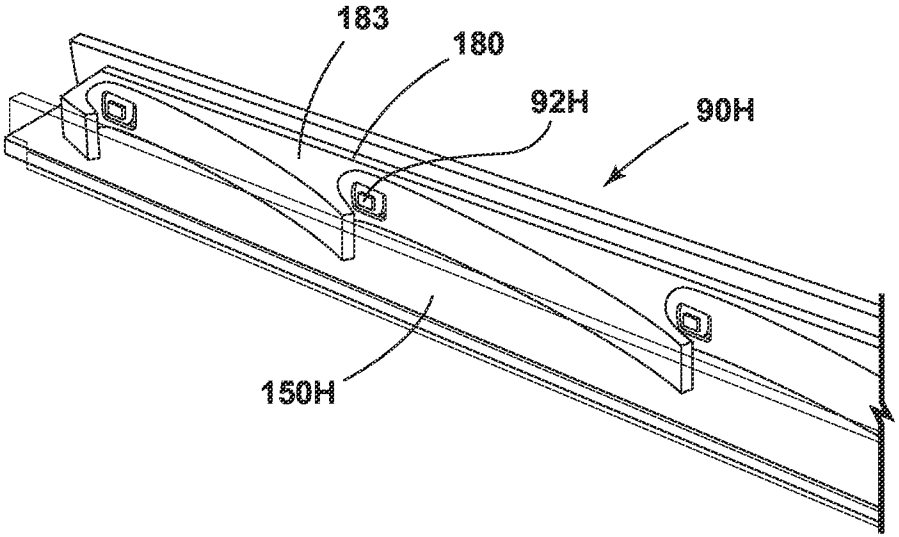
FIG. 32 is a close-up perspective view of another embodiment of a headlight for the base.
Figure 33:
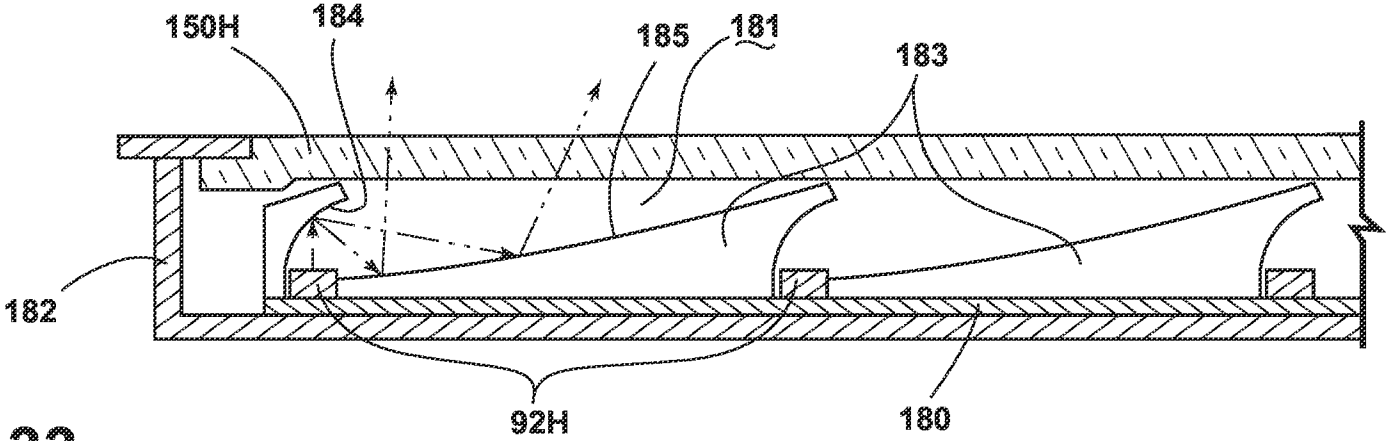
FIG. 33 is a top view of one end of the headlight from FIG. 32.

FIGS. 32-33 show another embodiment of a headlight 90H for the base 16. The headlight 90H includes an elongated front diffusing element 150H extending along the front of the base 16 and a plurality of surface-mounted LEDs 92H behind the diffusing element 150H. The LEDs 92H may be surface-mounted on a circuit board 180, and can be single color, high-powered LEDs.

The LEDs 92H direct light outward or horizontal direction within a light chamber 181 defined by a housing 182 and the diffusing element 150H. The housing 182 may itself be attached to or formed in part by the sole plate 152 (see FIGS. 16-17), and/or may be attached to or formed in part by another portion of the base housing.

A reflector 183 is provided within the light chamber 181, behind the headlight diffusing element 150H, to increase reflection and mixing of light before it escapes through the diffusing element 150H. One embodiment of the reflector 183 is shown in FIGS. 32-33, although it is understood that other configurations for the reflector are possible. The reflector 183 can comprise a louvered reflector with a plurality of reflector surfaces 184, 185, at least one of which is positioned in opposition to each LEDs 92H. Light is reflected within the light chamber 181 by bouncing off the reflecting surfaces 184, 186 before escaping through the diffusing element 150H. The reflecting surfaces 184, 185 can be white in color to increase reflection, such as by comprising an opaque white reflective coating.

In the embodiment shown in FIG. 33, light from each LED 92H is bounced perpendicularly from a first reflector surface 184 in front of the LED 92H to a secondary reflector surface 185 positioned to project outward through the diffusing element 150H. This design approach helps to block the light coming directly out from the LEDs 92H in order to minimize the appearance of visible bright spots when looking at the headlight 90H, and provide a more even light distribution along the full length of the diffusing element 150H.

Figure 34:
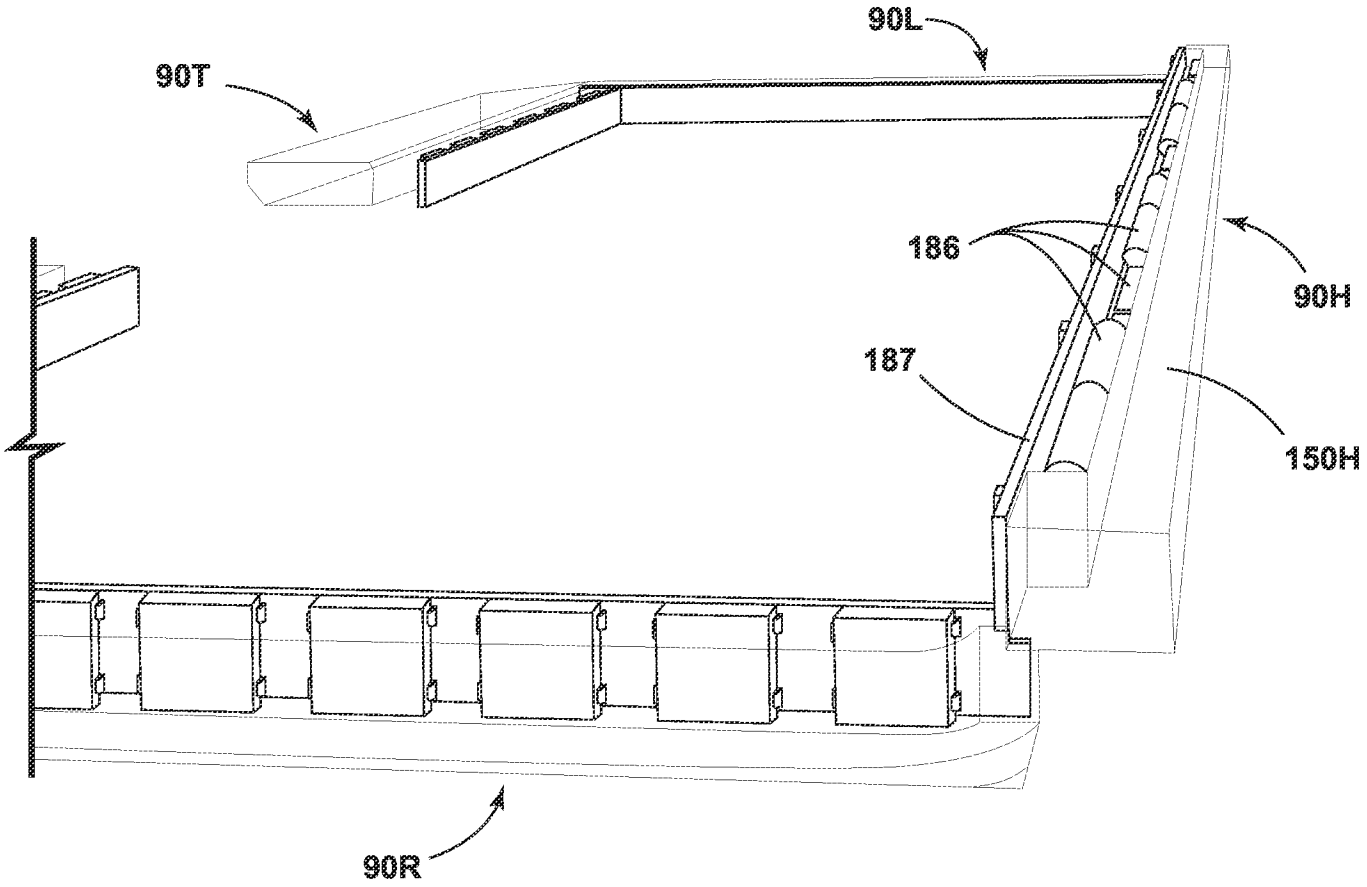
FIG. 34 is a perspective view of a portion of an illumination system, including another embodiment of a headlight.

FIG. 34 shows another embodiment of headlight 90H for the illumination system 88. The headlight 90H includes a plurality of COB strips 186 mounted behind the headlight diffusing element 150H. The COB strips 186 may be coupled to a support surface comprising a PCB 187, and can emit visible light of a single color. Each COB strip 186 can have multiple LED chips bonded directly to a substrate to form a module. In some embodiments, each strip 186 can comprise multiple series-connected LED chips on a transparent substrate, referred to as chip-on-glass (COG). With the single color COB strip 186, the headlight 90H may produce simple light animations and/or a gradient light effect.

Figure 37:
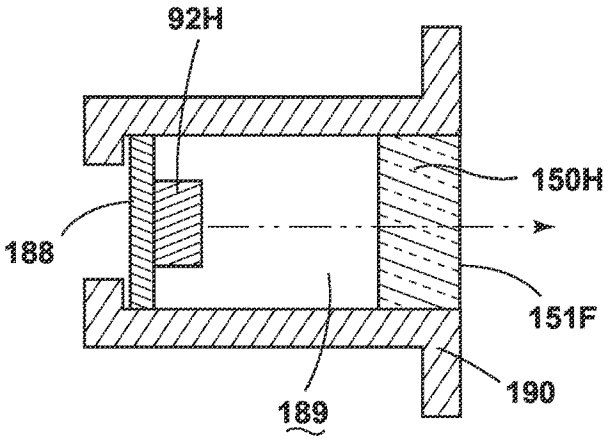
FIG. 37 is a cross-sectional view of the headlight from FIG. 35.
Figure 35:
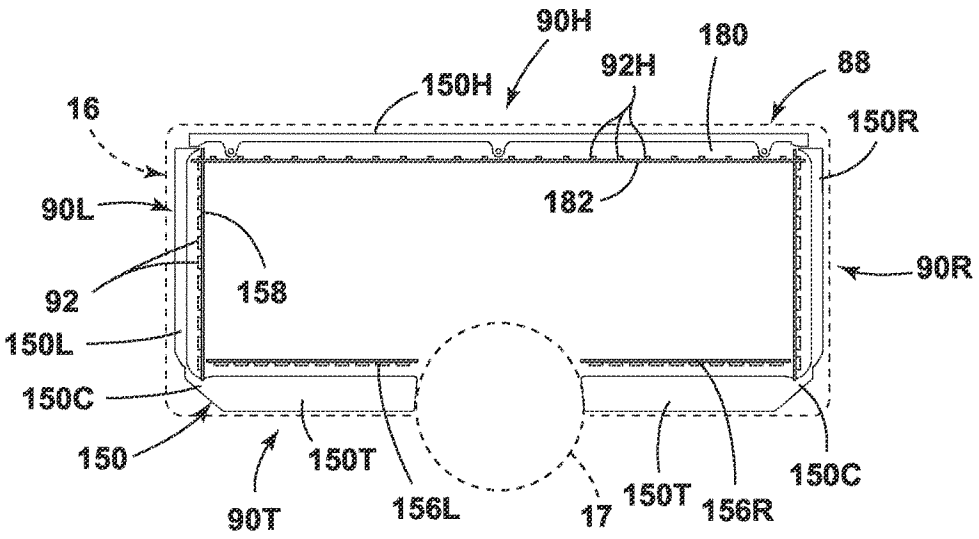
FIG. 35 is a top view of another embodiment of a light diffusing structure for the illumination system of FIG. 10, with the base indicated in phantom line.
Figure 36:
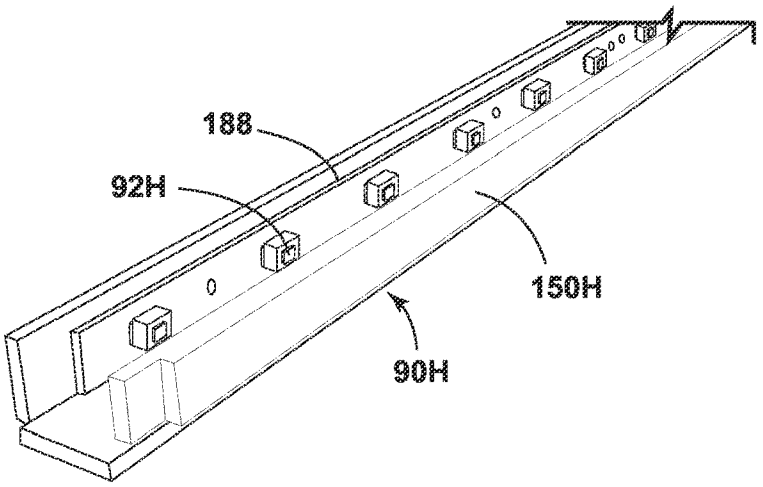
FIG. 36 is a front perspective view of the headlight of FIG. 35.

FIGS. 35-37 show an embodiment of a forward-firing or direct fire headlight 90H for the base 16. The headlight 90H includes an elongated front diffusing element 150H extending along the front of the base 16 and a plurality of LEDs 92H directly behind the diffusing element 150H. The LEDs 92H are configured to emit visible light in an outward or horizontal direction, and may be surface-mounted on a circuit board 188. The LEDs 92H can be single color, high-powered LEDs. The LEDs 92H direct light within a light chamber 189 defined by a housing 190 and the diffusing element 150H. The housing 190 may itself be attached to or formed in part by the sole plate 152 (see FIGS. 16-17), and/or may be attached to or formed in part by another portion of the base housing. No lens or covering for the headlight 90H is required, as the diffusing element 150H can serve as a lens itself. A forward surface 151F of the diffusing element 150H therefore forms an exterior surface of the base 16 that is visible to the user.

Other variations of the direct fire configuration include the use of an RGB LED strip, RGBW LED strip, a COB strip, or combinations thereof instead of discrete white LEDs 92H. With any of these light strips, the headlight 90H is able to produce complex light animations and/or light effects by itself or in coordination with the other light strips 156.

In yet another embodiment, instead of the diffusing element 150H, the headlight can comprise a clear lens in front the LEDs 92H and circuit board 188, with a holographic film laminated to the front surface of the clear lens to refocus the outputted light into a narrow horizontal strip of light.

Figure 38:
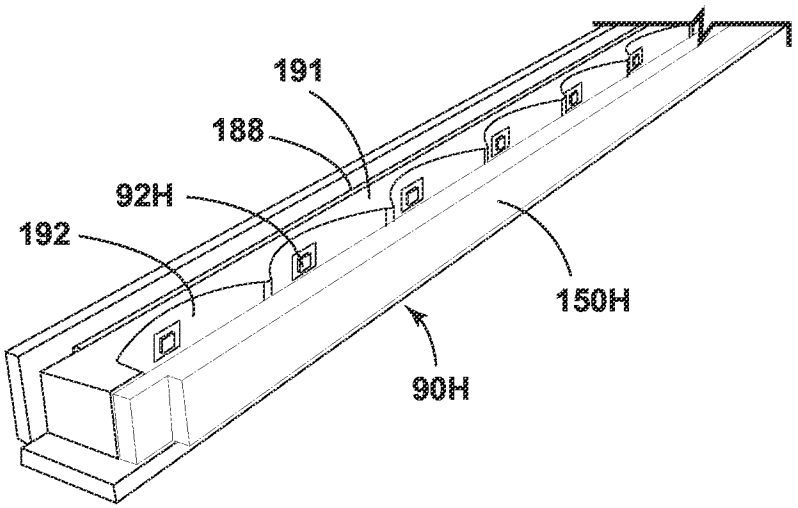
FIG. 38 is a perspective view of another embodiment of a headlight for the base.
Figure 39:
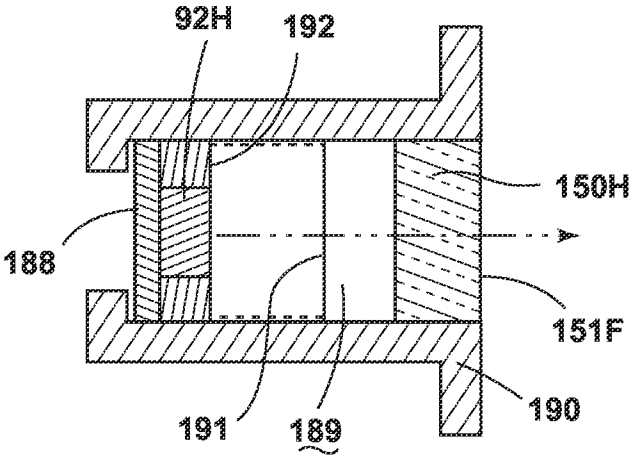
FIG. 39 is a cross-sectional view of the headlight from FIG. 38.

FIGS. 38-39 show another embodiment of a direct fire headlight 90H for the base 16. In this embodiment, a reflector 191 is disposed in the light chamber 189 to increase reflection and mixing of light before it escapes through the diffusing element 150H. The surfaces of the reflector 191 pick up light reflected back from the diffuser 150H. One embodiment of the reflector 191 is shown, although it is understood that other configurations for the reflector are possible. The reflector 191 can comprise a plurality of arches 192, with one LED 92H facing outwardly in each arch 192. The arches 175 curve outwardly on either side of the LED 92H positioned therein.

Still other embodiments of a light diffusing structure for the illumination system 88 are possible. For example, the illumination system 88 can include a headlight 90H, sidelight 90R, 90L, and/or taillight 90T comprising a single color LED and a holographic film. In another example, the illumination system 88 can include a headlight 90H, sidelight 90R, 90L, and/or taillight 90T comprising at least one RGB color LED strip in combination with at least one LED filament. In still another example, any embodiment of the headlight disclosed herein can be used for the right sidelight 90R, the left sidelight 90L, and/or the taillight 90T.

Figure 40:
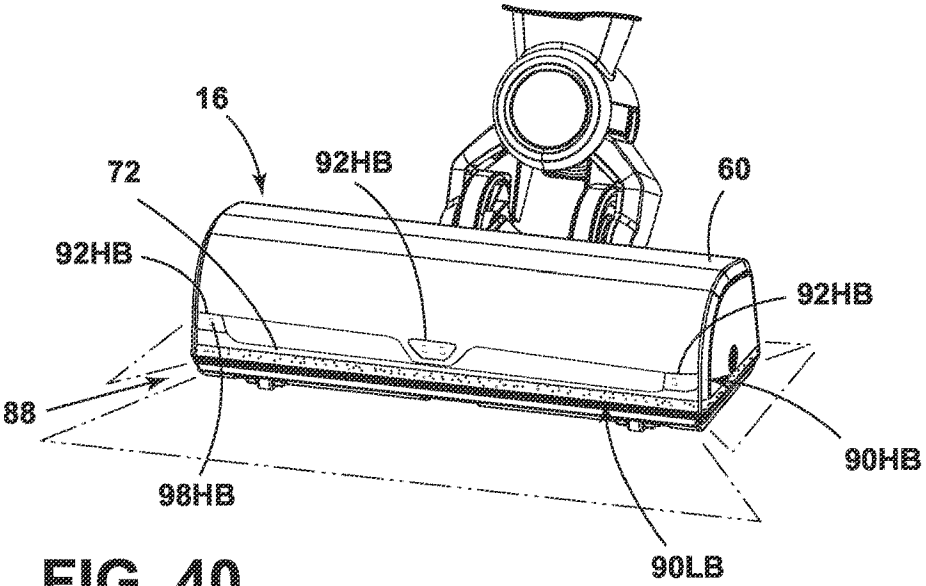
FIG. 40 is a front perspective view of a base of a surface cleaning apparatus having an illumination system according to another embodiment of the invention, showing the illumination system emitting light from a low beam headlight.
Figure 41:
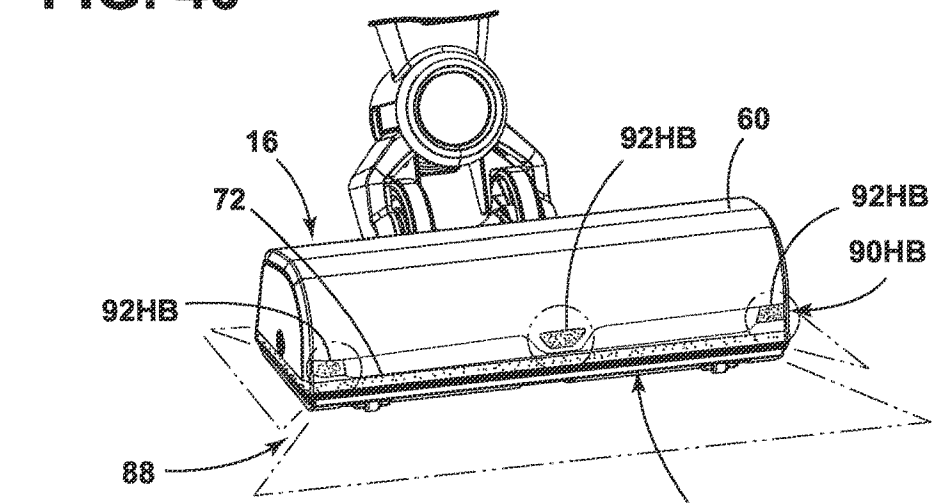
FIG. 41 is a front perspective view of the base from FIG. 40, showing the illumination system emitting light from the low beam headlight and a high beam headlight.

FIGS. 40-41 show another embodiment of the illumination system 88 for the apparatus 10. In the illustrated embodiment, the base 16 includes a high beam headlight 90HB disposed above a low beam headlight 90LB on the base 16. As the low beam headlight 90LB is disposed below the high beam headlight 90HB in this embodiment, the headlight 90H is also referred to herein as a lower headlight. The high beam headlight 90HB may be referred to herein as an upper headlight. The low beam and high beam headlights together can function as a headlight assembly with multi-level headlights for illuminating a surface to be cleaned.

Figure 43B:
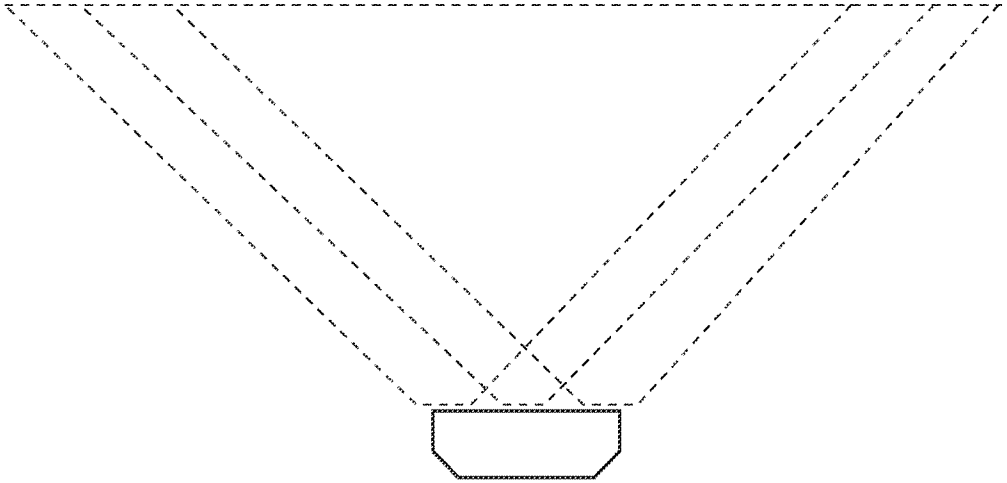
FIGS. 43A-43C are schematic tops views of the base from FIG. 40 showing a representation of an illumination zone for a low beam function, a high beam function, and a combined low and high beam function, respectively.
Figure 43C:
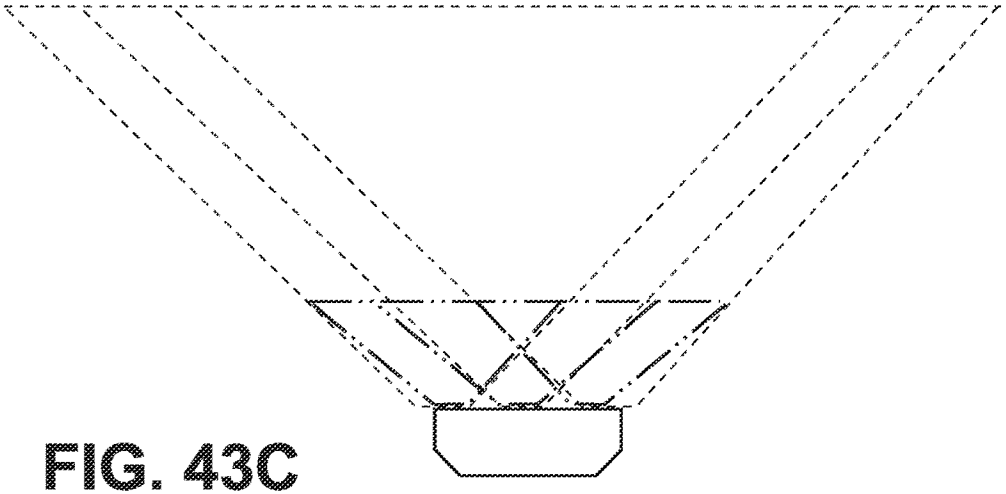
Figure 43A:
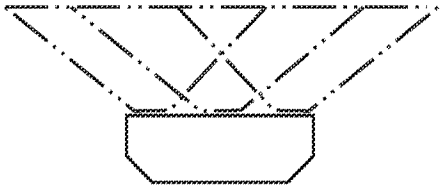

The each headlight 90HB, 90LB can define, at least in part, a lighting zone or emission zone configured to emit plurality of light beams outwardly from the front side of the housing 60 and produce an illuminated zone on the surface to be cleaned. One example of an illuminated zone for the low beam headlight 90LB is shown in FIG. 43A. One example of an illuminated zone for the high beam headlight 90HB is shown in FIG. 43B. One example of a combined illuminated zone for the high beam headlight 90HB and the low beam headlight 90LB is shown in FIG. 43C, where the high beam illuminated zone is at least partially overlapped by the low beam illuminated zone.

The high beam headlight 90HB can include at least one light source, and preferably includes a plurality of light sources 92HB. The light sources 92HB can be spaced across along the front side 80 of the base housing 60. The high beam headlight 90HB can include at least one cover 98HB for protecting the light sources 92H. The cover 98HB can include a transparent, semi-transparent, or translucent portion to permit emitted light to shine through to the surface to be cleaned. In one embodiment, as shown, the cover 98HB can be formed by a portion of the nozzle cover 72 itself, such as by a lower front edge of the nozzle cover 72 extending to cover the light sources 92HB. In other embodiments, the light sources 92HB can be positioned behind a headlight cover disposed below and separate from the nozzle cover 72. In yet other embodiments, the light sources 92HB can be uncovered.

Various numbers of light sources 92HB are possible. As shown in FIG. 31, three light sources may be provided, including one light source positioned generally at the center of the base 16 and two light sources disposed laterally of center, generally at either end of the base 16. In other embodiments, the high beam headlight 90HB may include less than three or more than three light sources.

The high beam headlight 90HB is generally disposed on the forward oriented portion of the housing 60, e.g. the front side 80, and is configured to emit visible light from the housing 60 towards a region on the surface to be cleaned in front of the forward oriented portion of the housing 60. From the high beam headlight 90HB, visible light can be cast onto the surface in front of the front side 80 of the housing 60, producing the high beam illuminated zone schematically shown in FIG. 43B.

The low beam and high beam lights 90H, 90HB can be illuminated together, e.g. at the same time, or can be illuminated individually. For example, the controller 46 can be configured to illuminate the lower headlight 90H alone as shown in FIG. 40, both headlights together as shown in FIG. 41, or the high beam headlight 90HB alone (not shown). Such illumination can be controlled based on user input or based on sensor data, as described in further detail below.

The low beam and high beam lights 90LB, 90HB can be can be positioned relatively low on the base 16, which can improve illumination of debris on the surface to be cleaned by elongating the shadow cast by debris, making debris appear larger and more apparent to the user. The height from floor surface may be, for example 10 mm to 40 mm inclusive. In one embodiment, the low beam headlight 90LB is positioned at a first height from the floor surface and the high beam lights 90HB are positioned at a second height from the floor surface that is greater than the first height. The first height for the low beam headlight 90LB can be, for example 10 mm to 40 mm, and the second height for the high beam headlight 90HB can be, for example 20 mm to 50 mm. On carpeted surfaces, it was found that having the high beam headlight 90HB closer to the floor surface, e.g. closer to a height of around 15 mm to 20 mm from the floor surface, may be preferred, as this height produces longer shadows that made debris on top of the carpeted surface more visible.

In some embodiments the temperature of visible light emitted from the low beam headlight 90LB and the high beam lights 90HB may be different in order to improve visibility of debris on different surfaces. The low beam headlight 90LB, and optionally also the sidelights 90R, 90L and/or taillight 90T, can emit visible light in a temperature range of approximately 4000 k-5000 k for a warm white light appearance. Light in this temperature range may enhance the visibility of debris on hard flooring surfaces, particularly debris that is close (i.e. within 12 inches) to the base 16. The high beam lights 90HB can emit visible light in a temperature range of approximately 6000 k-7000 k for a cool white light appearance. Light in this temperature range may enhance the visibility of debris on carpeted surfaces compared with light at lower temperatures, e.g. warmer light.

In some embodiments, the apparatus 10 can default to turning on the low beam headlight 90LB when the apparatus 10 is powered on. The high beam lights 90HB can be turn on at a user's discretion, such as when the carpet cleaning mode is selected through the user interface 48, and/or when sensor 102 detects carpet under the base 16.

Figure 42:
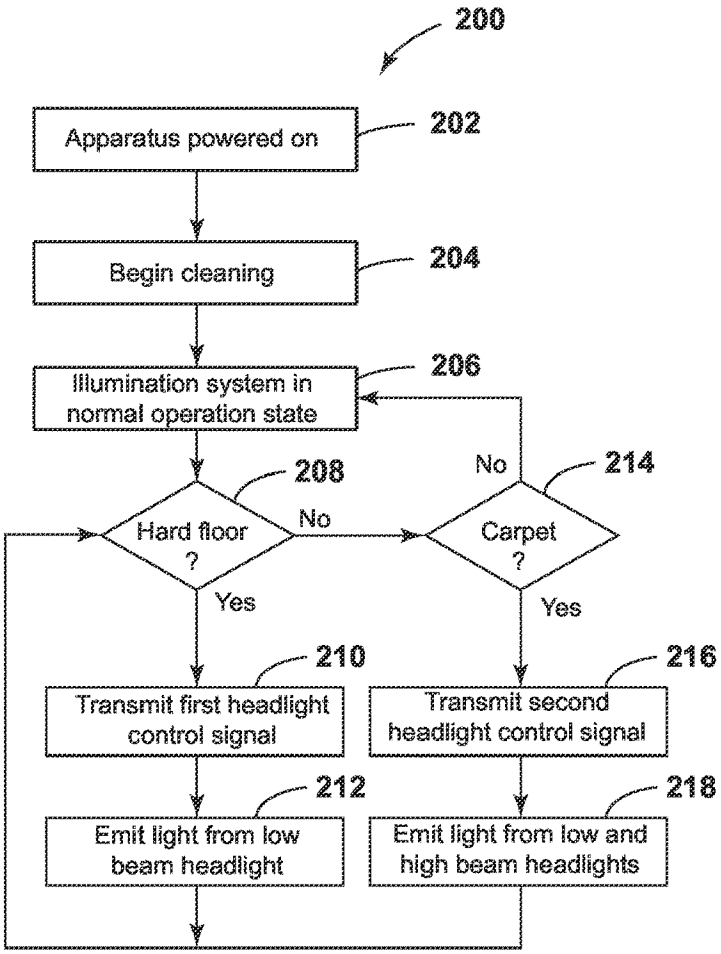
FIG. 42 is a flow chart depicting one embodiment of a method for operating the illumination system depending on the floor surface under the base.

Referring to FIG. 42, according to yet another embodiment of the disclosure, a method 200 for illuminating a floor surface with a surface cleaning apparatus comprises transmitting a first headlight control signal to the illumination system 88 if the floor surface is hard flooring, transmitting a second headlight control signal to the illumination system 88 if the floor surface is carpet. The first headlight control signal can power the low beam headlight 90LB, as shown in FIG. 40. The second headlight control signal can power both the low beam headlight 90H and the high beam lights, as shown in FIG. 41.

The method may begin with powering the apparatus on at step 202, and beginning a cleaning operation at step 204. For a normal cleaning operation, the illumination system 88 can be in a normal operation state at step 206. Various normal operation states are possible, including a state where at least one light of the illumination system 88 is activated to emit visible light. In some embodiments, the apparatus 10 can default to turning on the low beam headlight 90LB, and not the high beam headlight 90HB for normal operation state at step 206. The illumination system 88 may also turn on the sidelights 90R, 90L and the taillight 90T when the apparatus 10 is operating normally at step 206.

If the apparatus 10 is cleaning hard floor at step 208, then the controller 46 transmits a first headlight control signal to the illumination system 88 at step 210. The first headlight control signal can power the low beam headlight and not the high beam headlight at step 212, as shown in FIG. 40. The first headlight control signal can also optionally deactivate the high beam headlight if off.

If the apparatus 10 is cleaning carpet (which includes area rugs) at step 214, then the controller 46 transmits a second headlight control signal to the illumination system 88 at step 216. The second headlight control signal can power the low beam headlight and the high beam headlight at step 218, as shown in FIG. 41.

In some embodiments, the headlight control signal for step 210 or step 214 can be generated based on user input. For example, step 208 can comprise a user selecting a hard floor cleaning mode through the user interface 48 and step 214 can comprise a user selecting a carpet or area rug cleaning mode through the user interface 48, and a corresponding headlight control signal can be generated for step 210 or 216 based on this user input. Optionally, the high beam lights 90HB can be turned off when switching from the carpet cleaning mode to the hard floor cleaning mode.

In some embodiments, the apparatus 10 can be configured to automatically sense a floor type of the surface to be cleaned at step 208 or 214 by generating sensor data during a cycle of operation of the surface cleaning apparatus with a sensor on-board the surface cleaning apparatus, processing the sensor data to determining whether the type is carpet or hard flooring, and generating a headlight control signal at step 210 or 216 based on the sensor data. In such an embodiment, the sensor 102 (FIG. 7) can be a floor type sensor. Optionally, the high beam lights 90HB can be turned off when hard flooring is detected at step 208 and turned on when carpet (or an area rug) is detected at step 214.

Figure 44A:
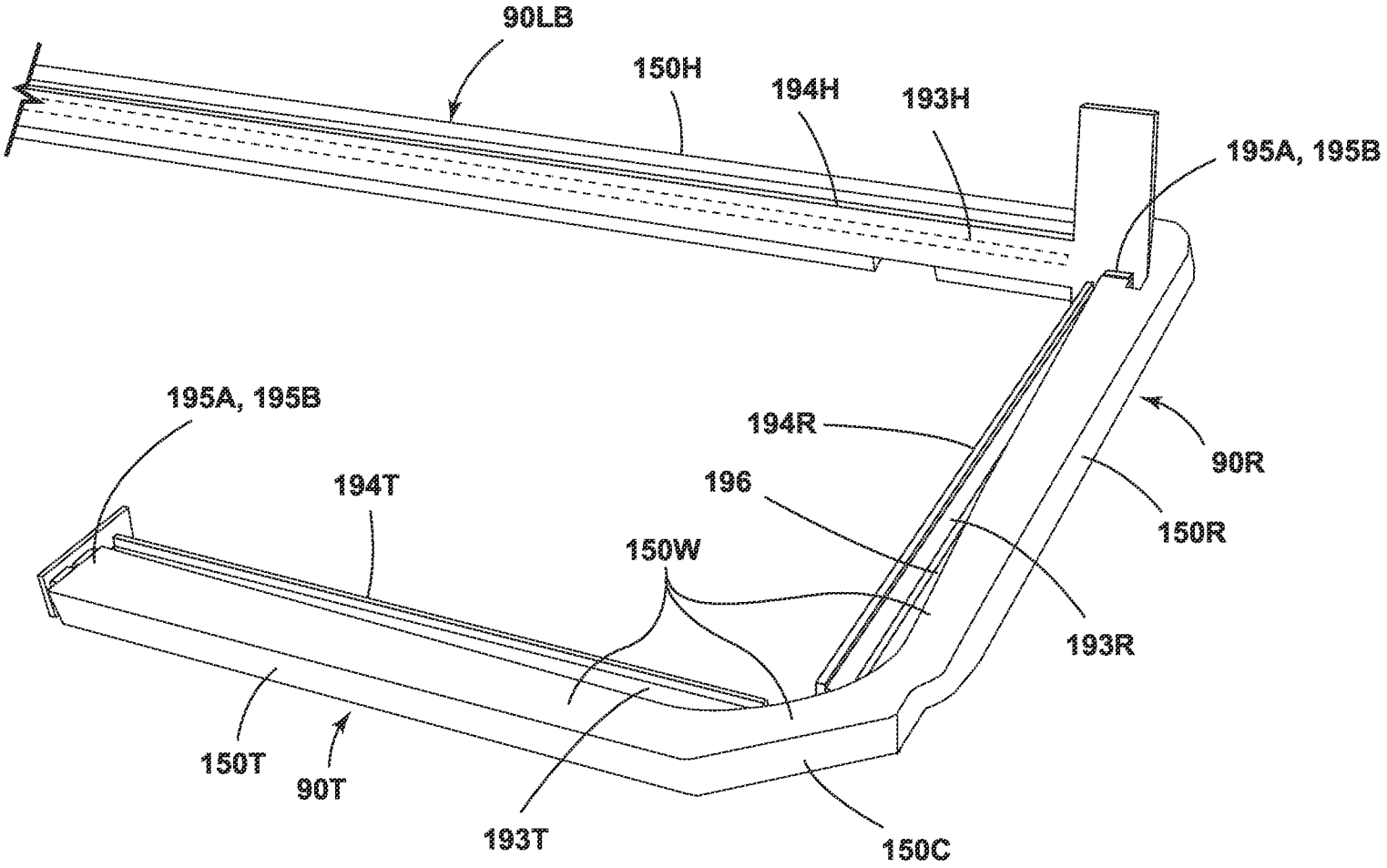
FIG. 44A is a perspective view of a portion of the illumination system of FIG. 40, including details of a low beam headlight, sidelight, and taillight.

FIG. 44A shows one embodiment of a light diffusing structure for the illumination system of FIGS. 40-41. The low beam headlight 90LB, sidelight 90R, and taillight 90T can comprise addressable segmented white COB strips 193H, 193R, 193T. The segments of the COB strips are individually addressable by the controller 46 to allow for more complex light animations, intensity changes, or color changes. The COB strips 193H, 193R, 193T can have multiple LED chips (not shown) bonded directly to a substrate or PCB 194H, 194R, 194T. The headlight 90H, sidelight 90R, and taillight 90T each comprise a diffuser 150H, 150R, 150T respectively disposed in front of the corresponding COB strip 193H, 193R, 193T and PCB 194H, 194R, 194T. Alternatively, the low beam headlight 90LB can comprise any headlight configuration disclosed herein.

The COB strips 193H, 193R, 193T illuminate the diffusers 150H, 150R, 150T from behind. In addition to providing diffusion, one or more of the diffusers 150H, 150R, 150T can function as light pipes for another light source, as will be described in further detail below. Such diffusers are referred to herein in some instances as dual function diffusers.

In the illustrated embodiment, the side and rear diffusers 150R, 150T are dual function diffusers and comprise one-piece molded body that wraps around a rear corner of the base at corner portion 150C, thereby defining a single light pipe 150W. The light pipe 150W allows light from the COB strips to pass through and serves as a reflective element for a light pipe function.

In addition to the white COB strips, the sidelight 90R and taillight 90T can comprise at least additional light source configured to emit colored (e.g. non-white) light. In the embodiment shown in FIG. 42, the sidelight 90R and taillight 90T each comprises two colored LEDs 195A, 195R disposed at each end face of the light pipe 150W to propagate light along the length of the light pipe 150W to provide a substantially uniform illumination, including around the corner portion 150C. The LEDs 195A, 195R are preferably different colors, such as amber and red, in order to covey different visual information to the user. Other numbers and colors for the end-mounted LEDs are possible.

To convey a first warning, error, or other indication to the user, the two first colored LEDs 195A can be illuminated at the same time, thereby propagating light of the first color along the length of the light pipe 150W (e.g. along the right side and rear side of the base 16). To convey a second warning, error, or other indication to the user, the two second colored LEDs 195R can be illuminated at the same time, thereby propagating light of the second color along the length of the light pipe 150W (e.g. along the right side and rear side of the base 16). Examples of possible warnings, errors, or other indications are provided above.

The wrap-around light pipe 150W can comprise a clear element, without a light-scattering filler, with a coating 196 on an inside surface thereof that faces the COB strips 193R, 193T that is both reflective and translucent at the same time. This structure allows the COB strips 193R, 193T to be placed inward of the light pipe 150W and still shine outward through the translucent coating 196. Because the coating 196 is also internally reflective, the light from the end-mounted colored LEDs 195A, 195R can pass internally through the light pipe 150W to reflect off the inside surface and outward. A non-limiting examples of the coating 196 is a paint comprising powdered pure mica in a clear carrier.

While not shown in FIG. 44A, the structure of the left sidelight 90L and left-side taillight 90T can be the same as or similar to the structure of the right sidelight 90R and right-side taillight 90T.

Figure 44B:
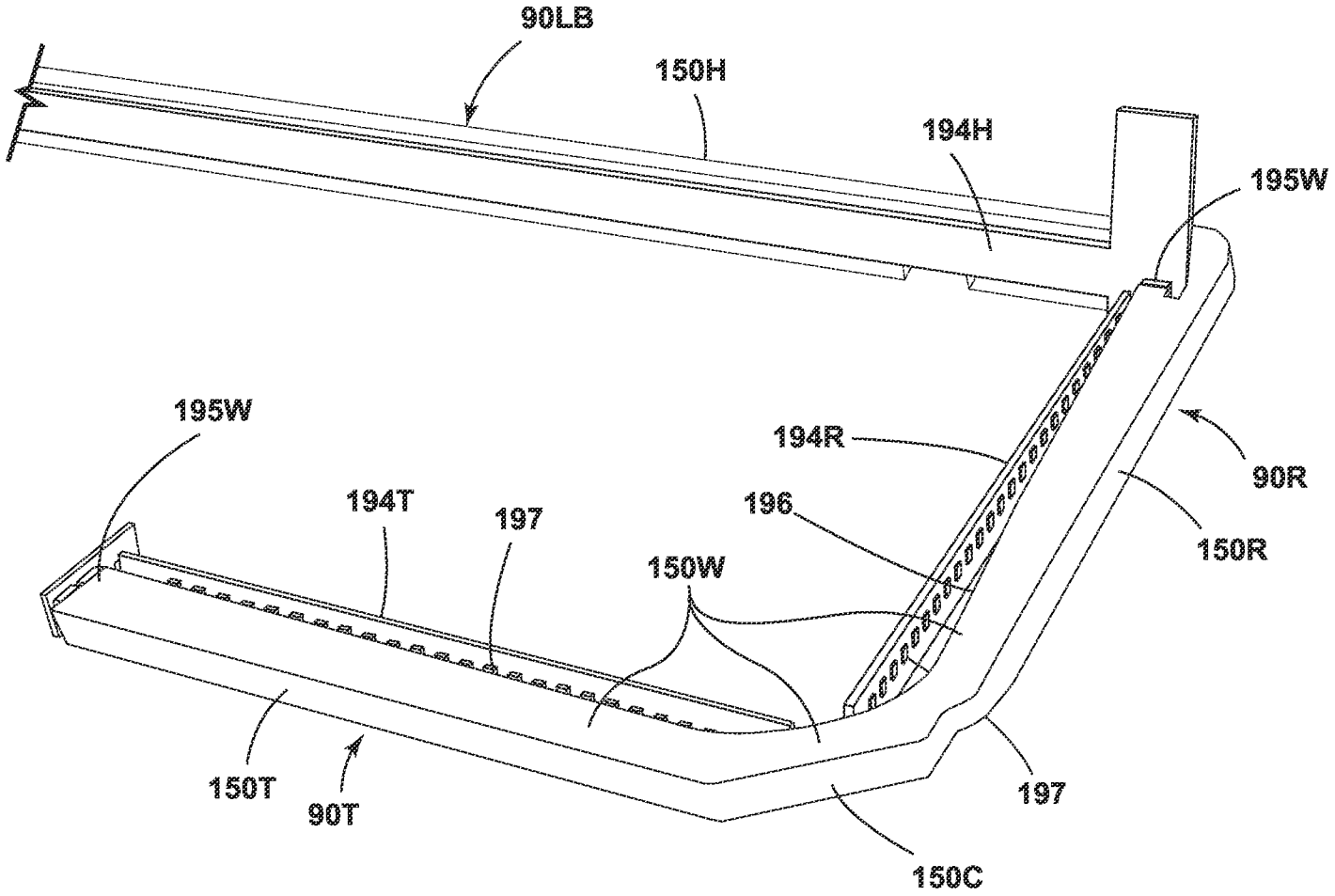
FIG. 44B is a perspective view of another embodiment of a portion of the illumination system of FIG. 40, including details of a low beam headlight, sidelight, and taillight.
Figure 46:
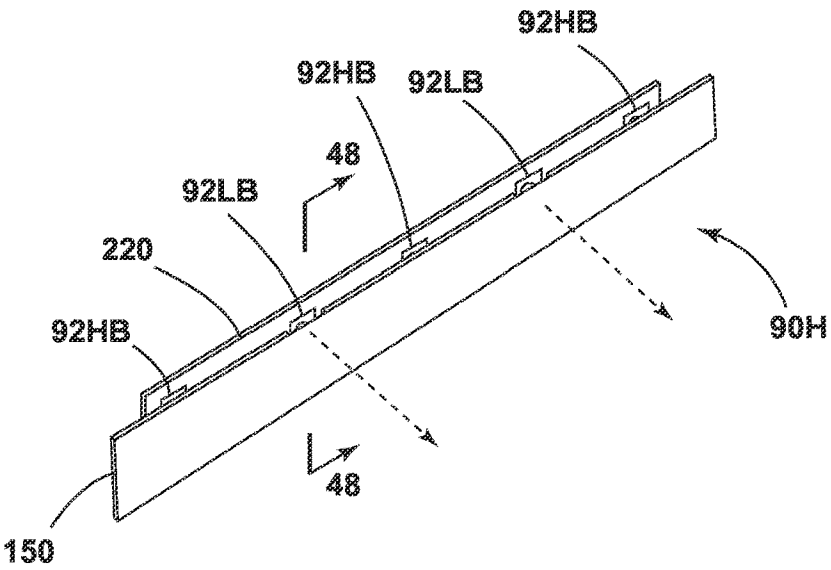
FIG. 46 is a front perspective view of the headlight from FIG. 45, showing the headlight emitting light from low beam light sources.
Figure 45:
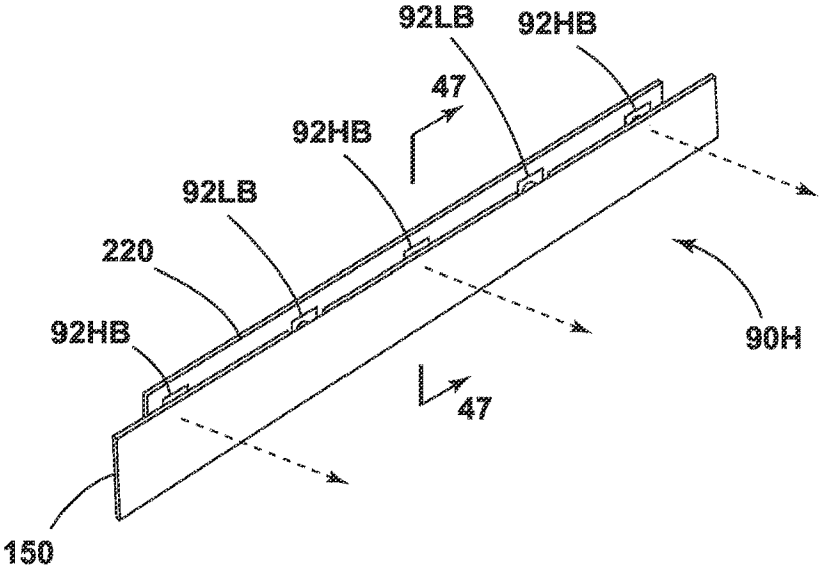
FIG. 45 is a front perspective view of a combination high beam and low beam headlight for the illumination system according to another embodiment of the invention, showing the headlight emitting light from high beam light sources.

FIG. 44B shows another embodiment of a light diffusing structure for the illumination system of FIGS. 40-41. In this embodiment, the sidelight 90R and taillight 90T can comprise colored LEDs 197 and the end-mounted LEDs can comprise white LEDs 195W. The low beam headlight 90LB can comprise white LEDs (not shown) mounted on PCB 194H in a direct fire configuration, substantially as described for the embodiment of FIGS. 35-37. Of course, it is understood that the low beam headlight 90LB can comprise any headlight configuration disclosed herein.

The colored LEDs 197 are individually addressable by the controller 46 to allow for animation. In one configuration, amber and red LEDs are placed alternately along the side and rear PCBs 194R, 194T, and emit light through the translucent coating 196, which also has a diffusion effect. Other color combinations and orders are possible.

In one configuration, the colored LEDs 197 are provided as an RGB LED strip or a RGBW LED strip instead of discrete LEDs. With any of these light strips, the lights are able to produce complex light animations and/or light effects by itself or in coordination with the other lights. If the red, green, and blue components of an RGB LED strip are energized together, white light can be produced, and emitted from the sidelight 90R and taillight 90T at the same time white light is emitted from the low and/or high beam headlights 90LB, 90HB (see FIG. 40-41). Alternatively, RGBW light strips can allow more accurate color temperature adjustment to match the temperature of the single color headlight LEDs.

FIGS. 45-48 show yet another embodiment of a headlight 90H for the illumination system 88 of FIGS. 10-13. The headlight 90H comprises a combination high beam and low beam headlight 90H. In the illustrated embodiment, the headlight 90H can include a plurality of light sources coupled to a circuit board 220 and a diffuser 150 in front of the plurality of light sources to diffuse the light emitted by the light sources. One or more of the light sources can comprise high beam LEDs 92HB and one or more of the light sources can comprise low beam LEDs 92LB. The diffuser 150 includes at least one flat lens 222 disposed in front of the high beam LED 92HB, the flat lens 222 allowing visible light to pass straight through the lens 222 to produce a longer or farther illumination region. The diffuser 150 includes at least one angled lens 224 disposed in front of the low beam LED 92LB, the angled lens 224 configured to direct visible light downward to produce a shorter or closer illumination region. The angled lens 224 can, for example be angled approximately 5-8 degrees from the flat lens 222.

The high beam and low beam LEDs 92HB, 92LB can be similar or different in intensity, color, wavelength, and/or temperature. In one embodiment, the low beam LEDs 92LB can emit visible light in a temperature range of approximately 4000 k-5000 k for a warm white light appearance, and the high beam LEDs 92HB can emit visible light in a temperature range of approximately 6000 k-7000 k for a cool white light appearance. The LEDs 92HB, 92LB can be controlled individually, including where only the high beam LEDs 92HB are turned on for specific modes and/or where only the low beam LEDs 92LB are turned on for specific modes.

In the illustrated embodiment, the high beam and low beam LEDs 92HB, 92LB are disposed in an alternating array extending lengthwise behind the diffuser 150. The flat and angled lens 222, 224 also alternate. Various other arrangements are contemplated, including where pairs of high beam and low beam LEDs 92HB, 92LB alternate. Various other numbers of high beam and low beam LEDs 92HB, 92LB are possible.

Figure 47:
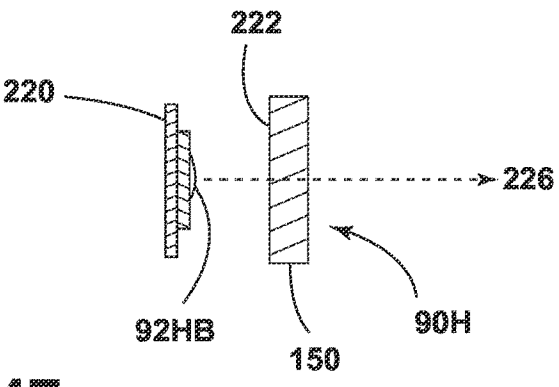
FIG. 47 is a sectional view through one of the high beam light sources of the headlight taken though line 47-47 of FIG. 45.

FIG. 47 is a sectional view of the headlight 90H taken through one of the high beam LEDs 92HB. The LED 92HB is configured to emit at least one light beam 226, e.g. a directional projection of light energy radiating from the LED 92HB, and the light beam 226 passes straight through the flat lens 222.

Figure 48:
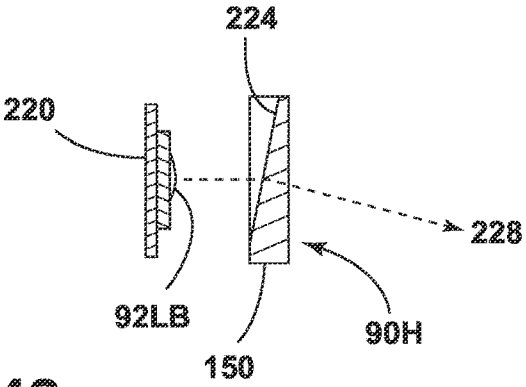
FIG. 48 is a sectional view through one of the low beam light sources of the headlight taken though line 48-48 of FIG. 46.

FIG. 48 is a sectional view of the headlight 90H taken through one of the low beam LEDs 92LB. The LED 92LB is configured to emit at least one light beam 228, e.g. a directional projection of light energy radiating from the LED 92LB. The light beam 228 enters the angled lens 224 and is refracted.

Figure 49:
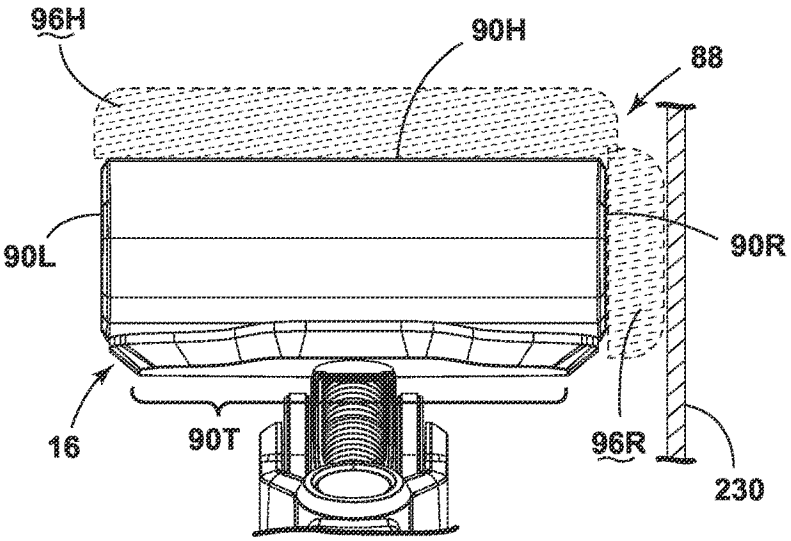
FIG. 49 is a top view of a base with an illumination system providing adaptive illumination for edge cleaning, where an obstacle is located on a right side of the base.
Figure 50:
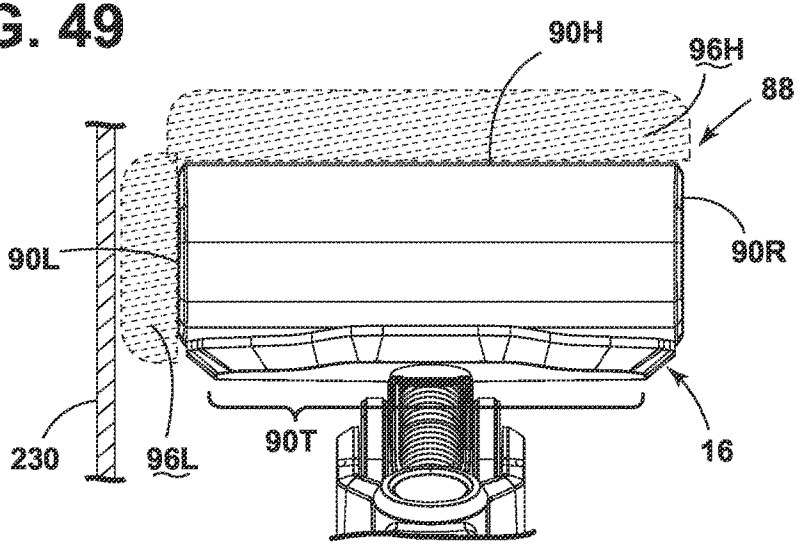
FIG. 50 is a top view of a base with an illumination system providing adaptive illumination for edge cleaning, where an obstacle is located on a left side of the base.

FIGS. 49-50 show one embodiment of the illumination system 88 providing adaptive illumination for edge cleaning. In FIGS. 49-50, the illumination system 88 is embodied as the illumination system 88 from FIGS. 10-13, although it is understood that the adaptive illumination for edge cleaning may be applied to any embodiment of the illumination system 88, base 16, or apparatus 10 described herein.

For edge cleaning where an obstacle 230, such as a wall, baseboard, cabinet, furniture, or other obstacle, is on a side or edge of the base 16, the illumination system 88 can provide greater illumination along that side of the base 16, offering improved feedback for where a user is cleaning. For right edge cleaning where an obstacle 230 is on the right side of the base 16, visible light can be emitted from the right sidelight 90R and not the left sidelight 90L, an example of which is shown in FIG. 49. For left edge cleaning where an obstacle 230 is on the left side of the base 16, visible light can be emitted from the left sidelight 90L and not the right sidelight 90R, an example of which is shown in FIG. 50. For either right or left edge cleaning, in some embodiments the headlight 90H can be on and the taillight 90T can be off in order to further focus the illumination, and the user's attention, along the floor area where the user is cleaning.

Figure 51:
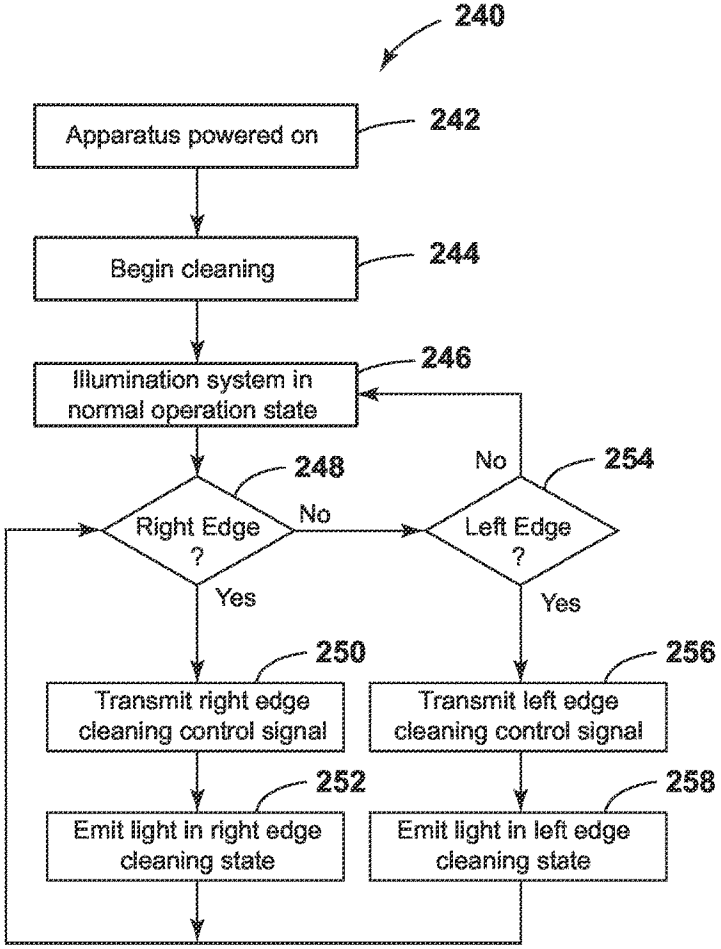
FIG. 51 is a flow chart depicting one embodiment of a method for adaptive illumination for edge cleaning.

FIG. 51 shows one embodiment of a method 240 for adaptive illumination for edge cleaning, including transmitting a right edge cleaning control signal to the illumination system 88 if an obstacle is detected on the right side of the base 16, and transmitting a left edge cleaning control signal to the illumination system 88 if an obstacle is detected on the left side of the base 16.

The method 240 may begin with powering the apparatus on at step 242, and beginning a cleaning operation at step 244. For a normal cleaning operation, the illumination system 88 can be in a normal operation state at step 246. Various normal operation states are possible, including a state where at least one light of the illumination system 88 is activated to emit visible light. In some embodiments, the apparatus 10 can default to turning on the headlight 90H, both sidelights 90R, 90L, and the taillight 90T when the apparatus 10 is operating normally at step 246.

If an obstacle is on the right side of the base 16 at step 248, then the controller 46 then transmits a right edge cleaning control signal to the illumination system 88 at step 250 and light is emitted in a right edge cleaning state at step 252. In the right edge cleaning state, the right edge cleaning control signal can power the right sidelight 90R, and optionally also the headlight as shown in FIG. 49. In the right edge cleaning state, the right edge cleaning control signal can also optionally deactivate the left sidelight 90L and the taillight 90T.

If an obstacle is on the left side of the base 16 at step 254, then the controller 46 then transmits a left edge cleaning control signal to the illumination system 88 at step 256 and light is emitted in a left edge cleaning state at step 258. In the left edge cleaning state, the left edge cleaning control signal can power the left sidelight 90L, and optionally also the headlight 90H, as shown in FIG. 50. In the left edge cleaning state, the left edge cleaning control signal can also optionally deactivate the right sidelight 90R and the taillight 90T.

Figure 52:
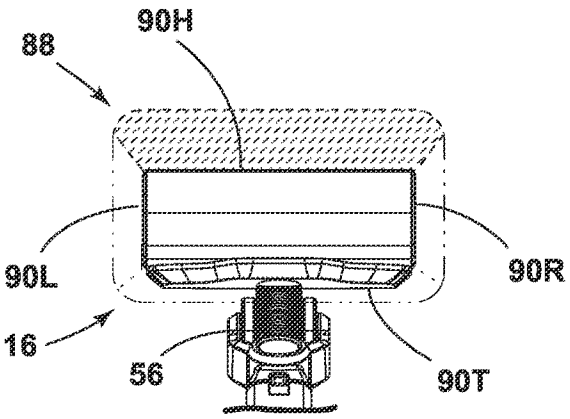
FIG. 52 is a top view of a base with an illumination system providing adaptive illumination for turning, where the base is in a center position.
Figure 53:
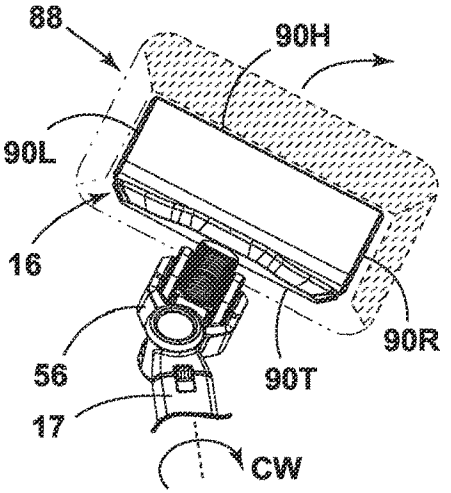
FIG. 53 is a top view of the base from FIG. 52 turned right.
Figure 54:
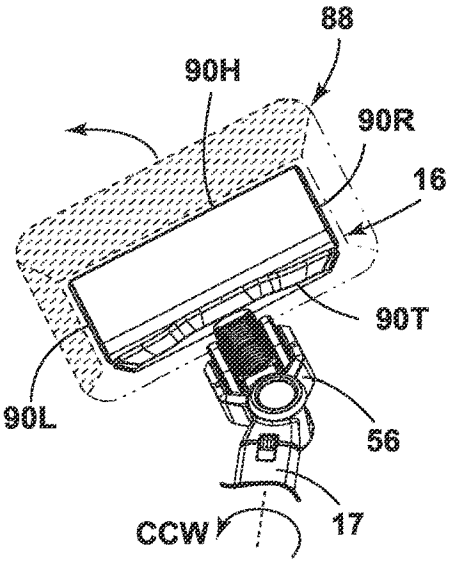
FIG. 54 is a top view of the base from FIG. 52 turned left.

In some embodiments, the apparatus 10 can be configured to automatically sense an obstacle on a side of the base 16 by generating sensor data during a cycle of operation of the surface cleaning apparatus with a sensor on-board the surface cleaning apparatus, processing the sensor data to determining whether an obstacle is on the right side or left side of the base 16, and generating an edge cleaning control signal based on the sensor data. In such an embodiment, the sensor 102 (FIG. 7) can be an infrared optical proximity sensor or another suitable sensor capable of detecting an obstacle on the side of the base 16. Optionally, the left sidelight 90L and/or taillight 90T can be turned off by the right edge cleaning control signal, and the right sidelight 90R and/or taillight 90T can be turned off by the left edge cleaning control signal FIGS. 52-54 show one embodiment of the illumination system 88 providing adaptive illumination for turning. During operation when the base 16 turns, the illumination system 88 can adapt the lighting to provide greater illumination for the direction in which the base 16 is turning. The controller 46 (FIG. 7) can control the illumination system 88 such that the illuminated portion of the base 16 appears to adapt with turning of the base 16. Generally, the illuminated portion can appear to angle to the left when the base 16 turns left and can appear to angle toward the right when the base 16 turns right. In FIGS. 52-54, the illumination system 88 is embodied as the illumination system 88 from FIGS. 10-13, although it is understood that the adaptive illumination for edge cleaning may be applied to any embodiment of the illumination system 88, base 16, or apparatus 10 described herein.

FIG. 52 is a top view showing the base 16 in a center position, with right and left turning positions shown in FIGS. 53 and 54, respectively. For the purposes of this embodiment, turning of the base 16 can comprise turning the base 16 right or left from the center position shown in FIG. 52. The swivel joint 56 connecting the base 16 to the upright body 17 causes the base 16 to turn right with a clockwise twist of the upright body 17 as indicated by arrow CW in FIG. 53 and causes the base 16 to turn left with a counterclockwise twist of the upright body 17 as indicated by arrow CCW in FIG. 54.

In one embodiment, during a normal cleaning operation and when the base 16 is in the center position, e.g. not turned with respect to the upright body 17, at least the headlight 90H and sidelights 90R, 90L, and optionally also the taillight 90T, are activated, with the headlight 90H emitting light at a greater intensity (e.g. appears brighter) than the sidelights 90R, 90L, and optionally also the taillight 90T if activated. When the base 16 is turned, the controller 46 can increase the intensity of light emitted along the corresponding turn side of the base 16.

In FIG. 53, the base 16 is turned right, and the intensity of light emitted from the right sidelight 90R increases above its initial level shown in FIG. 52. For example, the intensity of the right sidelight 90R may increase to match that of the headlight 90H. The intensity of light emitted from the left sidelight 90L and/or taillight 90T may remain unchanged during a right turn, or may decrease. When the base 16 is straightened out, the turning animation can run in reverse, such that the intensity of light emitted along the right side of the base 16 decreases, such as by decreasing back to its initial level shown in FIG. 40.

In FIG. 54, the base 16 is turned left, and the intensity of light emitted from the left sidelight 90L increases above its initial level shown in FIG. 52. For example, the intensity of the left sidelight 90L may increase to match that of the headlight 90H. The intensity of light emitted from the right sidelight 90R and/or taillight 90T may remain unchanged during a left turn, or may decrease. When the base 16 is straightened out, the turning animation can run in reverse, such that the intensity of light emitted along the left side of the base 16 decreases, such as by decreasing back to its initial level shown in FIG. 40.

Other turning animations are possible. For example, in one alternative embodiment, instead of changing the intensity, the controller 46 can operate the illumination system 88 to provide a turning animation as shown in described for FIG. 8G.

Figure 55:
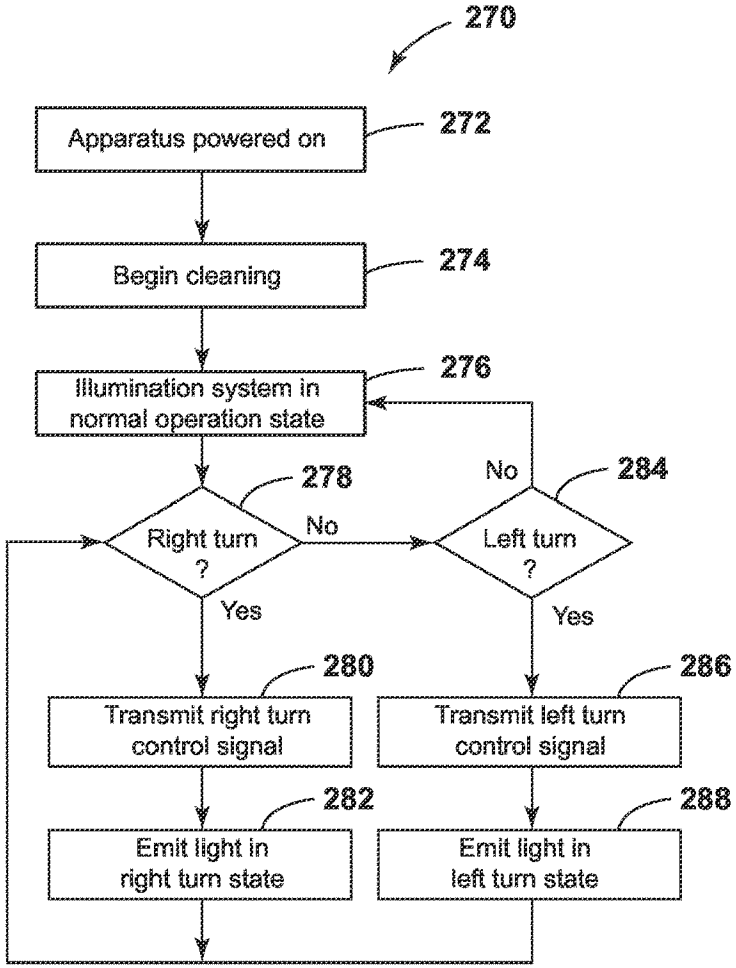
FIG. 55 is a flow chart depicting one embodiment of a method for adaptive illumination for turning.

FIG. 55 shows one embodiment of a method 270 for adaptive illumination of a floor surface during turning, including transmitting a right turn control signal to the illumination system 88 when the base 16 turns right, and transmitting a left turn control signal to the illumination system 88 when the base 16 turns left.

The method 270 may begin with powering the apparatus on at step 272, and beginning a cleaning operation at step 274. For a normal cleaning operation, the illumination system 88 can be in a normal operation state at step 276. Various normal operation states are possible, including a state where at least one light of the illumination system 88 is activated to emit visible light. In some embodiments, the apparatus 10 can default to turning on the headlight 90H, both sidelights 90R, 90L, and the taillight 90T when the apparatus 10 is operating normally at step 276. FIG. 52 shows one embodiment of a normal operation state for step 276, where the headlight 90H emits light at a greater intensity than the sidelights 90R, 90L, and taillight 90T.

If right turn is made at step 278, then the controller 46 transmits a right turn control signal to the illumination system 88 at step 280. The right turn control signal can increase the intensity of light emitted from the right sidelight 90R, as shown in FIG. 53, at step 282. The intensity of light emitted from the headlight 90H, left sidelight 90L, and taillight 90T may remain the same. This effect results in the illumination appearing to angle to the right when the base 16 turns right. In some embodiments, this effect can be further enhanced by the right turn control signal decreasing the intensity of light emitted from the left sidelight 90L and/or the taillight 90T.

If left turn is made at step 284, then the controller 46 then transmits a left turn control signal to the illumination system 88 at step 286. The left turn control signal can increase the intensity of light emitted from the left sidelight 90L, as shown in FIG. 54, at step 288. The intensity of light emitted from the headlight 90H, right sidelight 90R, and taillight 90T may remain the same. This effect results in the illumination appearing to angle to the left when the base 16 left right. In some embodiments, this effect can be further enhanced by the left turn control signal decreasing the intensity of light emitted from the right sidelight 90R and/or the taillight 90T.

In some embodiments, the illumination of the sidelights 90R, 90L can be controlled such that light intensity increases in proportion with the turn angle. That is, the visible light gradually gets brighter as the base 16 is turned farther away from center, and gradually gets dimmer as the base 16 is turned toward center, until it reaches its initial intensity when the base 16 is centered.

The apparatus 10 can be configured to automatically sense turning of the base 16 by generating sensor data with a sensor on-board the surface cleaning apparatus, processing the sensor data to determining whether the base 16 turns right or left, and generating a turn control signal based on the sensor data. In such an embodiment, the sensor 102 (FIG. 7) can be a rotational position sensor located in the swivel joint 56.

Thus far, embodiments of illumination systems with adaptive illumination for edge cleaning and turning have been discussed. Other embodiments of adaptive illumination are possible. For example, the illumination system 88 can provide adaptive illumination for forward and backward cleaning strokes. During operation, a user moves the base 16 forwardly for a forward stroke and rearward for a backward stroke. The illumination system 88 can adapt the lighting to provide greater illumination for the direction in which the base 16 is moving. The controller 46 (FIG. 7) can control the illumination system 88 such that the intensity of light emitted from the headlight 90H increases with a forward stroke and the intensity of light emitted from the taillight 90T increases with a backward stroke.

Although the figures have thus far shown aspects and embodiments of the illumination system 88 in the context of a cleaning apparatus comprising a stick-type, convertible vacuum cleaner, it is recognized that numerous variations are possible whereby the embodiments of the illumination system 88 can be configured for incorporation into virtually any type of floor cleaning apparatus. According to the invention, the floor cleaning apparatus can be any apparatus capable of cleaning, treating, or disinfecting a surface to be cleaned. The floor cleaning apparatus can include, but is not limited to any of the following: a wet/dry vacuum cleaner, an autonomous floor cleaner, an unattended spot-cleaning apparatus or deep cleaner, an upright deep cleaner or extractor, a handheld extractor, a vacuum cleaner, a sweeper, a mop, a steamer, an ultraviolet radiation disinfecting device, a treatment dispensing device, and combinations thereof.

Figure 57:
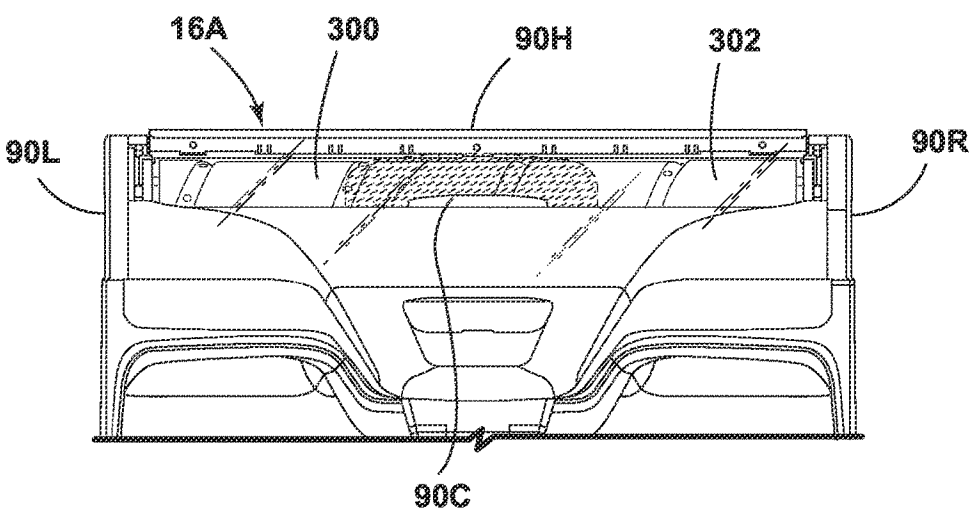
FIG. 57 is a top view of a base of the apparatus of FIG. 56, showing the illumination system indicating a dispensing state.
Figure 58:
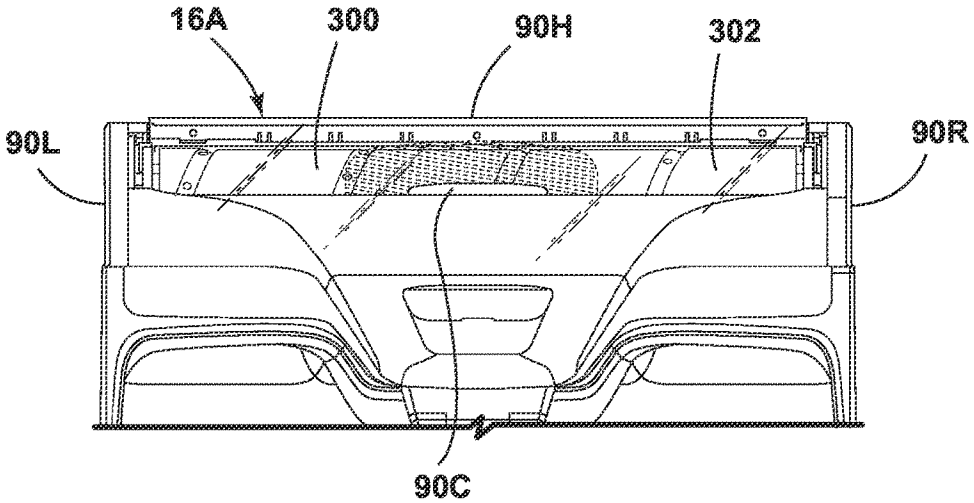
FIG. 58 is a top view of a base of the apparatus of FIG. 56, showing the illumination system indicating an alert state.
Figure 56:
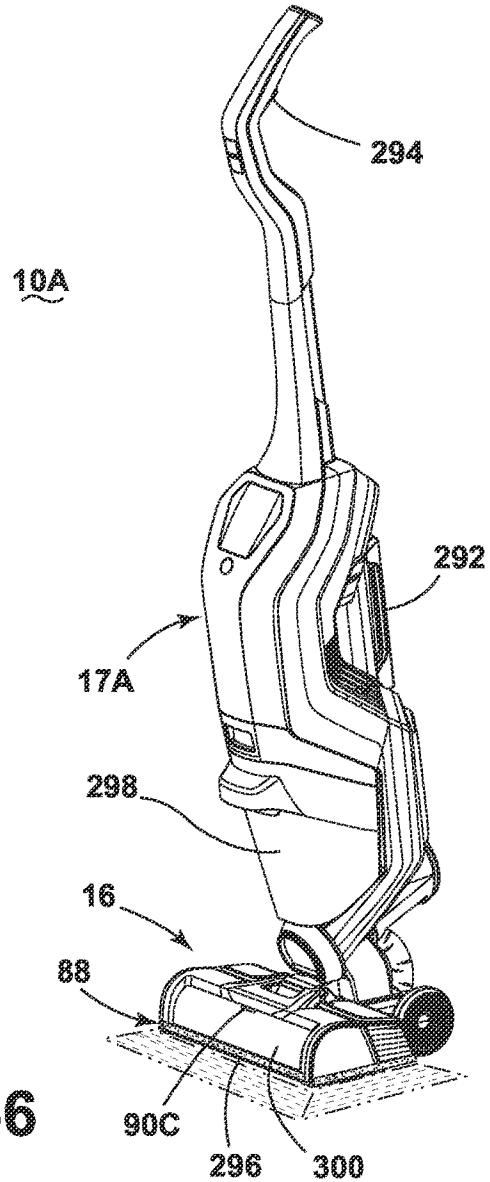
FIG. 56 is a perspective view of a surface cleaning apparatus in the form of a wet/dry wet vacuum cleaner according to another embodiment of the invention.

FIGS. 56-58 show a surface cleaning apparatus in the form of a wet/dry wet apparatus 10A according to another aspect of the present disclosure. In this embodiment, the surface cleaning apparatus is a wet/dry wet vacuum cleaner that can be used to clean hard floor surfaces such as tile and hardwood and soft floor surfaces such as carpet. The wet/dry apparatus 10 has an upright body 17A pivotally connected to a base 16A for directing the base 16A across the surface to be cleaned. The illumination system 88 can be substantially similar to the embodiments of the illumination system described previously, and can includes at least one additional light 90C disposed on an upper side of the base 16, provided in addition to one or more of the headlight 90H, sidelights 90R, 90L, and taillight 90T. The light 90C can visually convey a status, alert, or error, alert, while the headlight 90H, sidelights 90R, 90L, and taillight 90T emit visible light to illuminate the surface to be cleaned, providing the user with status information without disrupting the illumination of the surface.

The cleaner 10A includes a fluid delivery system configured to store cleaning fluid (e.g. liquid) and deliver the cleaning fluid to the surface to be cleaned, and a recovery system for removing debris and liquid from the surface to be cleaned. The delivery system may include at least a supply tank 292 and a fluid distributor (not shown) in the base 16A for delivering the cleaning fluid from the supply tank 292 to the floor surface. Various combinations of additional components can be incorporated into the fluid delivery system, such as a fluid pump, a heater, and/or fluid control and mixing valves, as well as suitable conduits or tubing fluidly connecting the components of the fluid delivery system together to effect the supply of cleaning fluid from the supply tank to the fluid distributor. A trigger 294 or other input control controls fluid delivery from the supply tank 292 via an electronic or mechanical coupling with the tank 292. The recovery system may include a suction nozzle 296, a suction source (not shown) in fluid communication with the suction nozzle 296 for generating a working air stream, and a recovery container 298 for separating and collecting fluid and debris from the working airstream for later disposal. Non-limiting example of wet/dry vacuum cleaners are disclosed in U.S. Pat. No. 10,092,155 to Xia et al. and U.S. Patent Application Publication No. 2020/0214527 to Resch et al., which are incorporated herein by reference in their entirety.

The illumination system 88 can be disposed on the base 16A, and can include one or more of the headlight 90H, sidelights 90R, 90L, and taillight 90T as previously described. The location of the light 90C on the upper side of the base 16 makes the emitted visible light easy to see from the typical operating position of the user behind and above the base 16A. Various locations for the light 90C on the base 16A are possible. In one embodiment, the light 90C can be located behind by a nozzle cover 300 defining the suction nozzle 296 and a chamber for a brushroll 302, and can be disposed at an upper rear side of the brushroll 302. The cover 300 can be formed at least partially from a transparent, semi-transparent, or translucent material, and may, for example, allow a user to view visible light emitted from the 90C, as well as the brushroll 302, from the typical operating position of the user behind and above the base 16A. The emitted visible light 90C passing through the cover 300 may be refracted or diffused such that a portion of the cover 300 may appear to glow.

The light 90C can include at least one light source comprising at least one light emitting element, such as, but not limited to, a light emitting diode (LED), an organic LED (OLED), a chip-on-board LED, a laser or laser diode, a regular lamp (arc lamp, gas discharge lamp, etc.), bulbs, or other light emitting device. The light 90C can comprise multiple light emitting elements, such as multiple LEDs. For an LED light source, an RGB LED may be preferred in order to produce lights in varying colors to indicate different statuses, errors, and/or alerts for the apparatus 10.

FIG. 57 is a top view of the base 16A showing the illumination system in a dispensing state. For the dispensing state, the indicator light 90C can emit blue light, optionally in a pulsing or breathing animation. One or more of the headlight 90H, sidelights 90R, 90L, and taillight 90T may be on to illuminate the surface to be cleaned, and in some cases so that a user can see where fluid has been dispensed on the surface.

In some embodiments, a control signal for the illumination system to operate in the dispensing state can be generated based on user input. For example, a user can depress trigger 294 to put the apparatus 10A into the dispensing state, thereby dispensing cleaning fluid and providing a visual confirmation of dispensing via light 90C.

FIG. 58 is a top view of the base 16A showing the illumination system in an alert state. For the alert state, the indicator light 90C can emit orange or amber light, optionally in a pulsing or breathing animation. To further draw the user's attention, for the alert state, one or more of the headlight 90H, sidelights 90R, 90L, and taillight 90T may be tuned off.

It is noted that the indicator light 90C may also communicate other states for the apparatus 10A. For example, an error state may be communicated, such as by the indicator light 90C, emitting red light in a flashing animation, creating a more urgent visual effect.

Figure 59:
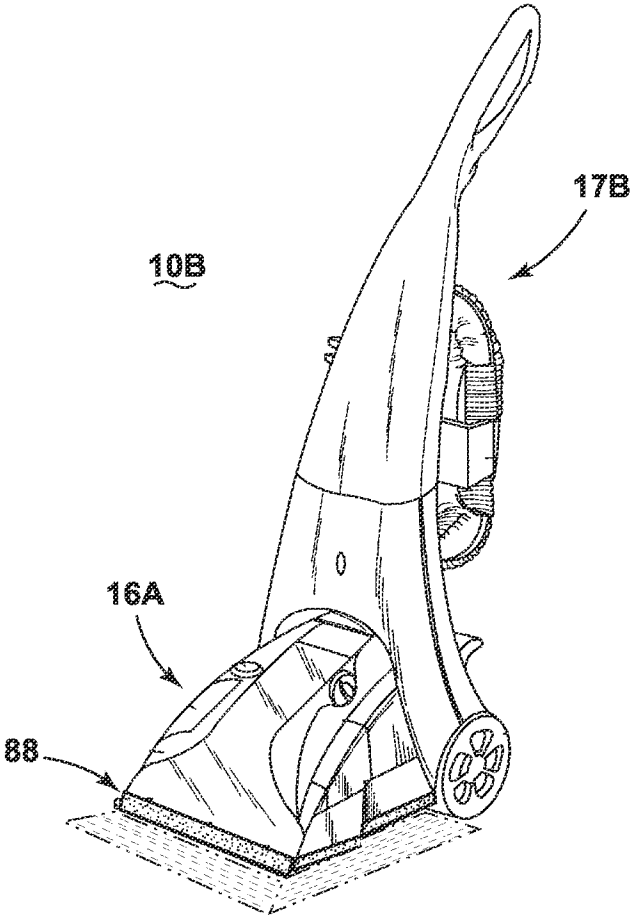
FIG. 59 is a perspective view of a surface cleaning apparatus in the form of an upright deep cleaner according to another embodiment of the invention.

FIG. 59 shows an embodiment of an upright deep cleaner 10B comprising an illumination system 88 according to any of the aspects and embodiments described herein. The deep cleaner 10B has an upright handle assembly 17B pivotally connected to a base 16B for directing the base 16B across the surface to be cleaned. The illumination system 88 can be disposed on the base 16B. A non-limiting example of the upright extraction cleaner is disclosed in U.S. Pat. No. 6,131,237 to Kasper et al., which is incorporated herein by reference in its entirety.

Figure 60:
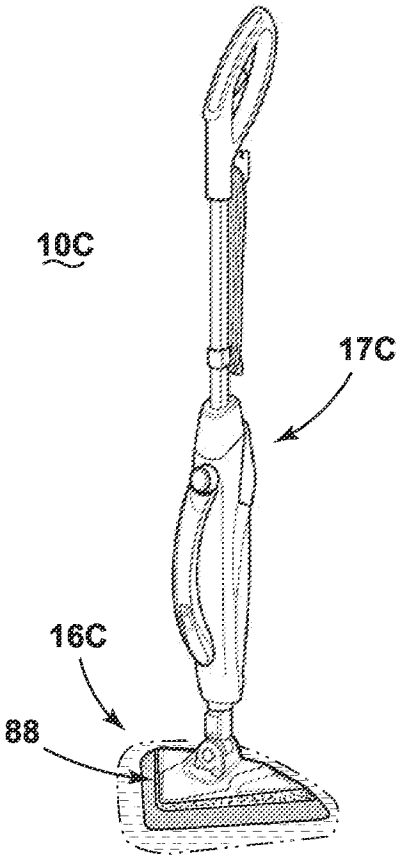
FIG. 60 is a perspective view of a surface cleaning apparatus in the form of a steam mop according to another embodiment of the invention.

FIG. 60 shows an embodiment of a steam mop 100 comprising an illumination system 88 according to any of the aspects and embodiments described herein. The steam mop 10C has an upright handle assembly 17C pivotally connected to a base 16C for directing the base 16C across the surface to be cleaned. The illumination system 88 can be disposed on the base 16C. A non-limiting example of the steam mop is disclosed in U.S. Pat. No. 9,320,405, issued Apr. 26, 2016, which is incorporated herein by reference in its entirety.

Figure 61:
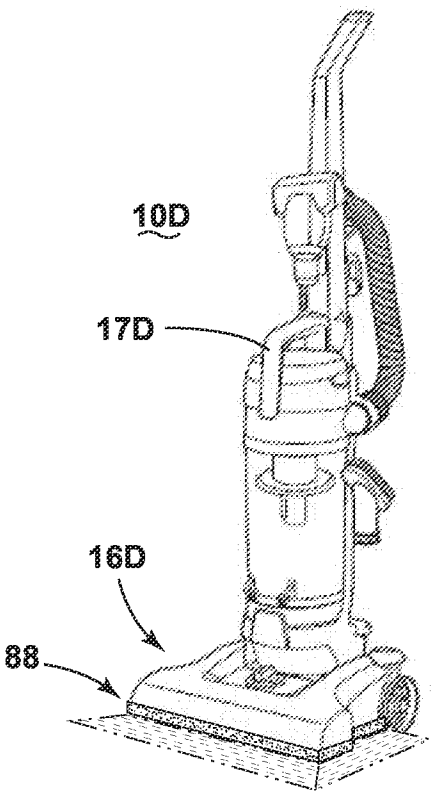
FIG. 61 is a perspective view of a surface cleaning apparatus in the form of an upright vacuum cleaner according to another embodiment of the invention.

FIG. 61 shows an embodiment of an upright vacuum cleaner 10D comprising an illumination system 88 according to any of the aspects and embodiments described herein. The upright vacuum cleaner 10D has an upright handle assembly 17D pivotally connected to a base 16D for directing the base 16D across the surface to be cleaned. The illumination system 88 can be disposed on the base 16D. A non-limiting example of the upright vacuum cleaner is disclosed in U.S. Pat. No. 9,392,919, issued Jul. 19, 2016, which is incorporated herein by reference in its entirety.

Figure 62:
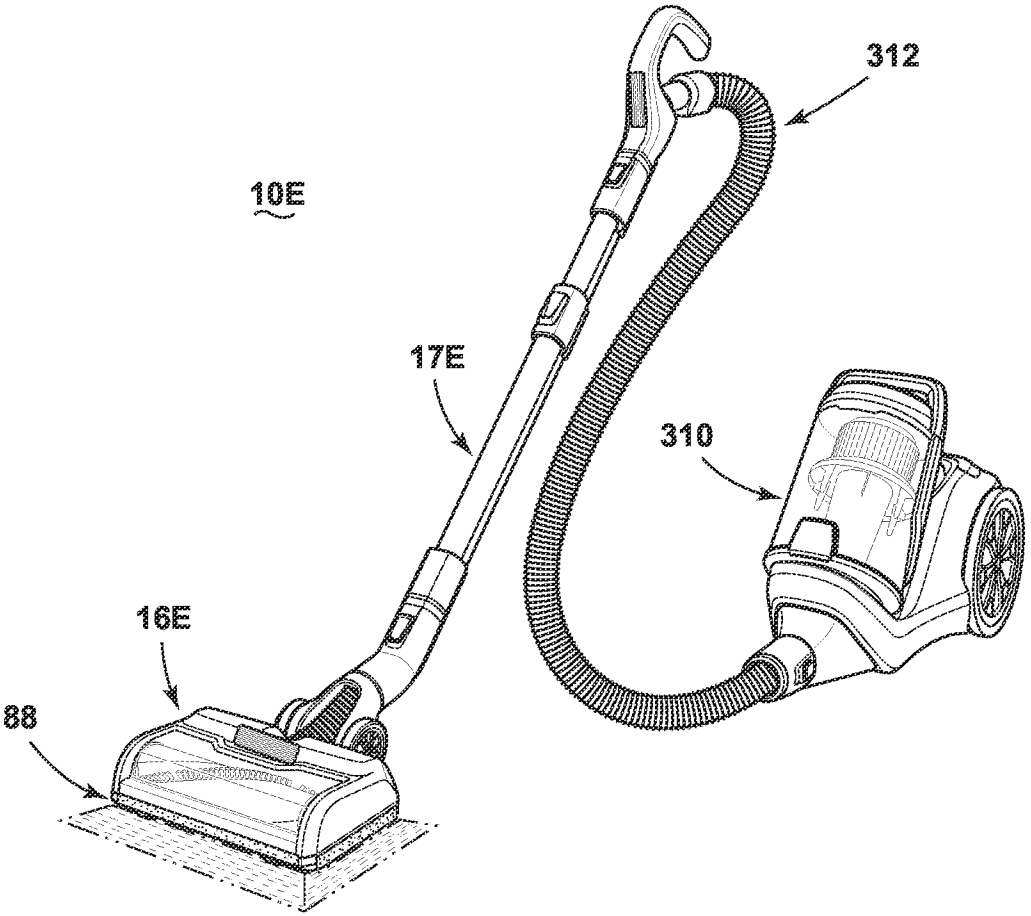
FIG. 62 is a schematic view of a surface cleaning apparatus in the form of a canister vacuum cleaner according to another embodiment of the invention.

FIG. 62 shows an embodiment of a canister vacuum cleaner 10E comprising an illumination system 88 according to any of the aspects and embodiments described herein. The canister vacuum cleaner 10E has a canister unit 310 connected to a cleaning head 16E via a flexible hose 312. The cleaning head 16E can be coupled with a wand 17E for directing the cleaning head 16E across the surface to be cleaned. The illumination system 88 can be disposed on the cleaning head 16E. A non-limiting example of the canister vacuum cleaner is disclosed in U.S. Pat. No. 9,795,261, issued Oct. 24, 2017, which is incorporated herein by reference in its entirety.

Figure 63:
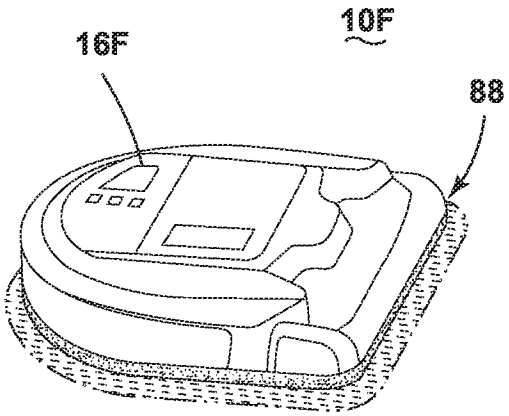
FIG. 63 is a schematic view of a surface cleaning apparatus in the form of an autonomous floor cleaner according to another embodiment of the invention.

FIG. 63 shows an embodiment of an autonomous floor cleaner 10F comprising an illumination system 88 according to any of the aspects and embodiments described herein. The autonomous floor cleaner 10F comprises an autonomously moveable housing 16F adapted for movement over a surface to be cleaned and a drive system configured to autonomously move the housing 16F over a surface to be cleaned. The housing 16F is D-shaped, but in other embodiments may be round or circular in shape. The lights of the illumination system 88 may be disposed on the lateral side of the housing 16F as shown, or may be disposed on top of the housing 16F. A non-limiting example of the autonomous floor cleaner is disclosed in U.S. Pat. No. 10,595,694, issued Mar. 24, 2020, which is incorporated herein by reference in its entirety.

Figure 64:
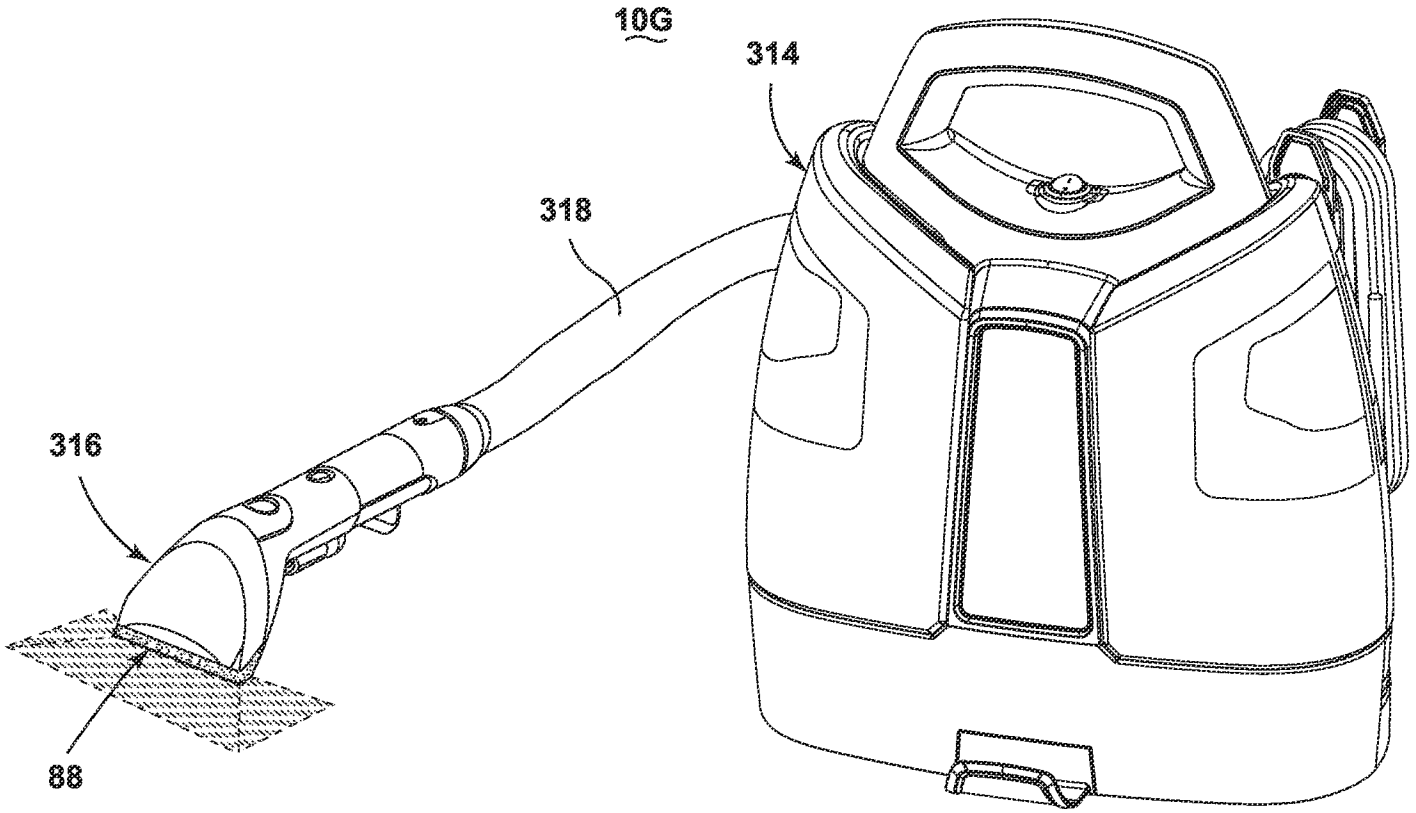
FIG. 64 is a schematic view of a surface cleaning apparatus in the form of an portable extraction cleaner according to another embodiment of the invention.

FIG. 64 shows an embodiment of a portable extraction cleaner 10G comprising an illumination system 88 according to any of the aspects and embodiments described herein. The portable extraction cleaner 10G comprises a hand-carried body or pod 314 and a hand-held cleaning tool 316 coupled to the pod 314 by a flexible hose 318. The illumination system 88 may be disposed on the tool 316, on the pod 314, on the hose 318, or on any combination thereof, and may be configured in a manner similar to that described above with respect to FIGS. 16-39, 43A-48. In one example, the cleaning tool 316 forms a base that is moveable over a surface to be cleaned and carries the illumination system 88 configured to illuminate a surface being cleaned as the body of the cleaning tool 316 is being moved over the surface in a manner similar to that described above with respect to FIGS. 1-15, 49-55. In another example, the body 314, while not moveable relative to a surface during cleaning, can include an illumination system configured to illuminate an adjacent surface to communicate alert and/or error information to the user, in a manner similar to that described above with respect to FIGS. 7-15. A non-limiting example of a portable extraction cleaner is disclosed in U.S. Pat. No. 9,615,703, issued Apr. 11, 2017, which is incorporated herein by reference in its entirety.

There are several advantages of the present disclosure arising from the various aspects or features of the apparatus, systems, and methods described herein. For example, aspects described above provide an illumination system for a surface cleaning apparatus with a brighter field of view and greater awareness while cleaning. With some embodiments of the illumination system disclosed herein, users have enhanced directional illumination, enabling better spotting of debris on the surface and making it easier to confirm when the debris is picked up. A greater visibility of pet hair and other debris on all types of floor surfaces is provided. With illumination to the front and/or sides of the apparatus, a user can more clearly see where to clean next, and with illumination on the rear of the apparatus, the user can see how well the apparatus has cleaned a section of the surface after passing over that section.

Another advantage of some embodiments of the present disclosure is that the illumination system provides diffused visible light, reducing eye strain for users and eliminating bright hot-spots of light.

Yet another advantage of some embodiments of the present disclosure is that the illumination system can double as a communication output device. For example, aspects described above provide an illumination system that provides visible indication of a condition, status, state, alert, or error to the user, in addition to illuminating the surface to be cleaned. The various embodiments of the illumination system and related methods disclosed herein improves user experience and discourage improper operation of the apparatus, This integration of floor illumination and status indicators provides users with a high-quality and tailorable lighting visible from multiple directions.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various vacuum cleaner configurations as desired to form new embodiments, whether or not the new embodiments are expressly described.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. An upright surface cleaning apparatus comprising:

a base adapted for movement over a surface to be cleaned and having a plurality of sides, including at least a front side, a first lateral side, a second lateral side, and a rear side;

an upright body moveably mounted to the base and comprising a handle;

at least one of a fluid delivery system, recovery system, or a combination thereof;

a controller; and an illumination system operably coupled with the controller to receive input from the controller, the illumination system comprising lighting extending along at least at least a portion of the front side, the first lateral side, and the second lateral side of the base;

wherein the lighting is configured to emit visible light onto the surface to be cleaned to produce an illumination zone that extends greater than 180 degrees around the base to provide greater than 180 degrees of illumination around the base;

wherein the lighting extends along at least a portion of the rear side.

2. The upright surface cleaning apparatus of claim 1, wherein the illumination zone extends at least 270 degrees around the base to provide at least 270 degrees of illumination around the base.

3. The upright surface cleaning apparatus of claim 1, wherein the illumination zone extends 360 degrees around the base to provide 360 degrees of illumination around the base.

4. The upright surface cleaning apparatus of claim 3, wherein the lighting extends along at least a portion of the rear side of the base.

5. The upright surface cleaning apparatus of claim 1, wherein the front lateral side meets the first lateral side at a corner, and the lighting wraps around the corner to extend from the front side to the first lateral side.

6. The upright surface cleaning apparatus of claim 1, wherein:

the base comprises a rectilinear housing generally having:

a forward oriented portion of the rectilinear housing comprising the front side;

a first laterally oriented portion of the rectilinear housing comprising the first lateral side;

a second laterally-oriented portion of the rectilinear housing comprising the second lateral side; and a rearward oriented portion of the rectilinear housing comprising the rear side; and the lighting comprises:

a first light on the forward oriented portion of the rectilinear housing, the first light configured to emit visible light from the forward oriented portion of the rectilinear housing;

a second light on the first laterally orientated portion, the second light configured to emit visible light from the first laterally orientated portion; and a third light on the second laterally orientated portion of the rectilinear housing, the third light configured to emit visible light from the second laterally orientated portion;

wherein the first light, second light, and third light produce the illumination zone that extends greater than 180 degrees around the base to provide greater than 180 degrees of illumination around the base.

7. The upright surface cleaning apparatus of claim 1, wherein the lighting comprises:

a first light on the front side of the housing, the first light comprising a first plurality of light sources;

a second light on the first lateral side of the housing, the second light comprising a second plurality of light sources; and a third light on the second lateral side of the housing, the third light comprising a third plurality of light sources;

wherein the first light, second light, and third light produce the illumination zone that extends greater than 180 degrees around the base to provide greater than 180 degrees of illumination around the base.

8. The upright surface cleaning apparatus of claim 7, comprising a diffuser disposed in front of at least one of the first, second, and third plurality of light sources, the diffuser defining an exterior surface of the base.

9. A surface cleaning apparatus comprising:

a housing adapted for movement over a surface to be cleaned;

at least one of a fluid delivery system, recovery system, or a combination thereof;

a controller;

a headlight on a forward oriented portion of the housing, the headlight configured to emit visible light from the forward oriented portion of the housing;

a taillight on a rearward oriented portion of the housing, the taillight configured to emit visible light from the rearward oriented portion of the housing;

a first sidelight on a first laterally orientated portion of the housing, the first sidelight configured to emit visible light from the first laterally orientated portion of the housing; and a second sidelight on a second laterally orientated portion of the housing, the second sidelight configured to emit visible light from the second laterally orientated portion of the housing;

wherein the headlight, taillight, first sidelight and second sidelight together provide lighting around the housing.

10. The surface cleaning apparatus of claim 9, wherein:

the headlight is configured to emit visible light from the housing towards a first region on the surface to be cleaned in front of the forward oriented portion of the housing;

the first sidelight is configured to emit visible light from the housing toward a second region on the surface to be cleaned outward of the first laterally orientated portion of the housing;

the second sidelight configured to emit visible light from the housing toward a third region on the surface to be cleaned outward of the second laterally orientated portion of the housing; and the taillight is configured to emit visible light from the housing towards a fourth region on the surface to be cleaned in back of the rearward oriented portion of the housing.

11. The surface cleaning apparatus of claim 9, wherein:

the headlight is configured to emit visible light from the housing to produce a front illuminated zone;

the first sidelight is configured to emit visible light from the housing to produce a first side illuminated zone;

the second sidelight configured to emit visible light from the housing to produce a second side illuminated zone; and the taillight is configured to emit visible light from the housing to produce a rear illuminated zone.

12. The surface cleaning apparatus of claim 9, wherein:

the headlight comprises a beam angle of at least 90 degrees;

the taillight comprises a beam angle of at least 90 degrees;

the first sidelight comprises a beam angle of at least 90 degrees; and the second sidelight comprises a beam angle of at least 90 degrees.

13. The surface cleaning apparatus of claim 9, wherein the headlight, taillight, first sidelight and second sidelight together provide 360 degrees of lighting around the housing.

14. The surface cleaning apparatus of claim 9, wherein the housing comprises a rectilinear housing having the forward oriented portion extending between the first laterally oriented portion and the second laterally oriented portion, and the rearward oriented portion lying generally parallel to the forward oriented portion and extending between the first laterally oriented portion and the second laterally oriented portion.

15. The surface cleaning apparatus of claim 9, comprising:

a base adapted for movement over a surface to be cleaned and having a plurality of sides, the base including the housing; and an upright body pivotally mounted to the base and comprising a handle.

16. The surface cleaning apparatus of claim 15, wherein the base comprises a suction nozzle in fluid communication with a collection container, and the suction nozzle has a suction inlet port on a surface-facing underside of the housing, the suction nozzle having a nozzle cover, and the headlight is disposed behind the nozzle cover and emits visible light approximately parallel to the surface-facing underside of the housing.

17. The surface cleaning apparatus of claim 16, wherein the first sidelight and the second sidelight emit visible light approximately parallel to the surface-facing underside of the housing.

18. The surface cleaning apparatus of claim 17, wherein the taillight emits visible light approximately parallel to the surface-facing underside of the housing.

19. The surface cleaning apparatus of claim 9, wherein the taillight provides alert and error notifications.

* * * * *